US008599222B2

(12) United States Patent
Ishiguro et al.

(10) Patent No.: US 8,599,222 B2
(45) Date of Patent: Dec. 3, 2013

(54) METHOD OF DRIVING PIXEL CIRCUIT, LIGHT EMITTING DEVICE, AND ELECTRONIC APPARATUS

(75) Inventors: Hideto Ishiguro, Shiojiri (JP); Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 807 days.

(21) Appl. No.: 12/544,563

(22) Filed: Aug. 20, 2009

(65) Prior Publication Data

US 2010/0053233 A1 Mar. 4, 2010

(30) Foreign Application Priority Data

Sep. 4, 2008 (JP) ..... 2008-226735
Sep. 4, 2008 (JP) ..... 2008-226736
Sep. 26, 2008 (JP) ..... 2008-247525

(51) Int. Cl.
*G09G 5/10* (2006.01)

(52) U.S. Cl.
USPC ..... 345/690; 345/77; 345/204

(58) Field of Classification Search
None
See application file for complete search history.

(56) References Cited

U.S. PATENT DOCUMENTS 3,714,511 A * 1/1973 Fendrich, Jr. ..... 361/59
6,583,775 B1 6/2003 Sekiya et al.
7,138,967 B2 * 11/2006 Kimura ..... 345/76
7,259,735 B2 * 8/2007 Kasai ..... 345/77
7,535,442 B2 5/2009 Yamashita et al.
7,760,167 B2 7/2010 Uchino et al.
7,834,823 B2 11/2010 Uchino et al.
2003/0090447 A1 * 5/2003 Kimura ..... 345/82
2003/0112205 A1 * 6/2003 Yamada ..... 345/32
2003/0156084 A1 * 8/2003 Tsuchiya et al. ..... 345/84
2004/0257353 A1 * 12/2004 Imamura et al. ..... 345/204
2004/0263506 A1 * 12/2004 Koyama et al. ..... 345/204
2006/0158402 A1 * 7/2006 Nathan et al. ..... 345/82
2006/0176250 A1 * 8/2006 Nathan et al. ..... 345/76
2007/0085785 A1 * 4/2007 Ozaki et al. ..... 345/77
2007/0115215 A1 * 5/2007 Kanauchu et al. ..... 345/63
2007/0268210 A1 11/2007 Uchino et al.
2008/0001545 A1 1/2008 Uchino et al.

FOREIGN PATENT DOCUMENTS

JP A-2001-060076 3/2001
JP A-2006-084899 3/2006
JP A-2007-310311 11/2007
JP A-2007-534015 11/2007
JP A-2008-9198 1/2008
JP A-2008-026467 2/2008
JP A-2008-032861 2/2008
JP A-2008-191296 8/2008
JP A-2008-216353 9/2008
WO WO 2005/101267 A2 10/2005

* cited by examiner

*Primary Examiner* — James Wozniak
*Assistant Examiner* — Antonio Xavier
(74) *Attorney, Agent, or Firm* — Oliff & Berridge, PLC

(57) ABSTRACT

There is provided a method of driving a pixel circuit that includes a light emitting element; a driving transistor that is connected to the light emitting element in series; a storage capacitor that is interposed between a path, which is formed between the light emitting element and the driving transistor, and a gate of the driving transistor; a selection switch that is interposed between the gate of the driving transistor and a signal line; and a first control switch that is interposed between the gate of the driving transistor and the signal line and is connected to the selection switch in series.

12 Claims, 32 Drawing Sheets

GA[i]
GB[i]
VEL[i]
S[j]
VG
VS
i-TH ROW
H[i-3]
H[i-2]
H[i-1]
H[i]
H[i+1]
h1
h2
TSL: ON
TCR1: ON
V1
V2
VREF
VDATA[i-3]
VDATA[i-2]
VDATA[i-1]
VDATA[i]
VD[i+1]
VGS1
VGS3
VTH
tb (i-1)-TH ROW
i-TH ROW
(i+1)-TH ROW
COMPENSATION [1]
RESET
DRIVING
WRITE + COMPENSATION [2]

GA[i]
Grst[i]
GC[i]
VCT[i]
S[j]
VS
VG
VL1
i-TH ROW
H[i-4]
H[i-3]
H[i-2]
H[i-1]
H[i]
H[i+1]
h1
h2
VCT1
VCT2
VREF
VDATA [i-4]
VDATA [i-3]
VDATA [i-2]
VDATA [i-1]
VDATA [i]
VDATA [i+1]
VEL
Vrst
VREF
VDATA
VGS1
ΔVG
ΔVL1
VTH
tb (i-1)-TH ROW
i-TH ROW
(i+1)-TH ROW
RESET
DRIVING
COMPENSATION [1]
COMPENSATION [2]

GA[i]
Grst[i]
GC[i]
GEL[i]
VCT[i]
S[j]
VS
VG
VA
VL1
i-TH ROW
VCT1
VCT2
VEL
Vrst
VREF
VDATA
H[i-4]
H[i-3]
H[i-2]
H[i-1]
H[i]
H[i+1]
h1
h2
VDATA [i-4]
VDATA [i-3]
VDATA [i-2]
VDATA [i-1]
VDATA [i]
VDATA [i+1]
VGS1
ΔVG
ΔVL1
VTH
tb
ΔV2

(i-1)-TH ROW
i-TH ROW
(i+1)-TH ROW
DRIVING
COMPENSATION [1]
COMPENSATION [2]
RESET

GA[i]
Grst[i]
GC[i]
GEL[i]
GB[i]
VCT[i]
S[j]
VS
VG
VA
VL1
i-TH ROW
H[i-4]
H[i-3]
H[i-2]
H[i-1]
H[i]
H[i+1]
VDATA [i-4]
VDATA [i-3]
VDATA [i-2]
VDATA [i-1]
VDATA [i]
VDATA [i+1]
VCT1
VCT2
VEL
Vrst
VREF
VDATA
VTH
tb
VGS1
VG
VA
VL1

(i-1)-TH ROW
i-TH ROW
(i+1)-TH ROW
COMPENSATION [1]
COMPENSATION [2]
RESET
DRIVING

METHOD OF DRIVING PIXEL CIRCUIT, LIGHT EMITTING DEVICE, AND ELECTRONIC APPARATUS

BACKGROUND

1. Technical Field

The present invention relates to a light emitting device such as an organic EL (electroluminescence) device.

2. Related Art

Light emitting devices in which a driving transistor controls the amount of a driving current supplied to a light emitting element suffer from errors (deviations from a target value or non-uniformity between elements) in the electrical characteristics of the driving transistors or the light emitting elements. JP-A-2007-310311 discloses a technique for compensating for errors in the threshold voltage and mobility (furthermore, errors in the amount of driving current) of a driving transistor by setting a voltage across a storage capacitor interposed between the gate and the source of the driving transistor to the threshold voltage of the driving transistor and changing the voltage across the storage capacitor to a voltage corresponding to a gray scale value. However, in JP-A-2007-310311, the errors in the driving current may be effectively compensated only in the cases where a gray scale value is specifically designated. Therefore, errors in the driving current in some gray scale values may not be removed.

However, the error in the driving current can be effectively compensated by using the technology disclosed in JP-A2007-310311 only for a case where a specific gray scale value is designated. Thus, there are cases where the error in the driving current cannot be eliminated depending on the gray scale value.

SUMMARY

An advantage of some aspects of the invention is that it provides a method of driving a pixel circuit, a light emitting device, and an electronic apparatus that are capable of suppressing the error in the driving current for a plurality of gray scale values.

According to a first aspect of the invention, there is provided a method of driving a pixel circuit that includes: a light emitting element; a driving transistor that is connected to the light emitting element in series; and a storage capacitor that is interposed between a path, which is formed between the light emitting element and the driving transistor, and a gate of the driving transistor. The method includes: having a voltage between both ends of the storage capacitor gradually approach a threshold voltage of the driving transistor for a compensation period as a first compensation operation for a compensation period by having the driving transistor to be in the conductive state and supplying a reference electric potential (for example, the reference electric potential VREF) to the gate of the driving transistor; changing the electric potential of the gate of the driving transistor in accordance with a gray scale electric potential according to a gray scale value designated to the pixel circuit and having the voltage between both ends of the storage capacitor gradually approach the threshold voltage of the driving transistor over a temporal length (for example, a temporal length tb) that is set to be changed in accordance with the gray scale value for a write period after the elapse of the compensation period as a second compensation operation; and supplying a driving current according to the voltage between the both ends of the storage capacitor to the light emitting element by stopping supply of the electric potential to the gate of the driving transistor for a driving period after elapse of the write period. According to the above-described driving method, the temporal length of the second compensation operation is set to be changed in accordance with the gray scale value (or the gray scale electric potential). Accordingly, it is possible to effectively suppress the error in the driving current for a plurality of the gray scale values.

In addition, described in more details, under a premise that the temporal length of the second compensation operation, for which the error in the driving current can be suppressed, tends to be shortened as the amount of change in the voltage (for example, a voltage VIN) between both ends of the storage capacitor at the time of supply of the gray scale electric potential in the write period increases, the temporal length of the second compensation operation is set to be changed in accordance with the gray scale value that is designated to the pixel circuit, so that the temporal length of the second compensation operation is shortened as the amount of change in the voltage (for example, the voltage VIN) between both ends of the storage capacitor at the time of supply of the gray scale electric potential in the write period is increased. For example, the temporal length of the second compensation operation is set to be changed in accordance with the gray scale value that is designated to the pixel circuit, so that a value acquired by multiplying the amount of change in the voltage between both ends of the storage capacitor at the time of supply of the gray scale electric potential in the write period by the temporal length of the second compensation operation approaches a predetermined value.

However, under the tendency that the temporal length of the second compensation operation, for which the error in the driving current is suppressed, is lengthened as the gray scale value is smaller, in order to minimize the error in the driving current even for a case where the gray scale value is small, an excessively long temporal length needs to be acquired for the second compensation operation. Thus, according to an embodiment of the invention, when the gray scale value is smaller than a predetermined value, the temporal length of the second compensation operation is set to a predetermined value (for example, a temporal length tmax shown in FIG. 10) that does not depend on the gray scale value (in other words, the upper limit of the temporal length of the second compensation operation is set). In such a case, there is an advantage that the temporal length of the second compensation operation is suppressed to an appropriate length even when the gray scale value is small.

It is preferable that the voltage between both ends of the storage capacitor is set to the threshold voltage of the driving transistor for the compensation period by performing the first compensation operation. In such a case, there is an advantage that the error in the threshold voltage of the driving transistor is compensated accurately by performing the first compensation operation. A detailed example of the above-described aspect will be described, for example, as a first embodiment of the invention. In addition, in order for the voltage between both ends of the storage capacitor to exactly match the threshold voltage of the driving transistor, logically, an infinite temporal length is needed. Accordingly, to set the voltage between both ends of the storage capacitor to the threshold voltage of the driving transistor, according to an embodiment of the invention represents a state (a state in which the threshold voltage is substantially reached) in which the voltage between both ends of the storage capacitor sufficiently approaches the threshold voltage of the driving transistor.

As a different embodiment, in the compensation period, the first compensation operation may be performed over a temporal length (for example, the temporal length t1 shown in FIG. 17) that is set to be changed in accordance with the gray scale value). In such a case, both temporal lengths of the first compensation operation and the second compensation operation are set to be changed in accordance with the gray scale value. Accordingly, it is possible to suppress the error in the driving current for gray scale values extending over a broad range, compared to a case where only the temporal length of the first compensation operation is adjusted. In addition, a detailed example of the above-described aspect will be described as a fourth embodiment of the invention.

According to a second aspect of the invention, there is provided a method of driving a pixel circuit. The method includes: performing a second compensation operation of having the voltage between both ends of the storage capacitor gradually approach the threshold voltage of the driving transistor by supplying a gray scale electric potential according to the gray scale value designated to the pixel circuit from a signal line to the gate of the driving transistor of the pixel circuit over a temporal length that is set to be changed in accordance with the gray scale value in a second period of a unit period of a plurality of unit periods each including a first period (for example, the period h1 shown in FIG. 14) for each of a plurality of pixel circuits and a second period (for example, the period h2 shown in FIG. 14) corresponding to the pixel circuit for each of a plurality of the pixel circuits; performing a first compensation operation of having the voltage between both ends of the storage capacitor gradually approach the threshold voltage of the driving transistor by having the driving transistor to be in the conductive state and supplying the reference electric potential to the gate of the driving transistor from the signal line in two or more first period before start of the second period of the unit period corresponding to the pixel circuit intermittently; and supplying a driving current according to the voltage between both ends of the storage capacitor to the light emitting element by stopping the supply of the electric potential to the gate of the driving transistor of the pixel circuit after elapse of the second period of the unit period corresponding to the pixel circuit.

According to the second aspect, the temporal length of the second compensation operation is set to be changed in accordance with the gray scale value (or the gray scale electric potential). Accordingly, similarly to the driving method according to the first aspect, it is possible to effectively suppress the error in the driving current for a plurality of gray scales. In addition, since the first compensation operation is intermittently performed over the first period of a plurality of the unit periods, the voltage of both ends of the storage capacitor can sufficiently approach the threshold voltage of the driving transistor by performing the first compensation operation. In addition, a detailed example of the above-described driving method will be described later, for example, as a second embodiment of the invention. In addition, a common signal line is used for both supply of the reference electric potential and supply of the gray scale electric potential, and there is an advantage that the configuration of the pixel circuit is simplified, compared to a configuration in which the reference electric potential and the gray scale electric potential are supplied to each pixel circuit through separate wirings. In addition, the temporal relationship between the first period and the second period, the ratio of the first period to the second period, and the number of unit periods for which the first compensation operation is performed may be arbitrarily selected.

According to a third aspect of the invention, there is provided a method of driving a pixel circuit. The method includes: performing a second compensation operation of having the voltage between both ends of the storage capacitor gradually approach the threshold voltage of the driving transistor by supplying a gray scale electric potential according to the gray scale value designated to the pixel circuit from a signal line to the gate of the driving transistor of the pixel circuit for each of a plurality of pixel circuits over a temporal length that is set to be changed in accordance with the gray scale value in a unit period of a plurality of unit periods corresponding to the pixel circuit; and performing a first compensation operation of having the voltage between both ends of the storage capacitor gradually approach the threshold voltage of the driving transistor by having the driving transistor to be in the conductive state and supplying the reference electric potential to the gate of the driving transistor from a feed line (for example, a feed line 54 shown in FIG. 15) in two or more unit periods before start of the unit period corresponding to the pixel circuit; and supplying a driving current according to the voltage between both ends of the storage capacitor to the light emitting element by stopping the supply of the electric potential to the gate of the driving transistor of the pixel circuit after elapse of the unit period corresponding to the pixel circuit.

According to the third aspect, the temporal length of the second compensation operation is set to be changed in accordance with the gray scale value (or the gray scale electric potential). Accordingly, similarly to the driving method according to the first aspect, it is possible to effectively suppress the error in the driving current for a plurality of gray scales. In addition, since the first compensation operation is intermittently performed over the first period of a plurality of the unit periods, the voltage of both ends of the storage capacitor can sufficiently approach the threshold voltage of the driving transistor by performing the first compensation operation. In addition, there is also an advantage that the temporal length of the second compensation operation can be set to the entire temporal length at its maximum length (in other words, the width of change of the temporal length of the second compensation operation can be acquired). In addition, the number of the unit periods for which the first compensation operation is performed may be arbitrarily selected. A detailed example of the above-described driving method will be described later, for example, as a third embodiment of the invention.

According to a fourth aspect of the invention, there is provided a method of driving the pixel circuit that includes a light emitting element, a driving transistor that is connected to the light emitting element in series, a storage capacitor that is interposed between a path, which is formed between the light emitting element and the driving transistor, and a gate of the driving transistor, a selection switch that is interposed between the gate of the driving transistor and a signal line, and a first control switch (for example, a control switch TCR3) that is interposed between the gate of the driving transistor and the signal line and is connected to the selection switch in series. The method includes: having a voltage between both ends of the storage capacitor gradually approach a threshold voltage of the driving transistor for a compensation period; changing the electric potential of the gate of the driving transistor in accordance with a gray scale electric potential and having the voltage between both ends of the storage capacitor gradually approach the threshold voltage of the driving transistor for a write period after the elapse of the compensation period by supplying the gray scale electric potential according to a gray scale value that is designated to the pixel circuit to the signal line, controlling the selection switch to be in the ON state, and controlling the first control switch to be in the ON state in an operation period, which has a temporal length (for example, a temporal length T) set to be changed in accordance with the gray scale value, of the write period; and supplying a driving current according to the voltage between the both ends of the storage capacitor to the light emitting element by stopping supply of the electric potential to the gate of the driving transistor for a driving period after elapse of the write period. According to the above-described driving method, the temporal length of the operation period for having the voltage of both ends of the storage capacitor gradually approach the threshold voltage of the driving transistor within the write period is set to be changed in accordance with the gray scale value (or the gray scale electric potential). Accordingly, it is possible to effectively suppress the error in the driving current for a plurality of the gray scale values. A detailed example of the above-described aspect will be described later, for example, as a fifth embodiment of the invention.

In addition, under a premise that the temporal length of the operation, for which the error in the driving current can be suppressed, tends to be shortened as the amount of change in the voltage (for example, a voltage VIN) between both ends of the storage capacitor at the time of supply of the gray scale electric potential in the write period increases, the temporal length of the operation is set to be changed in accordance with the gray scale value that is designated to the pixel circuit, so that the temporal length of the operation is shortened as the amount of change in the voltage (for example, the voltage VIN) between both ends of the storage capacitor at the time of supply of the gray scale electric potential in the write period is increased. For example, the temporal length of the operation is set to be changed in accordance with the gray scale value that is designated to the pixel circuit, so that a value acquired by multiplying the amount of change in the voltage between both ends of the storage capacitor at the time of supply of the gray scale electric potential in the write period by the temporal length of the operation approaches a predetermined value.

However, under the tendency that the temporal length of the second compensation operation, for which the error in the driving current is suppressed, is lengthened as the gray scale value is smaller, in order to minimize the error in the driving current even for a case where the gray scale value is small, an excessively long temporal length needs to be acquired for the operation. Thus, according to an embodiment of the invention, when the gray scale value is smaller than a predetermined value, the temporal length of the operation is set to a predetermined value (for example, a temporal length Tmax shown in FIG. 10) that does not depend on the gray scale value (in other words, the upper limit of the temporal length of the operation is set). In such a case, there is an advantage that the temporal length of the operation is suppressed to an appropriate length even when the gray scale value is small.

In addition, it is preferable that a reference electric potential is supplied to the gate of the driving transistor from a feed line other than the signal line for the compensation period. In such a case, since the reference electric potential is supplied to the gate of the driving transistor from the feed line other than the signal line for the compensation period, there is an advantage that the temporal length of the operation for having the voltage of both ends of the storage capacitor gradually approach the threshold voltage of the driving transistor can be sufficiently acquired in the compensation period, compared to a case where a common signal line is used for both the supply of the gray scale electric potential and the supply of the reference electric potential.

According to a fifth aspect of the invention, there is provided a method of driving a pixel circuit including: a capacitor element that has a first electrode and a second electrode; a P-channel driving transistor having a gate connected to the second electrode; and a light emitting element. The method includes: performing a first compensation operation of having the voltage between both ends of the storage capacitor gradually approach the threshold voltage of the driving transistor by supplying the reference electric potential to the first electrode and having the driving transistor to be in the conductive state for diode connection of the driving transistor for a compensation period; performing a second compensation operation of changing the voltage between the gate and the source of the driving transistor to the voltage according to the gray scale value and having the voltage between the gate and the source of the driving transistor gradually approach the threshold voltage of the driving transistor by supplying the gray scale electric potential according to the gray scale value designated to the pixel circuit to the first electrode from the signal line and implementing diode-connection of the driving transistor over a temporal length that is set to be changed in accordance with the gray scale value in the write period after the elapse of the compensation period; and releasing the diode connection of the driving transistor and supplying a driving current according to the voltage between both ends of the storage capacitor to the light emitting element at that moment in the driving period after elapse of the write period.

According to the above-described method, the temporal length of the compensation operation (the second compensation operation) in the write period is set to be changed in accordance with the gray scale value (or the gray scale electric potential). Accordingly, it is possible to effectively suppress the error in the driving current for a plurality of gray scales. A detailed example of the above-described aspect will be described later, for example, as a sixth embodiment of the invention.

In addition, it may be configured that one electrode of the light emitting element is connected to the drain of the driving transistor, the voltage of both ends of the light emitting element is set to be lower than the threshold voltage of the light emitting element by supplying a first electric potential to the other electrode of the light emitting element in the compensation period and the write period, and the voltage of both ends of the light emitting element is set to be higher than the threshold voltage of the light emitting element by supplying a second electric potential to the other electrode of the light emitting element in the driving period. In such a case, the light emitting element can be shifted between the ON state and the OFF state by changing the electric potential that is supplied to the other electrode of the light emitting element. Accordingly, a switching element that is used for determining whether to supply the driving current to the light emitting element may not be disposed on the path of the driving current. As a result, there is an advantage that the configuration of the pixel circuit can be simplified.

In addition, it may be configured that a switching element disposed on the path of the driving current is included, the switching element is in the OFF state in the compensation period and the write period, and the switching element is in the ON state in the driving period so as to supply the driving current to the light emitting element. In such a case, since the switching element is in the OFF state in the compensation period and the write period, the light emitting element is in the OFF state (non-emitting state) assuredly without changing the electric potential of the electrode of the light emitting element. A detailed example of the above-described aspect will be described later, for example, as an eighth embodiment of the invention.

In the above-described aspect, the temporal length of the second compensation operation is set to be changed in accordance with the gray scale value designated to the pixel circuit, so that the temporal length of the second compensation operation is shortened as the amount of change in the electric potential of the gate of the driving transistor at the time of supplying the gray scale electric potential in the write period is increased.

In addition, when the gray scale value is lower than a predetermined value, the temporal length of the compensation operation may be configured to be set to a predetermined value that does not depend on the gray scale value (in other words, an upper limit of the temporal length of the compensation operation is set). In such a case, there is an advantage that the temporal length of the compensation operation is suppressed to an appropriate length even when the gray scale value is small.

In addition, in the compensation period, the voltage between the gate and the source of the driving transistor may be set to the threshold voltage of the driving transistor by performing the first compensation operation. In such a case, there is an advantage that the error in the threshold voltage of the driving transistor is accurately compensated by performing the first compensation operation. In addition, in order for the voltage between the gate and the source of the driving transistor to exactly match the threshold voltage of the driving transistor, logically, an infinite temporal length is needed. Accordingly, "to set the voltage between the gate and the source of the driving to the threshold voltage of the driving transistor" according to an embodiment of the invention represents a state (a state in which the threshold voltage is substantially reached) in which the voltage between the gate and the source of the driving transistor sufficiently approaches the threshold voltage of the driving transistor.

In addition, in the compensation period, the first compensation operation may be performed over a temporal length that is set to be changed in accordance with the gray scale value. In such a case, both temporal lengths of the first compensation operation and the second compensation operation are set to be changed in accordance with the gray scale value. Accordingly, it is possible to suppress the error in the driving current for gray scale values extending over a broad range, compared to a case where only the temporal length of the first compensation operation is adjusted. In addition, a detailed example of the above-described aspect will be described as a tenth embodiment of the invention.

According to a sixth aspect of the invention, there is provided a method of driving a plurality of pixel circuits each including: a capacitor element that has a first electrode and a second electrode; a P-channel driving transistor having a gate connected to the second electrode; and a light emitting element. The method includes: performing a second compensation operation of having the voltage between the gate and the source of the driving transistor of the pixel circuit gradually approach the threshold voltage of the driving transistor for each of the plurality of pixel circuits by supplying the gray scale electric potential according to the gray scale value designated to the pixel circuit to the first electrode of the pixel circuit from the signal line and performing diode-connection of the driving transistor in the second period of the unit period corresponding to the pixel circuit among a plurality of unit periods each including the first period and the second period over the temporal length that is set to be changed in accordance with the gray scale value; performing a first compensation operation of having the voltage between the gate and the source of the driving transistor gradually approach the threshold voltage of the driving transistor by supplying the reference electric potential to the first electrode of the pixel circuit from the signal line and having the driving transistor to be in the conductive state for diode-connection of the driving transistor in the first period before the start of the second period of the unit period corresponding to the pixel circuit and two or more unit periods before the start of the unit period corresponding to the pixel circuit; and releasing the diode connection of the driving transistor after the elapse of the second period of the unit period corresponding to the pixel circuit and supplying a driving current according to the voltage between the gate and the source of the driving transistor to the light emitting element at that moment.

According to this aspect, the temporal length of the second compensation operation is set to be changed in accordance with the gray scale value (or the gray scale electric potential). Accordingly, it is possible to effectively suppress the error in the driving current for a plurality of gray scales. In addition, since the first compensation operation is performed over two or more unit periods, the voltage of the gate and the source of the driving transistor can sufficiently approach the threshold voltage of the driving transistor by performing the first compensation operation. In addition, a common signal line is used for both supply of the reference electric potential and supply of the gray scale electric potential, and there is an advantage that the configuration of the pixel circuit is simplified, compared to a configuration in which the reference electric potential and the gray scale electric potential are supplied to each pixel circuit through separate wirings. In addition, the temporal relationship between the first period and the second period, the ratio of the first period to the second period, and the number of unit periods for which the first compensation operation is performed may be arbitrarily selected. In addition, a detailed example of the above-described aspect will be described later, for example, as a seventh embodiment of the invention.

According to a seventh aspect of the invention, there is provided a method of driving a plurality of pixel circuits each including: a capacitor element that has a first electrode and a second electrode; a P-channel driving transistor having a gate connected to the second electrode; and a light emitting element. The method includes: performing a second compensation operation of having the voltage between the gate and the source of the driving transistor of the pixel circuit gradually approach the threshold voltage of the driving transistor for each of the plurality of pixel circuits by supplying the gray scale electric potential according to the gray scale value designated to the pixel circuit to the first electrode of the pixel circuit from the signal line and performing diode-connection of the driving transistor in the unit period corresponding to the pixel circuit over the temporal length that is set to be changed in accordance with the gray scale value; performing a first compensation operation of having the voltage between the gate and the source of the driving transistor gradually approach the threshold voltage of the driving transistor by supplying the reference electric potential to the first electrode of the pixel circuit from a feed line and having the driving transistor to be in the conductive state for diode-connection of the driving transistor in two or more unit periods before the start of the unit period corresponding to the pixel circuit; and releasing the diode connection of the driving transistor after the elapse of the unit period corresponding to the pixel circuit and supplying a driving current according to the voltage between the gate and the source of the driving transistor to the light emitting element at that moment.

According to this aspect, the temporal length of the second compensation operation is set to be changed in accordance with the gray scale value (or the gray scale electric potential). Accordingly, it is possible to effectively suppress the error in the driving current for a plurality of gray scales. In addition, since the first compensation operation is continuously performed over two or more unit periods, the voltage of the gate and the source of the driving transistor can sufficiently approach the threshold voltage of the driving transistor by performing the first compensation operation. In addition, there is an advantage that the temporal length of the second compensation operation can be set up to a temporal length of the entire unit period to its maximum (the width of change of the temporal length of the second compensation operation can be sufficiently acquired). In addition, the number of the unit periods for which the first compensation operation is performed can be arbitrarily selected. A detailed example of the above-described aspect will be described later, for example, as a ninth embodiment of the invention.

In addition, in the method of driving a pixel circuit according to an embodiment of the invention, the first compensation operation may be performed in a plurality of unit periods or in one unit period (the period in which the first compensation operation is performed may be over a plurality of the unit periods or may be included in one unit period), and accordingly, the driving method according to the sixth aspect or the seventh aspect is included in the driving method according to the fifth aspect.

According to the first aspect of the invention, there is provided a light emitting device including: a pixel circuit that includes a light emitting element, a driving transistor that is connected to the light emitting element in series, and a storage capacitor that is interposed between a path, which is formed between the light emitting element and the driving transistor, and a gate of the driving transistor; and a driving circuit that performs the driving method according to the first aspect of the invention. According to the light emitting device of the first aspect, the same advantages as those of the driving method according to the first aspect are acquired.

According to the second aspect of the invention, there is provided a light emitting device including: a plurality of pixel circuits each including a light emitting element, a driving transistor that is connected to the light emitting element in series, and a storage capacitor that is interposed between a path, which is formed between the light emitting element and the driving transistor, and a gate of the driving transistor; and a driving circuit that performs the driving method according to the second aspect of the invention. According to the light emitting device of the second aspect, the same advantages as those of the driving method according to the second aspect are acquired.

In a detailed example of the light emitting device according to the second aspect, each of the plurality of pixel circuits includes a selection switch (for example, a selection switch TSL shown in FIG. 13) and a control switch (for example, a control switch TCR1 shown in FIG. 13) that is disposed on the path of a current flowing through the driving transistor. In addition, for each of the plurality of pixel circuits, the driving circuit performs the first compensation operation by controlling the selection switch and the control switch to be in the ON state and supplying the reference electric potential to the signal line in two or more first periods before the start of the second period of the unit period corresponding to the pixel circuit, performs a second compensation operation by controlling the selection switch and the control switch to be in the ON state and supplying the gray scale electric potential to the signal line in the second period of the unit period corresponding to the pixel circuit, and controls the selection switch to be in the OFF state in each second period other than the second period of the unit period corresponding to the pixel circuit.

According to the third aspect of the invention, there is provided a light emitting device including: a plurality of pixel circuits each including a light emitting element, a driving transistor that is connected to the light emitting element in series, and a storage capacitor that is interposed between a path, which is formed between the light emitting element and the driving transistor, and a gate of the driving transistor; and a driving circuit that performs the driving method according to the third aspect of the invention. According to the light emitting device of the third aspect, the same advantages as those of the driving method according to the third aspect are acquired.

In a detailed example of the light emitting device according to the third aspect, each of the plurality of pixel circuits includes a selection switch (for example, a selection switch TSL shown in FIG. 15) and a control switch (for example, a control switch TCR2 shown in FIG. 15) that is interposed between the gate of the driving transistor and a feed line. In addition, for each of the plurality of pixel circuits, the driving circuit performs a first compensation operation by controlling the control switch to be in the ON state in two or more unit periods before the start of the unit period corresponding to the pixel circuit, performs a second compensation operation by controlling the selection switch to be the ON state and the control switch to be in the OFF state and supplying the gray scale electric potential to the signal line in the unit period corresponding to the pixel circuit, and controls the selection switch to be in the OFF state in each unit period other than the unit period corresponding to the pixel circuit, According to the fourth aspect of the invention, there is provided a light emitting device including: a pixel circuit that includes a light emitting element, a driving transistor that is connected to the light emitting element in series, a storage capacitor that is interposed between a path, which is formed between the light emitting element and the driving transistor, and a gate of the driving transistor, a selection switch that is interposed between the gate of the driving transistor and the signal line, and a first control switch that is interposed between the gate of the driving transistor and the signal line and is connected to the selection switch in series; and a driving circuit that drives the pixel circuit. The driving circuit changes the electric potential of the gate of the driving transistor in accordance with the gray scale electric potential and has the voltage of both ends of the storage capacitor gradually approach the threshold voltage of the driving transistor by having the voltage of both ends of the storage capacitor gradually approach the threshold voltage of the driving transistor in the compensation period, supplying the gray scale electric potential according to the gray scale value designated to the pixel circuit to the signal line and controlling the selection switch to be in the ON state in a write period after the elapse of the compensation period, and controlling the first control switch to be in the ON state in the operation period having a temporal length set to be changed in accordance with the gray scale value in the write period and supplies a driving current according to the voltage between both ends of the storage capacitor to the light emitting element by stopping the supply of the electric potential to the gate of the driving transistor in a driving period after the elapse of the write period.

It may be configured that the pixel circuit includes a second control switch (for example, a control switch TCR2) that is interposed between the gate of the driving transistor and the feed line to which the reference electric potential is supplied, and the driving circuit controls the second control switch to be in the ON state in the compensation period and controls the second control switch to be in the OFF state in the write period. In such a case, since the reference electric potential is supplied to the gate of the driving transistor from the feed line other than the signal line in the compensation period, there is an advantage that the temporal length of the operation for having the voltage of both ends of the storage capacitor gradually approach the threshold voltage of the driving transistor can be sufficiently acquired in the compensation period, compared to a case where a common signal line is used for both the supply of the gray scale electric potential and the supply of the reference electric potential.

In a detailed example of the light emitting device according to the fourth aspect of the invention, a light emitting element; a driving transistor that is connected to the light emitting element in series; a storage capacitor that is interposed between a path, which is formed between the light emitting element and the driving transistor, and a gate of the driving transistor; a signal line to which the gray scale electric potential according to the gray scale value is supplied; a selection switch that is interposed between the gate of the driving transistor and the signal line; a first control switch that is interposed between the gate of the driving transistor and the signal line and is connected to the selection switch in series; a scanning line to which a scanning signal used for controlling the selection switch is supplied; a control line to which a control signal for controlling the first control switch is supplied; and a driving circuit that supplies the scanning signal to the scanning line for allowing the selection switch to be in the ON state at least in the write period of a period in which the gray scale electric potential is supplied to the signal line and supplies the control signal to the control line, so that the operation period of the write period in which the first control switch is in the ON state becomes a temporal length set to be changed in accordance with the gray scale value are included. Under the above-described configuration, the temporal length of the operation period (that is, the operation period in which the voltage between both ends of the storage capacitor gradually approaches the threshold voltage of the driving transistor) in which both the selection switch and the first control switch are in the ON state is set to be changed in accordance with the gray scale value. Accordingly, it is possible to effectively suppress the error in the driving current for a plurality of gray scale values.

In addition, when the signal line and the control line extend in a direction intersecting the extending direction of the scanning line, the load of the control line is decreased, for example, in a light emitting device in which the number of pixel circuits arranged in the extending direction of the scanning line is larger than that arranged in the extending direction of the signal line. Accordingly, compared to a configuration in which the control line and the scanning line extend in the same direction, the temporal length of the operation period can be controlled with high accuracy.

According to the fifth aspect of the invention, there is provided a light emitting device including: a pixel circuit that includes a capacitor element that has a first electrode and a second electrode, a P-channel driving transistor having a gate connected to the second electrode, a light emitting element, a first switching element that is interposed between the signal line and the first electrode, and a second switching element that is interposed between the gate and the drain of the driving transistor; and a driving circuit that performs the driving method according to the fifth aspect of the invention. According to the light emitting device of the fifth aspect, the same advantages as those of the driving method according to the fifth aspect are acquired.

The pixel circuit further includes a third switching element that is disposed on the path of the driving current, and the driving circuit controls the third switching element to be in the OFF state in the compensation period and the write period and controls the third switching element to be in the ON state after the elapse of the write period, whereby the driving current can be supplied to the light emitting element appropriately.

According to the sixth aspect of the invention, there is provided a light emitting device including: a plurality of pixel circuits each including a capacitor element that has a first electrode and a second electrode, a P-channel driving transistor having a gate connected to the second electrode, a light emitting element, a first switching element that is interposed between the signal line and the first electrode, and a second switching element that is interposed between the gate and the drain of the driving transistor; and a driving circuit that performs the driving method according to the sixth aspect of the invention.

According to the light emitting device of the sixth aspect, the same advantages as those of the driving method according to the sixth aspect are acquired.

According to the seventh aspect of the invention, there is provided a light emitting device including: a plurality of pixel circuits each including a capacitor element that has a first electrode and a second electrode, a P-channel driving transistor having a gate connected to the second electrode, a light emitting element, a first switching element that is interposed between the signal line and the first electrode, a second switching element that is interposed between the gate and the drain of the driving transistor, and a fourth switching element that is interposed between the feed line and the first electrode; and a driving circuit that performs the driving method according to the seventh aspect of the invention. According to the light emitting device of the seventh aspect, the same advantages as those of the driving method according to the seventh aspect are acquired.

The light emitting devices according to the above-described aspects are used in various electronic apparatuses. A typical example of the electronic apparatus is an electronic apparatus that uses the light emitting device as a display device. As the electronic apparatuses according to embodiments of the invention, a personal computer and a cellular phone are exemplified. First of all, the use of the light emitting device according to an embodiment of the invention is not limited to display of an image. For examples the light emitting device according to an embodiment of the invention can be used as an exposure device (optical head) that is used for forming a latent image by irradiating rays on an image carrier such as a photosensitive drum.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
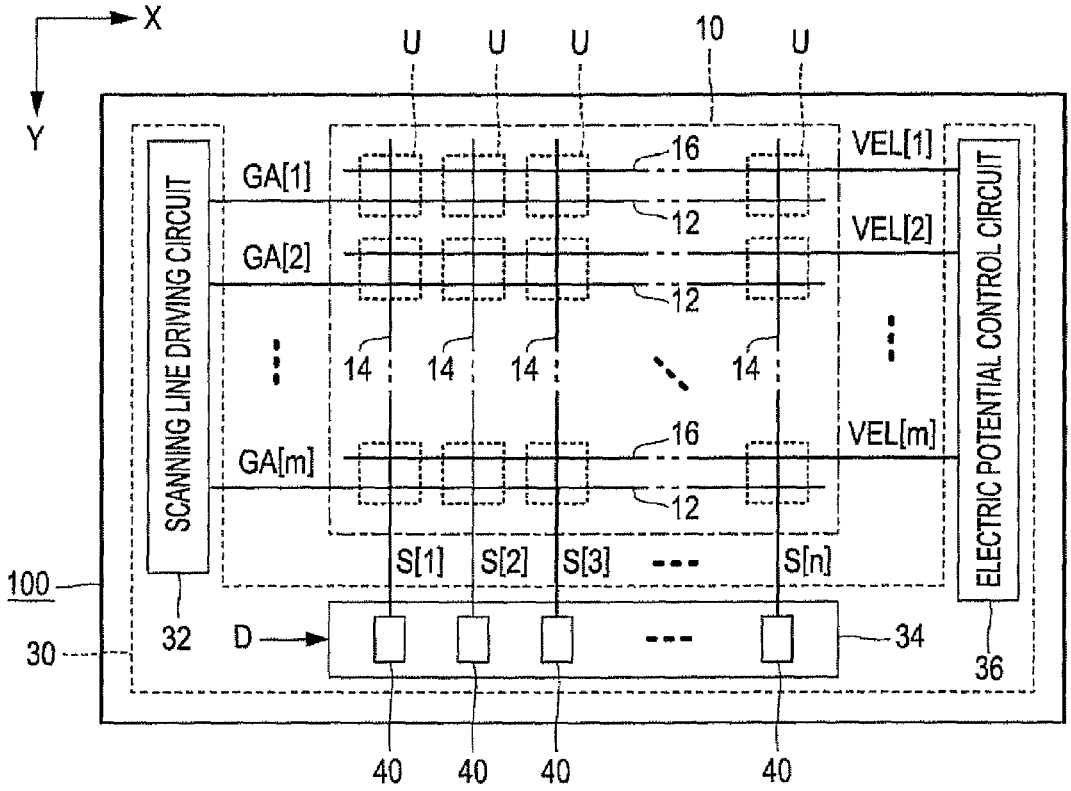
FIG. 1 is a block diagram showing a light emitting device according to a first embodiment of the invention.

Hereinafter, embodiments of the invention will be described with reference to the accompanying drawings. In the following description, elements denoted by the same reference numerals have the same function and operations if not stated otherwise.

A: First Embodiment

FIG. 1 is a block diagram showing a light emitting device according to a first embodiment of the invention. The light emitting device 100 is mounted on an electronic apparatus as a display body for displaying an image. As shown in FIG. 1, the light emitting device 100 includes a component unit 10 in which a plurality of pixel circuits U are arranged and a driving circuit 30 that drives the pixel circuits U. The driving circuit 30 includes a scanning line driving circuit 32, a signal line driving circuit 34, and an electric potential control circuit 36. The driving circuit 30 is mounted to be divided into, for example, a plurality of integrated circuits. However, at least one portion of the driving circuit 30 can be configured by thin film transistors formed on a substrate.

In the component unit 10, m scanning lines 12 extending in a X direction and n signal lines 14 extending in a Y direction perpendicular to the X direction are disposed (here, m and n are natural numbers). The plurality of pixel circuits U are disposed in correspondence with intersections of the scanning lines 12 and the signal lines 14, and are arranged in an array of m columns×n rows. In the component unit 10, m feed lines 16 extending in the X direction are disposed together with the scanning line 12.

The scanning line driving circuit 32 sequentially selects the pixel circuits U in units of rows by outputting to the scanning lines 12 the scan signals GA (GA[1] to GA[m]) that are sequentially generated to be in an active level (high level) in a predetermined sequence. The electric potential control circuit 36 generates electric potentials VEL (VEL[1] to VEL [m]) and outputs the electric potentials to the feed lines 16.

The signal line driving circuit 34 generates signals S (S[1] to S[n]) that define the operations of the pixel circuits U for outputting the signals to the signal lines 14. As shown in FIG. 1, the signal line driving circuit 34 includes n unit circuits 40 corresponding to the signal lines 14. The j-th (here, j=1 to n) unit circuit 40 outputs the signal S[j] to the j-th signal line 14. For example, the unit circuit 40 sets the signal S[j] to an electric potential (hereinafter, referred to as a "gray scale electric potential") VDATA corresponding to a gray scale value D that is designated to the pixel circuit U of the j-th column selected by the scanning line driving circuit 32.

Figure 2:
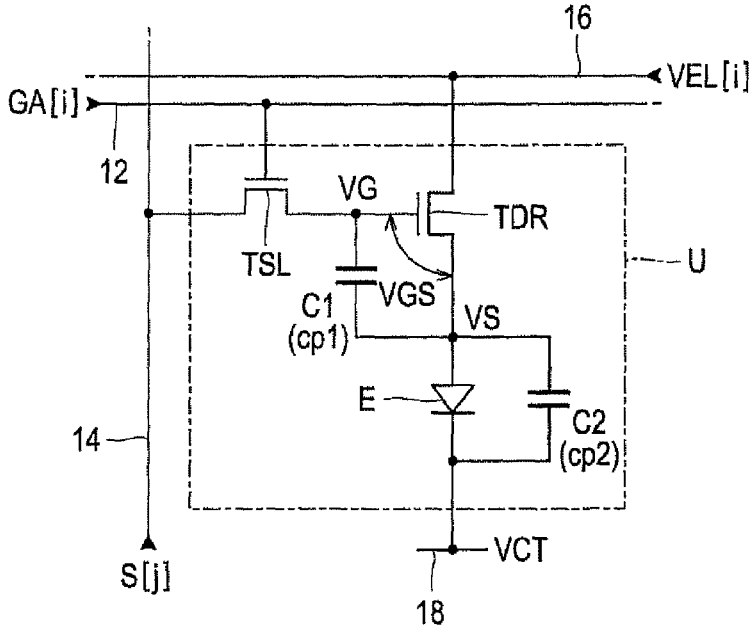
FIG. 2 is a circuit diagram of a pixel circuit according to the first embodiment.

FIG. 2 is a circuit diagram of the pixel circuit U. In FIG. 2, only one pixel circuit U of the j-th column belonging to the i-th row (i=1 to m) is representatively shown. As shown in FIG. 2, the pixel circuit U includes a light emitting element E, a driving transistor TDR, a selection switch TSL, and a storage capacitor C1. The light emitting element E and the driving transistor TDR are serially connected in a path that connects the feed line 16 and the feed line 18. The feed line 18 (a ground line) is applied with a predetermined electric potential VCT from a power supply circuit (not shown). The light emitting element E is an organic EL device where a light-emitting layer made of an organic EL (electroluminescence) material is interposed between an anode and a cathode that face each other. As shown in FIG. 2, the light emitting element E is accompanied with a capacitor C2 (capacitance value cp2).

The driving transistor TDR is an N-channel transistor (for example, a thin film transistor) of which the drain is connected to the feed line 16 and of which the source is connected to the anode of the light emitting element E. The storage capacitor C1 (capacitance value cp1) is interposed between the gate and source of the driving transistor TDR. The selection switch TSL is interposed between the signal line 14 and the gate of the driving transistor TDR so as to control the electrical connection (electrical conduction or non-conduction) between the signal line and the gate of the driving transistor. The gate of the selection switch TSL is connected to the scanning line 12.

Figure 3:
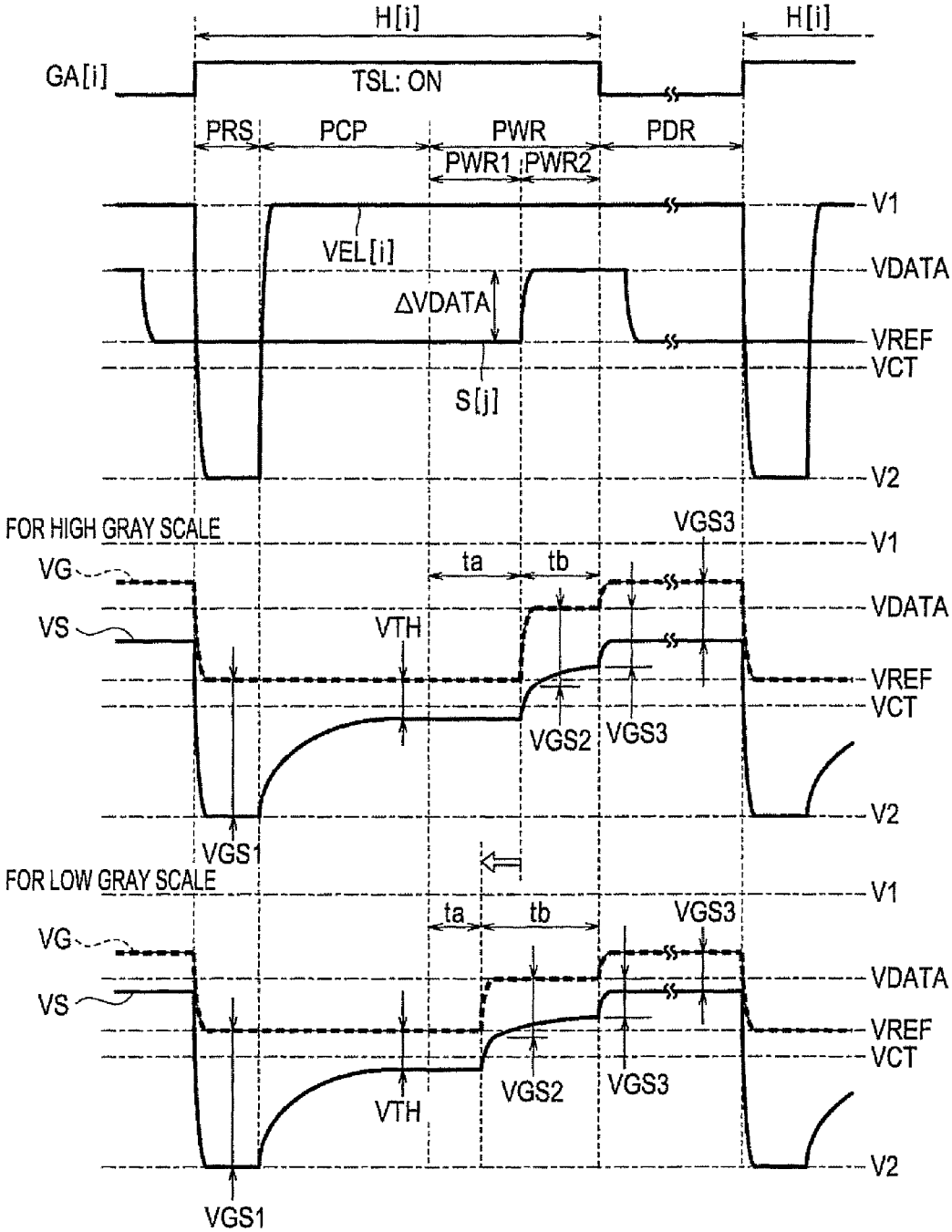
FIG. 3 is a timing chart showing the operation of a light emitting device according to the first embodiment.

Next, the operation (a method of driving the pixel circuit U) of the driving circuit 30 will be described with reference to FIG. 3 with focusing on the pixel circuit U positioned in the i-th row and the j-th column. As shown in FIG. 3, the scanning line driving circuit 32 sets the scanning signal GA[i] to an active level (high level) in the i-th unit period H[i] within the vertical scanning period. When the scanning signal GA[i] is set to the active level, the selection switches TSL of n pixel circuits U that are positioned in the i-th row change to be in the ON state simultaneously.

As shown in FIG. 3, the unit period H[i] includes a reset period PRS, a compensation period PCP, and a write period PWR. A voltage (that is, a voltage between both ends of the storage capacitor C1) VGS between the gate and the source of the driving transistor TDR is reset to a predetermined voltage in the reset period PRS and gradually approaches the threshold voltage VTH of the driving transistor TDR in the compensation period PCP after elapse of the reset period PRS. In the write period PWR after elapse of the compensation period PCP, the voltage VGS of the driving transistor TDR is set to a voltage corresponding to the gray scale value D that is designated to the pixel circuit U. In the driving period PDR after elapse of the unit period H[i], a driving current IDR according to the voltage VGS of the driving transistor TDR is supplied to the light emitting element E from the feed line 16 through the driving transistor TDR. The light emitting element E emits light with luminance according to the driving current IDR. Hereinafter, a detailed operation of the pixel circuit U will be described separately for the reset period PRS, the compensation period PCP, the write period PWR, and the driving period PDR.

Figure 4:
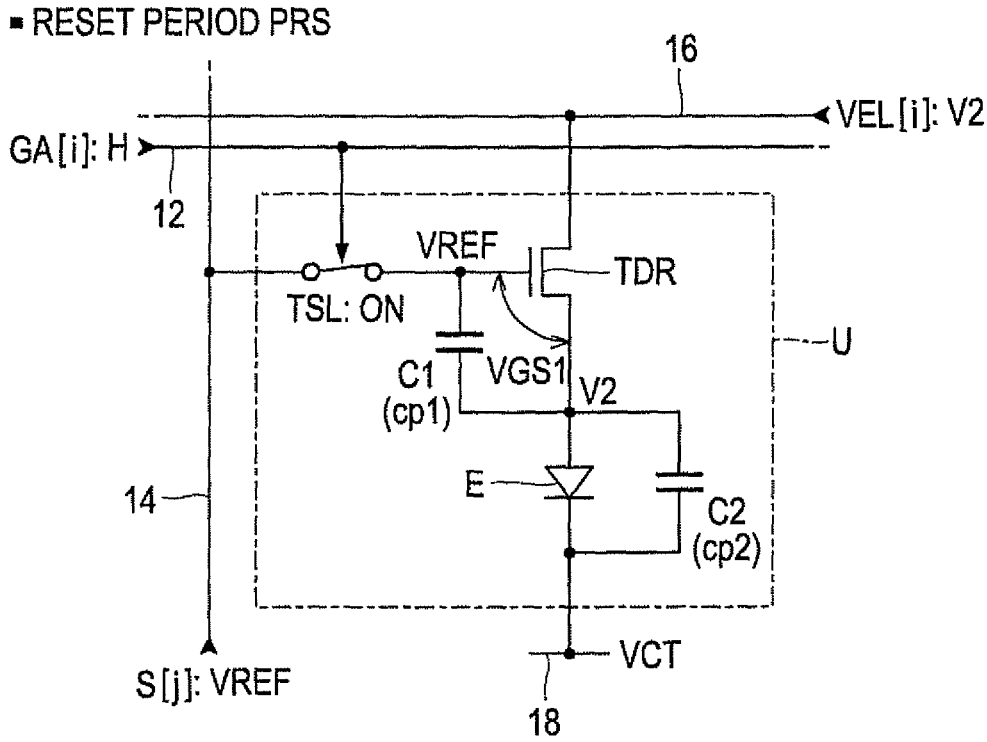
FIG. 4 is a circuit diagram showing the state of the pixel circuit for a reset period.

[1] Reset Period PRS (FIG. 4)

As shown in FIGS. 3 and 4, in the reset period PRS, the signal line driving circuit 34 sets the signal S[j] to a reference electric potential VREF, and the electric potential control circuit 36 sets the electric potential VEL[i] to an electric potential V2. Since the selection switch TSL is in the ON state, the gate electric potential VS of the driving transistor TDR is set to the reference electric potential VREF of the signal S[i] through the signal line 14 and the selection switch TSL. In addition, the source electric potential VS of the driving transistor TDR is set to the electric potential V2. Therefore, the voltage VGS of the driving transistor TDR (that is, the voltage across the storage capacitor C1) is reset to a voltage difference VGS1 (VGS1=VREF−V2) between the reference electric potential VREF and the electric potential V2.

The reference electric potential VREF and the electric potential V2 are set so that the voltage difference VGS1 is sufficiently higher than the threshold voltage VTH of the driving transistor TDR, as expressed in the following Equation (1), and the voltage (V2−VCT) across the light emitting element E is sufficiently lower than the threshold voltage VTH_OLED of the light emitting element E, as expressed in the following Equation (2). Therefore, in the reset period PRS, the driving transistor TDR is in the ON state, and the light emitting element E is in the OFF state (non-emitting state).

$$VGS1 = VREF - V2 >> VTH \quad \text{Equation (1)}$$

$$V2 - VCT << VTH_OLED \quad \text{Equation (2)}$$

Figure 5:
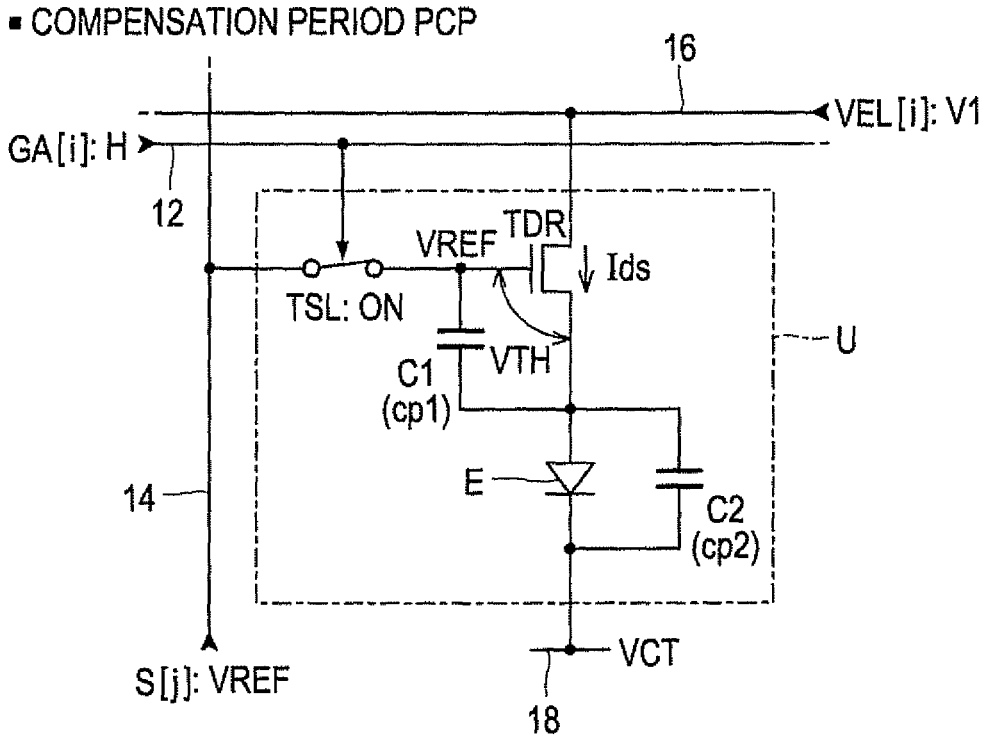
FIG. 5 is a circuit diagram showing the appearance of a pixel circuit for a compensation period.

[2] Compensation Period PCP (FIG. 5)

As shown in FIGS. 3 and 5, if the compensation period PCP starts, the electric potential control circuit 36 changes the electric potential VEL[i] of the feed line 16 (that is, the drain voltage of the driving transistor TDR) to the electric potential V1. As shown in FIG. 3, the electric potential V1 is sufficiently higher than the electric potential V2 or the reference electric potential VREF. Similarly to the reset period PRS, the signal line driving circuit 34 maintains the signal S[j] to the reference electric potential VREF. Since the selection switch TSL is maintained in the ON state even in the compensation period PCP, the gate electric potential VG of the driving transistor TDR is maintained at the reference electric potential VREF. Since the driving transistor TDR is transitioned into the ON state in the reset period PRS, the current Ids expressed by the following Equation (3) flows between the drain and source of the driving transistor TDR under the above state, as shown in FIG. 5. In Equation (3), μ is the mobility of the driving transistor TDR. In addition, W/L is the relative ratio of the channel width W to the channel length L of the driving transistor TDR, and Cox is the capacitance per unit area of a gate insulating layer of the driving transistor TDR.

$$Ids = 1/2 \cdot \mu \cdot W/L \cdot Cox \cdot (VGS - VTH)^2 \quad \text{Equation (3)}$$

As the current Ids flows from the feed line 16 through the driving transistor TDR, electric charges are charged in the storage capacitor C1 and the capacitor C2. Accordingly, as shown in FIG. 3, the electric potential VS of the source of the driving transistor TDR rises slowly. Since the electric potential VG of the gate of the driving transistor TDR is fixed to the reference electric potential VREF, the voltage VGS between the gate and the source of the driving transistor TDR decreases with the rise of the electric potential VS of the source. As can be known from Equation (3), as the voltage VGS decreases so as to approach the threshold voltage VTH, the current Ids decreases. Thus, an operation (hereinafter, referred to as a "first compensation operation") for having the voltage VGS of the driving transistor TDR gradually approach the threshold voltage VTH from the voltage VGS1 (VGS1=VREF−V2) that is set in the reset period PRS is performed for the compensation period PCP. The temporal length of the compensation period PCP is set such that the voltage VGS of the driving transistor TDR sufficiently approaches (ideally, coincides with) the threshold voltage VTH at the end point of the compensation period PCP. Accordingly, the driving transistor TDR is mostly in the OFF state at the end point of the compensation period PCP.

Figure 6:
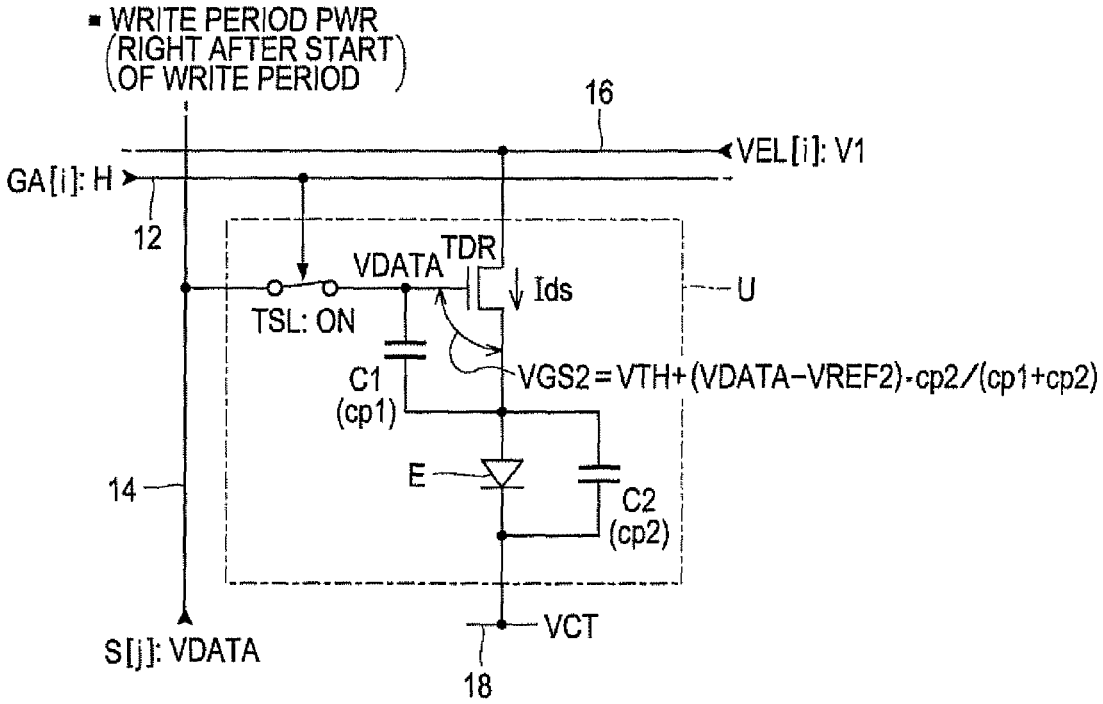
FIG. 6 is a circuit diagram showing the appearance of a pixel circuit right after the start of a write period PWR.

[3] Write Period PWB (FIG. 6)

As shown in FIG. 3, the write period PWR is divided into a standby period PWR1 and an operation period PWR2. The standby period PWR1 is a period from the start point of the write period PWR to the elapse of a temporal length ta. In addition, the operation period PWR2 is the remaining period PWR (a temporal length tb from the end point of the standby period PWR1 to the end point of the write period PWR). The temporal length tb of the operation period PWR2 is set to be changed in accordance with the gray scale value D that is designated to the pixel circuit U. In other words, as shown in FIG. 3, the temporal length tb of a case where the gray scale value D designates a high gray scale (high luminance) is shorter than the temporal length tb of a case where the gray scale value D designates a low gray scale (low luminance). Since the temporal length of the write period PWR is a fixed value, the temporal length ta of the standby period PWR1 is changed in accordance with the temporal length tb (gray scale value D). In addition, setting of the temporal length tb of the operation period PWR2 will be described later.

As shown in FIG. 3, the state of the compensation period PCP is maintained in the standby period PWR1. In other words, the driving transistor TDR maintains to be in the OFF state as the result of setting the voltage VGS to the threshold voltage VTH in the first compensation operation, with the supply of the reference electric potential VREF to the gate of the driving transistor TDR continued.

As shown in FIG. 3 and FIG. 6, when the start point of the operation period PWR2 is reached as the temporal length ta elapses, the signal line driving circuit 34 changes the signal S[j] to have a gray scale electric potential VDATA. The gray scale electric potential VDATA is set to be changed in accordance with the gray scale value D that is designated to the pixel circuit U (light emitting element E). Since the selection switch TSL maintains to be in the ON state also in the operation period PWR2, the electric potential VG of the gate of the driving transistor TDR changes from the reference electric potential VREF in the standby period PWR1 to the gray scale electric potential VDATA. The storage capacitor C1 is interposed between the gate and the source of the driving transistor TDR, and accordingly, as shown in FIG. 3, the electric potential VS of the source of the driving transistor TDR changes (rises) in association with the electric potential VG of the gate.

The amount of change of the electric potential VS right after the start of the operation period PWR2 corresponds to a voltage (ΔVDATA·cp1/(cp1+cp2)) that is acquired by dividing the amount of change ΔVDATA (ΔVDATA=VDATA−VREF) of the electric potential VG in accordance with the ratio of capacitance values of the storage capacitor C1 and the capacitor C2. Accordingly, the voltage VGS2 between the gate and the source of the driving transistor TDR (both ends of the storage capacitor C1) right after the start of the operation period PWR2, as shown in FIG. 6, can be represented in the following Equation (4). A voltage VIN in Equation (4) corresponding to the amount of change (ΔVDATA−cp2/(cp1+cp2)) of the voltage VGS between the gate and the source when the gray scale electric potential VDATA is supplied to the gate of the driving transistor TDR.

$$VGS2 = VTH + \Delta VDATA \cdot cp2/(cp1 + cp2) \quad \text{Equation (4)}$$
$$= VIN + VTH$$

As described above, as the voltage VGS2 is set to a voltage value above the threshold voltage VTH in accordance with the gray scale electric potential VDATA (described in more details, a difference between the gray scale electric potential VDATA and the reference electric potential VREF), the driving transistor TDR is changed to be in the ON state. Accordingly, the current Ids shown in Equation (3) flows between the drain and the source of the driving transistor TDR.

The electric potential VS of the source of the driving transistor TDR (the voltage between both ends of the capacitor C2) slowly rises in accordance with charging the storage capacitor C1 and the capacitor C2 by the current Ids. On the other hand, the electric potential VG of the gate of the driving transistor TDR is maintained at the gray scale electric potential VDATA in the operation period PWR2. Accordingly, the voltage VGS between the gate and the source of the driving transistor TDR decreases from the voltage VGS2 right after the start of the operation period PWR2 in accordance with the rise of the electric potential VS. As the voltage VGS approaches the threshold voltage VTH, the current Ids decreases. Accordingly, an operation (hereinafter, referred to as a "second compensation operation") for having the voltage VGS of the driving transistor TDR gradually approach the threshold voltage VTH from the voltage VGS2, which is set by supply of the gray scale electric potential VDATA, is performed in the operation period PWR2 of the write period PWR, similarly to the compensation period PCP. Accordingly, in the end point of the operation period PWR2 (the end point of the write period PWR), as shown in FIG. 3, the voltage VG5 between the gate and the source of the driving transistor TDR is set to a voltage VGS3, shown in Equation (5), that is lower than the voltage VGS2 shown in Equation (4) by a voltage ΔV. The voltage ΔV corresponds to the amount of change of the electric potential VS of the source of the driving transistor TDR that is made by the second compensation operation.

$$VGS3 = VGS2 - \Delta V \quad \text{Equation (5)}$$
$$= VIN + VTH - \Delta V$$

The voltage VGS3 changes in accordance with the gray scale electric potential VDATA and the temporal length tb. Thus, the operation for controlling the temporal length tb of the operation period PWR2 in accordance with the gray scale value D may be also perceived as an operation for controlling the voltage VGS3 at the end point of the operation period PWR2 to be changed in accordance with the gray scale value D.

The temporal length from the start point of the operation period PWR2 to a time when the driving transistor TDR is changed to be in the ON state is sufficiently short, and thus, the temporal length tb of the operation period PWR2 corresponds to a temporal length in which the second compensation operation is performed. The temporal length tb is set within the range in which the voltage VGS3 between the gate and the source of the driving transistor TDR at the end point of the operation period PWR2 is a voltage that is equivalent to the threshold voltage VTH (for a case where the gray scale value D designates a minimum gray scale) or a voltage that is higher than the threshold voltage VTH. In other words, in a case where the gray scale value D designates a gray scale other than the minimum gray scale, the driving transistor TDR is maintained to be in the ON state at the end point of the operation period PWR2.

Figure 7:
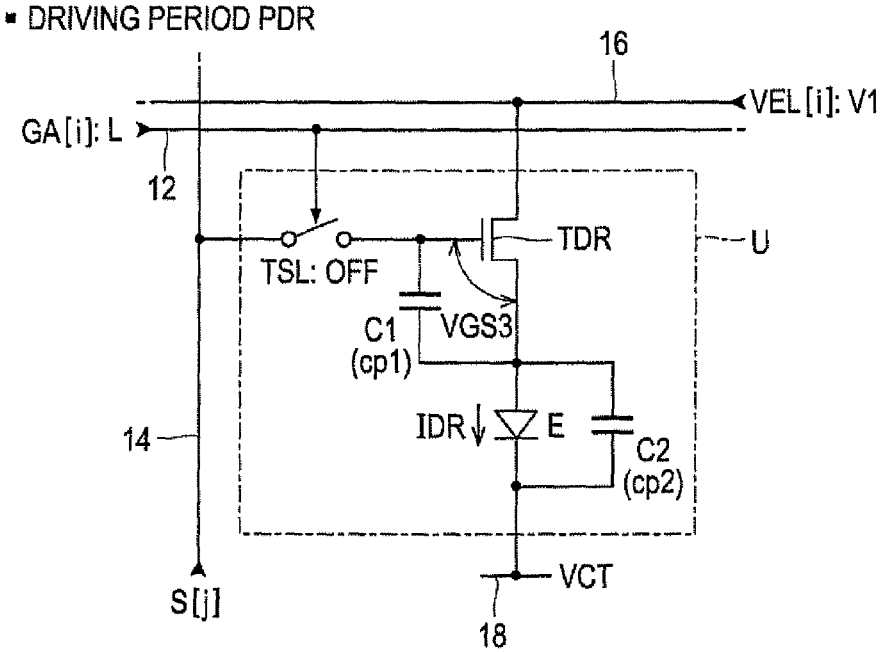
FIG. 7 is a circuit diagram showing the state of the pixel circuit for a driving period.

[4] Driving Period PDR (FIG. 7)

As shown in FIG. 3 and FIG. 7, when the driving period PDR is started, the scanning line driving circuit 32 changes the scanning signal GA[i] to have an inactive level (low level). Accordingly, the selection switch TSL of each pixel circuit U positioned in the i-th row is changed to be in the OFF state, and the gate of the driving transistor TDR is in an electrically-floating state (that is, supply of the electric potential to the gate of the driving transistor TDR is stopped). On the other hand, the current Ids shown in Equation (3) flows between the drain and the source of the driving transistor TDR that is set to be in the ON state in the write period PWR, and whereby the capacitor C2 is charged. Accordingly, as shown in FIG. 3, the voltage between both ends of the capacitor C2 (the electric potential VS of the source of the driving transistor TDR) slowly increases with the voltage VGS of the driving transistor TDR maintained to be the voltage VGS3 at the end point of the write period PWR. Then, the current Ids flows through the light emitting element E as a driving current IDR at a time point when the voltage of both ends of the capacitor C2 reaches a threshold voltage VTH_OLED of the light emitting element E. Accordingly, the driving current IDR can be represented in the following Equation (6).

$$\begin{aligned} IDR &= 1/2\cdot\mu\cdot W/L\cdot Cox\cdot(VGS3-VTH)^2 \\ &= 1/2\cdot\mu\cdot W/L\cdot Cox\cdot \\ &\quad \{(VIN+VTH-\Delta V)-VTH\}^2 \\ &= K\cdot(VIN-\Delta V)^2 \end{aligned} \qquad \text{Equation (6)}$$

$$(\text{here, } K = 1/2\cdot\mu\cdot W/L\cdot Cox)$$

As described above, the driving current IDR is controlled at the current amount corresponding to the voltage VGS3 on which the gray scale electric potential VDATA is reflected. Accordingly, the light emitting element E emits lights having the luminance level corresponding to the gray scale electric potential VDATA (that is, the gray scale value D). Then, the light emission of the light emitting element E is continued until start of the unit period H[i] in which the scanning signal GA[i] becomes the active level next time.

The voltage VGS3 shown in Equation (5) is a voltage that is acquired by changing the threshold voltage VTH, which is set in the compensation period PCP, in accordance with the gray scale electric potential VDATA. Thus, as shown in Equation (6), the driving current IDR does not depend on the threshold voltage VTH. Accordingly, even when there is an error in the threshold voltage VTH of the driving transistor TDR of each pixel circuit U, the driving current IDR is set as a target value corresponding to the gray scale electric potential VDATA. In other words, the error in the driving current IDR due to the threshold voltage VTH of the driving transistor TDR of each pixel circuit U is compensated by the first compensation operation that is performed in the compensation period PCP.

In addition, the voltage ΔV (the amount of change in the voltage VGS between the gate and the source of the driving transistor TDR that is made by the second compensation operation) shown in Equation (6) depends on the mobility μ of the driving transistor TDR. Additionally described in detail, as the mobility μ of the driving transistor TDR increases, the voltage ΔV is increased. As described above, since the mobility μ of the driving transistor TDR is reflected on the driving current IDR by performing the second compensation operation, the error in the driving current IDR due to the mobility μ of the driving transistor TDR can be compensated by performing the second compensation operation in the write period PWR (the operation period PWR2).

However, under the configuration (hereinafter, referred to as a "comparative example") in which the temporal length tb of the second compensation operation is fixed to a predetermined value that does not depend on the gray scale value D, as described below, there is a problem that the error in the mobility μ of the driving transistor TDR can be effectively compensated only in a case where a specific gray scale value D (the gray scale electric potential VDATA) is designated.

Figure 8:
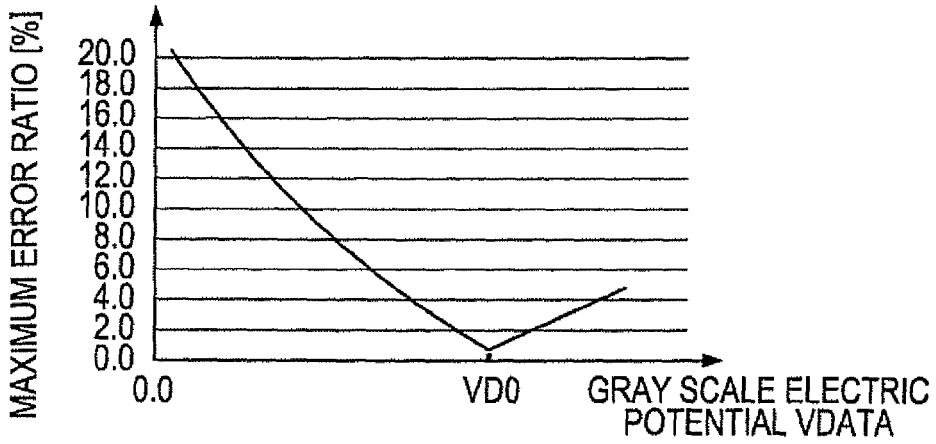
FIG. 8 is a graph showing the relationship between a gray scale electric potential and an error in a driving current in a comparative example.

FIG. 8 is a graph showing the correlation between the gray scale electric potential VDATA and the error in the current amount of the driving current IDR, according to the comparative example. In FIG. 8, the horizontal axis represents a voltage value of the gray scale electric potential VDATA with the reference electric potential VREF used as a reference value (0.0), and the vertical axis represents a relative ratio (maximum error ratio) of the maximum value of the current amount of the driving current IDR to the minimum value of the current amount of the driving current IDR for a case where a specific gray scale value D is designated. As can be known from FIG. 8, in a case where the temporal length tb of the second compensation operation is set to a fixed value, when the gray scale electric potential VDATA is set to a specific value VD0, the error in the driving current IDR is decreased assuredly. However, in such a case, as the gray scale electric potential VDATA is apart far from the specific value VD0, the error in the driving current IDR increases. In other words, in the comparative example, it is difficult to suppress the error in the driving current IDR due to the mobility μ of the driving transistor TDR over a broad range of the gray scale electric potentials VDATA.

Figure 9:
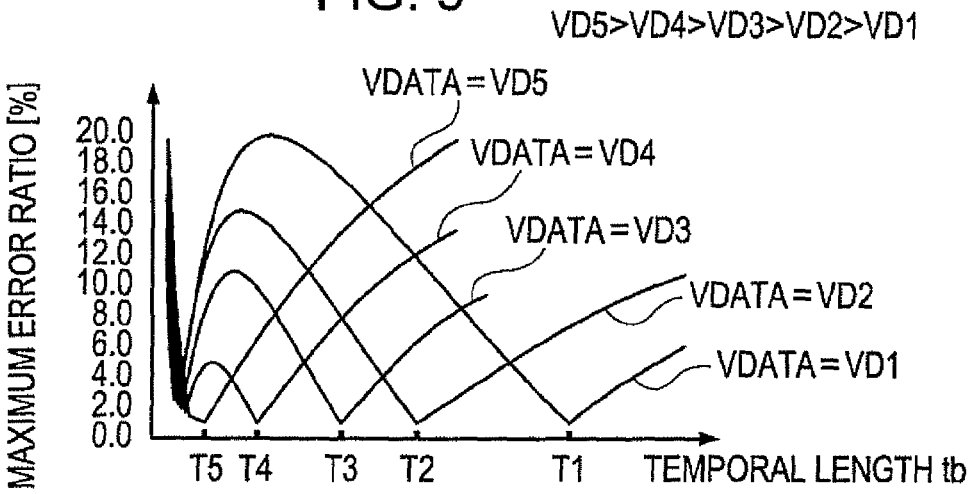
FIG. 9 is a graph showing the relationship between the temporal length of an operating period and the error in the driving current.

FIG. 9 is a graph acquired by calculating the relationship between the temporal length tb of the operation period PWR2 and the error (the maximum error ratio) in the driving current IDR for a plurality of cases where the gray scale electric potential VDATA is changed (VD1<VD2<VD3<VD4<VD5). The tendency that the temporal length tb, in which the error in the driving current IDR becomes the minimum, is different depending on the gray scale electric potential VDATA is found from FIG. 9. That is, as the gray scale electric potential VDATA becomes higher, the total time T for which the error in the driving current IDR becomes the minimum is shortened. As can be known from description above, according to this embodiment, by setting the temporal length tb of the operation period PWR2 to be changed in accordance with the gray scale value D (the gray scale electric potential VDATA), the error in the driving current IDR is suppressed regardless of the gray scale electric potential VDATA. For example, in such a state, when the gray scale electric potential VDATA is set to an electric potential VD1 shown in FIG. 9, the temporal length tb is set to a specific value T1. On the other hand, in the state, when the gray scale electric potential VDATA is set to an electric potential VD2 that is higher than the electric potential VD1, the temporal length tb is set to a specific value T2 (T2<T1).

Next, the second compensation operation within the operation period PWR2 will be reviewed in detail. The relationship shown in the following Equation (7) is satisfied between the current Ids that flows between the drain and the source of the driving transistor TDR in performing the second compensation operation and the capacitance values of the capacitors (the storage capacitor C1 and the capacitor C2) that are charged by the current Ids. In addition, C shown in Equation (7) is a sum (C=cp1+cp2) of the capacitance values of the storage capacitor C1 and the capacitor C2.

$$Ids=dQ/dt=C\cdot(dVS/dt) \quad \text{Equation (7)}$$

In addition, when considering the fact (dVS/dt=dΔV/dt) that the temporal change of the electric potential VS of the source of the driving transistor TDR is equivalent to that of the voltage ΔV, the following Equation (8) is derived from Equation (6) and Equation (7). The voltage ΔV(t) shown in Equation (8) represents that the voltage ΔV shown in Equation (6) changes with respect to a time t elapsed from the start of the second compensation operation (the start point of the operation period PWR2).

$$C(d\Delta V/dt)=K(VIN-\Delta V(t))^2 \quad \text{Equation (8)}$$

When Equation (8) is integrated under the condition that the voltage ΔV(t) (ΔV(0)) at the start point (t=0) of the operation period PWR2 is zero, the following Equation (9) that represents the current Ids (tb) between the drain and the source of the driving transistor TDR at the end point (t=tb) of the operation period PWR2 is derived.

Equation (9)

$$Ids(t_b) = K\left(\frac{V_{IN}}{1 + V_{IN}\frac{Kt_b}{C}}\right)^2 \quad (9)$$

The coefficient K shown in Equation (9) includes the mobility μ of the driving transistor TDR as is written additionally in Equation (6). Accordingly, the coefficient K corresponds to an index that represents the degree of error in the mobility μ. The driving current IDR that is supplied to the light emitting element E for the driving period PDR depends on the current Ids(tb) shown in Equation (9). Thus, in order to minimize the error in the driving current IDR, it is needed to minimize the error in the current Ids (tb) with respect to the variance of the coefficient K (mobility μ). A case where the error in the current Ids(tb) with respect to the variance of the coefficient K becomes the minimum is a case where the result of differentiating Equation (9) with respect to the coefficient K becomes zero. From the above-described condition, Equation (10) is derived.

Equation (10)

$$\frac{dIds}{dK} = \left(\frac{V_{IN}}{1 + V_{IN}\frac{Kt_b}{C}}\right)^2\left(\frac{C - KV_{IN}t_b}{C + KV_{IN}t_b}\right) = 0 \quad (10)$$

Accordingly, the condition under which the effect of compensation for the driving current IDR made by the second compensation operation becomes the maximum can be represented by the following Equation (11).

$$C=K\cdot VIN\cdot tb \quad \text{Equation (11)}$$

Since the voltage VIN shown in Equation (11) is set in accordance with the gray scale electric potential VDATA, a condition (as the gray scale electric potential VDATA becomes higher, the temporal length tb is shortened) that is the same as that described with reference to FIG. 9 for the gray scale electric potential VDATA and the temporal length tb of the operation period PWR2 can be found in Equation (11). Described in more details, when a value acquired by multiplying the voltage VIN by the temporal length tb of the operation period PWR2 (or a value acquired by multiplying the gray scale electric potential VDATA by the temporal length tb) is a predetermined value, the effect of compensation, which is performed by the second compensation operation, for the driving current IDR becomes the maximum.

Figure 10:
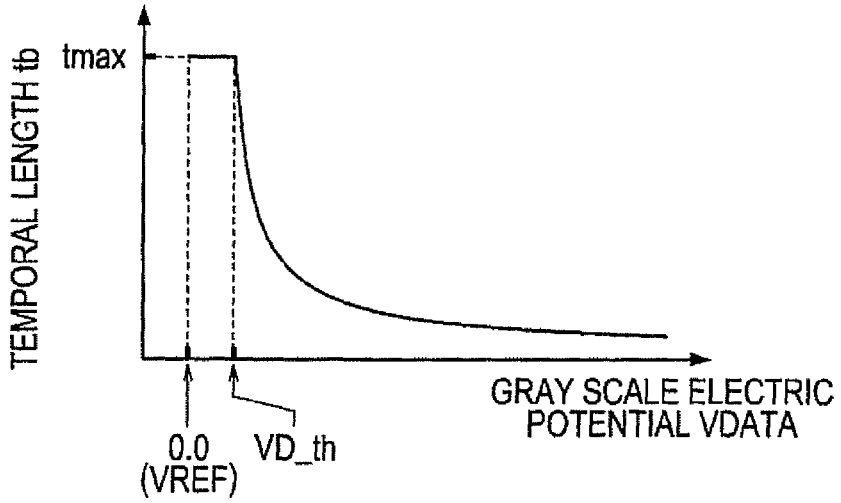
FIG. 10 is a graph showing the relationship between the gray scale electric potential and the temporal length of the operating period.

Based on the contents described above with reference to FIG. 9 and Equation (11), according to this embodiment, the relationship between the gray scale electric potential VDATA and the temporal length tb is set as shown in FIG. 10. As shown in FIG. 10, as the gray scale electric potential VDATA becomes higher (the amount VIN of the change in the voltage VGS between the gate and the source of the driving transistor TDR due to supply of the gray scale electric potential VDATA becomes larger), the temporal length tb of the operation period PWR2 is set to a shorter time interval. Described in more details, as can be known from Equation (11), the temporal length tb is set such that a value acquired by multiplying the gray scale electric potential VDATA (voltage VIN) by the temporal length tb becomes a predetermined value (the temporal length tb is in inverse proportion to the gray scale electric potential VDATA). For example, the temporal length tb corresponding to each of a plurality of types of the gray scale electric potentials VDATA is set such that the error in the driving current IDR, which is set in accordance with the gray scale electric potential VDATA, is decreased (minimized, ideally), to be 1% or less.

However, the temporal length tb for minimizing the error in the driving current IDR becomes longer as the gray scale electric potential VDATA is lowered. Thus, when the error in the driving current IDR is to be strictly minimized even in a case where the gray scale electric potential VDATA is sufficiently low (for example, in a case where the lowest gray scale is designated), the temporal length tb needs to be set to an excessively long time. Thus, the signal line driving circuit 34 according to this embodiment, as shown in FIG. 10, sets (clips) the temporal length tb of the operation period PWR2 to a predetermined value tmax, which does not depend on the gray scale value D, when the gray scale value D below a predetermined value is designated (when the gray scale electric potential VDATA is lower than the electric potential VDth shown in FIG. 10). The maximum value tmax is limited to a time that is shorter than a temporal length needed for decreasing the voltage VGS of the driving transistor TDR to the threshold voltage VTH by performing the second compensation operation. Under the above-described configuration, it is possible to shorten the write period PWR (additionally, the unit period).

As described with reference to FIG. 3, the second compensation operation within the write period PWR is started as the signal S[j] (the electric potential VG of the gate of the driving transistor TDR) is changed from the reference electric potential VREF to the gray scale electric potential VDATA.

Accordingly, each unit circuit 40 of the signal line driving circuit 34 controls the temporal length tb (the temporal length ta of the standby period PWR1) of the operation period PWR2 to be changeable by adjusting the time point for changing the signal S[j] from the reference electric potential VREF to the gray scale electric potential VDATA in accordance with the gray scale value D.

Figure 11:
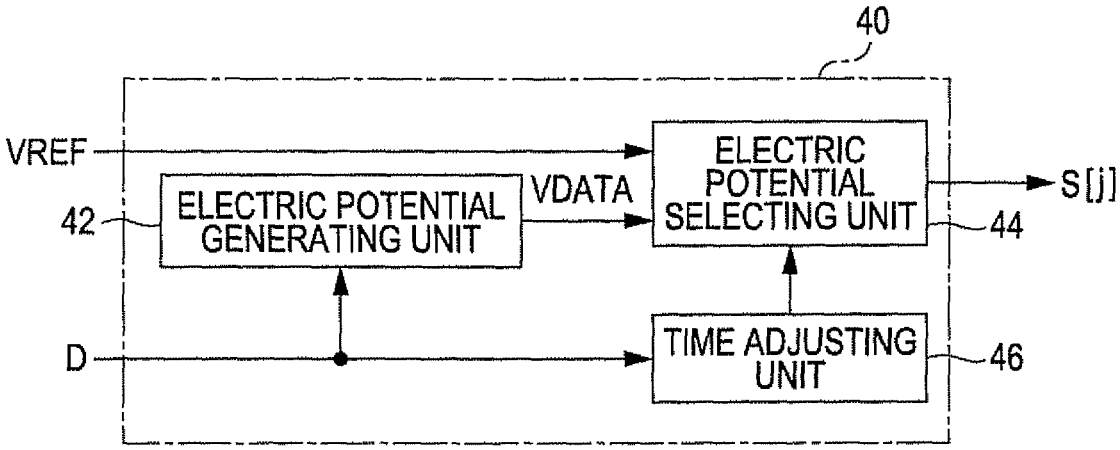
FIG. 11 is a block diagram showing a unit circuit that is included in a signal line driving circuit.

FIG. 11 is a block diagram showing the unit circuit 40 of the signal line driving circuit 34. In FIG. 11, one unit circuit 40 that generates and outputs the signal S[j] is representatively shown. As shown in FIG. 11, the unit circuit 40 includes an electric potential generating unit 42, an electric potential selecting unit 44, and a time adjusting unit 46. The gray scale value D of the j-th pixel circuit U is applied to the electric potential generating unit 42 and the time adjusting unit 46.

The electric potential generating unit 42 generates the gray scale electric potential VDATA corresponding to the gray scale value D. For example, a D/A converter of the voltage-output type is used as the electric potential generating unit 42. To the electric potential selecting unit 44, the reference electric potential VREF that is generated by the power supply circuit (not shown) and the gray scale electric potential VDATA that is generated by the electric potential generating unit 42 are supplied. The electric potential selecting unit 44 selectively outputs either the reference electric potential VREF or the gray scale electric potential VDATA to the signal line 14 as the signal S[j]. Described in more details, the electric potential selecting unit 44 outputs the reference electric potential VREF in the reset period PRS, the compensation period PCP, and the standby period PWR1 of the write period PWR and outputs the gray scale electric potential VDATA in the operation period PWR2 of the write period PWR.

The time adjusting unit 46 controls the time point when the electric potential of the signal S[j] is changed from the reference electric potential VREF to the gray scale electric potential VDATA (that is, the boundary between the standby period PWR1 and the operation period PWR2) by the electric potential selecting unit 44 so as to be changeable in accordance with the gray scale value D. For example, a counter circuit that starts counting at the start point of the write period PWR and outputs a direction for switching the electric potential (VREF→VDATA) to the electric potential selecting unit 44 at a time point when the counting value reaches a number corresponding to the gray scale value D (a time point when the temporal length ta elapses from the start of counting) is used as the time adjusting unit 46. The time adjusting unit 46 limits the temporal length tb to the maximum value tmax, as described above.

Figure 12:
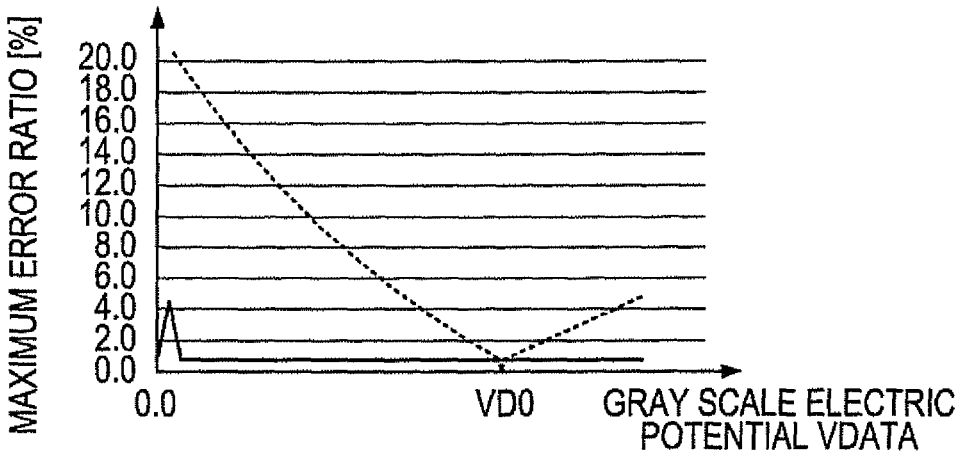
FIG. 12 is a graph for explaining the advantage of the first embodiment.

FIG. 12 is a graph showing the relationship (solid line) between the gray scale electric potential VDATA and the error in the driving current IDR according to this embodiment. In FIG. 12, the correlation (FIG. 8) between the gray scale electric potential VDATA and the error in the driving current IDR according to a comparative example is represented in a broken line additionally. As shown in FIG. 12, according to this embodiment, there is an advantage that the error in the driving current IDR is suppressed to be 1% or less over a broad range of the gray scale electric potentials VDATA, compared to a comparative example (for example, JP-A-2007-310311) where the temporal length tb of the second compensation operation is fixed instead of being changed in accordance with the gray scale value D.

As shown in FIG. 12, the error in the driving current IDR is slightly increased in a low-electric potential area of the gray scale electric potential VDATA. This is caused by the influence of limiting the upper limit of the temporal length tb to the maximum value tmax. Above all, it is apparent from FIG. 12 that the error in the driving current IDR is enhanced markedly, compared to the comparative example, although the error in the driving current IDR is increased on the low-electric potential side.

Major reasons for the error in the driving current IDR are the threshold voltage VTH of the driving transistor TDR and the error in the mobility μ of the driving transistor TDR. Since the error in the threshold voltage VTH is compensated by the first compensation operation in which the voltage VGS of the driving transistor TDR is set to the threshold voltage VTH, the second compensation operation can be also perceived as an operation for compensating for the error in the mobility μ of the driving transistor TDR. In other words, the temporal length tb of the operation period PWR2 is controlled so as to be changed in accordance with the gray scale value D, so that the error in the mobility μ of the driving transistor TDR is compensated over a wide range of the gray scale electric potential VDATA.

B: Second Embodiment

Next, a second embodiment of the invention will be described. According to the first embodiment, the first compensation operation is performed for each pixel circuit U in the i-th row in the compensation period PCP within the unit period H[i]. However, when it takes a considerable time for the voltage VGS between the gate and the source of the driving transistor TDR to reach the threshold voltage VTH, the unit period H[i] needs to be set to a long time. In addition, there is a problem that an increase in the precision (an increase of the number of rows) of the pixel circuit U is restricted as the unit period H[i] becomes longer. Thus, according to the second embodiment, by performing the first compensation operation over a plurality of unit periods H, the voltage VGS of the driving transistor TDR is assuredly set to the threshold value VTH while shortening the temporal length of the unit period H.

Figure 13:
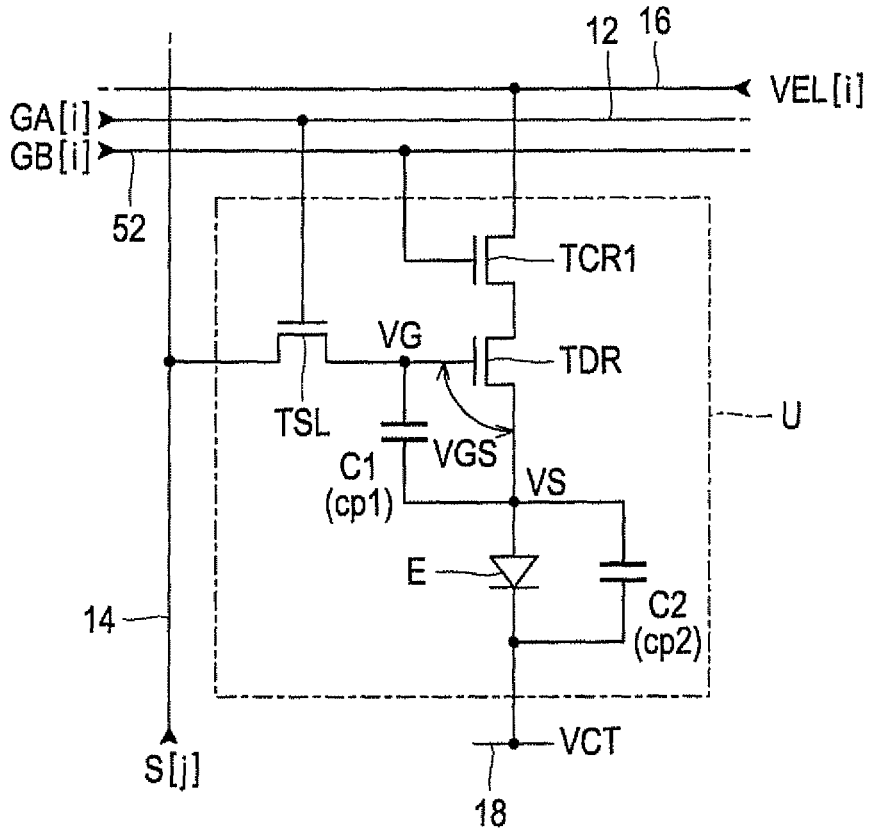
FIG. 13 is a circuit diagram of a pixel circuit according to a second embodiment of the invention.

FIG. 13 is a circuit diagram of the pixel circuit U according to the second embodiment. As shown in FIG. 13, the pixel circuit U of this embodiment has a configuration in which a control switch TCR1 is added to the pixel circuit U of the first embodiment. The control switch TCR1 is disposed in the path of the current Ids (driving current IDR) of the driving transistor TDR between the drain and the source. For example, as shown in FIG. 13, an N-channel transistor that is interposed between the drain of the driving transistor TDR and the feed line 16 is appropriate as the control switch TCR1.

Within the component unit 107 m control lines 52 that extend in the direction x together with the scanning line 12 are formed. As shown in FIG. 13, the gate of the control switch TCR1 of each pixel circuit U of the i-th row is connected to the control line 52 of the i-th row. To the control lines 52, control signals GB (GB[1] to GB[m]) are supplied from the driving circuit 30 (for example, the scanning line driving circuit 32). When the control switch TCR1 is transited to the ON state, the path of the current Ids is set up. On the other hand, when the control switch TCR1 is transited to the OFF state, the path of the current Ids is blocked.

In order to perform the first compensation operation and the second compensation operation, the current Ids needs to flow through the driving transistor TDR.

Accordingly, when the first compensation operation or the second compensation operation is performed, the control switch TCR1 is set to be in the ON state. In addition, when the operation for resetting the voltage VGS between the gate and the source of the driving transistor TDR to the voltage VGS1 shown in Equation (1) (hereinafter, referred to as a "reset operation") is performed, the electric potential VS of the source of the driving transistor TDR is set to the electric potential V2 (electric potential VEL[i]) of the feed line 16. Accordingly, the control switch TCR1 is set to be in the ON state even when the reset operation is performed.

Figures 14A, 14B:
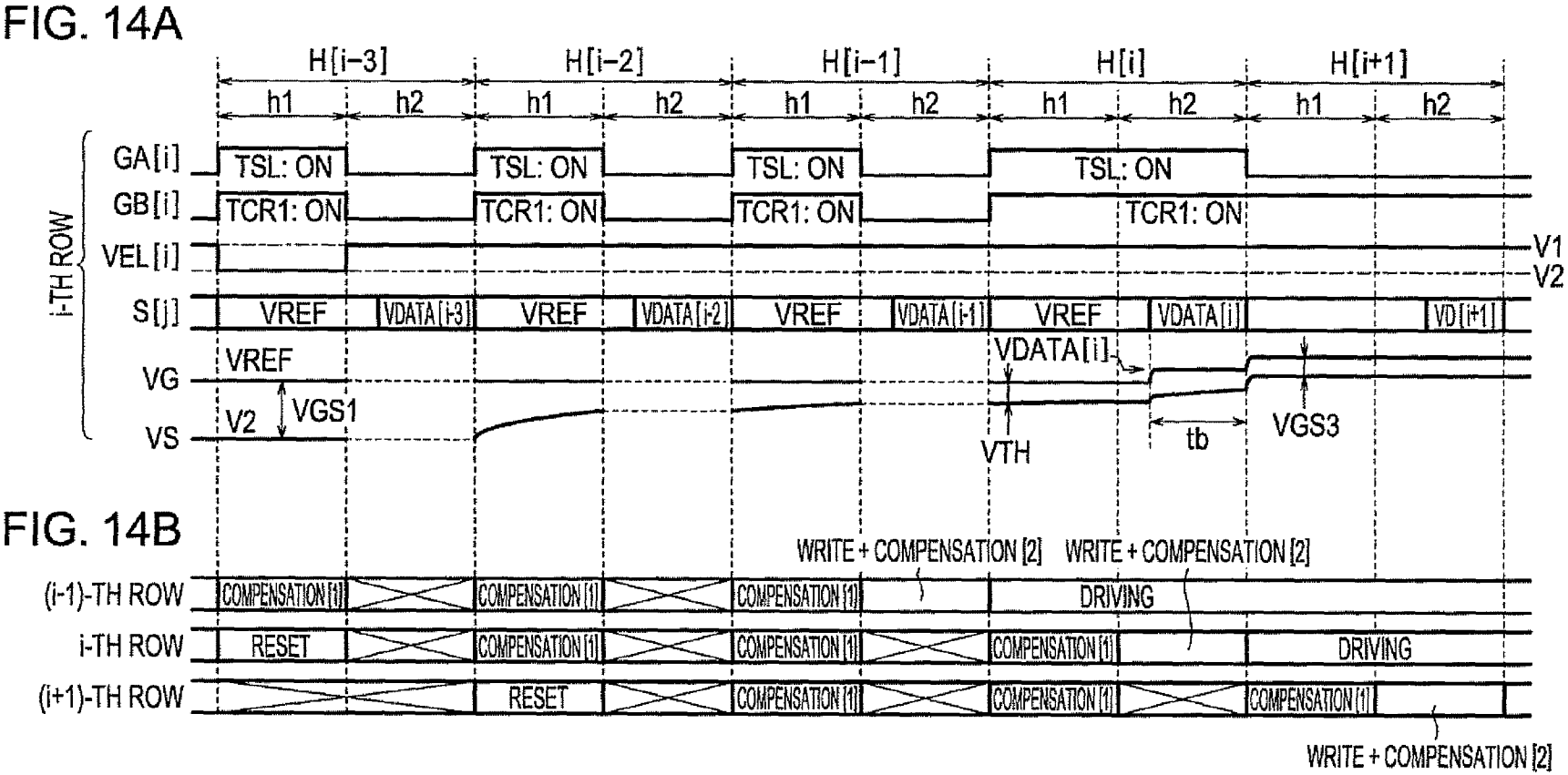
FIGS. 14A and 14B are timing charts showing the operation according to the second embodiment.

FIGS. 14A and 14B are timing charts for describing a method of driving the pixel circuit U. As shown in FIG. 14A, each of a plurality of unit periods H ( . . . , H[i−3], H[i−2], H[i−1], H[i], H[i+1], . . . ) is divided into a period h1 and a period h2. The period h1 is a period of a first half of the unit period H, and the period h2 is a period of the second half of the unit period H. The driving circuit 30 sequentially performs supply of the gray scale electric potential VDATA to the pixel circuit U and the second compensation operation ("write compensation[2]" shown in FIG. 14B) in units of rows for each period h2 of the unit period H. In other words, the period h2 of the unit period H[i] corresponds to the write period PWR of each pixel circuit U of the i-th row.

As shown in FIG. 14A, the scanning line driving circuit 32 controls the selection switch and the control switch TCR1 of each pixel circuit U of the i-th row to be in the ON state by setting the scanning signal GA[i] and the control signal GB[i] to the active level in the period h2 of the unit period H[i]. On the other hand, the signal line driving circuit 34 changes the electric potential of the signal S[j] from the reference electric potential VREF to the gray scale electric potential VDATA[i] of the pixel circuit U of the i-th row at a time point (the start point of the operation period PWR2) when the temporal length ta elapses from the start point of the period h2 of the unit period H[i]. Accordingly, as shown in FIG. 14A, in each pixel circuit U of the i-th row, the second compensation operation is performed over the temporal length tb according to the gray scale value D in the period h2 of the unit period H[i].

In addition, the driving circuit 30 performs the reset operation (the "reset" shown in FIG. 14B) and the first compensation operation (the "compensation[1]" shown in FIG. 14B) of each pixel circuit U of the i-th row for a plurality of periods h1 before start of the period h2 of the unit period H[i]. First, the scanning line driving circuit 32 sets the scanning signal GA[i] and the control signal GB[i] to the active level for the period h1 of the unit period H[i−3] that is three unit periods before the unit period H[i], and accordingly, the selection switch TSL and the control switch TCR1 of each pixel circuit U of the i-th row is set to be in the ON state. In addition, as shown in FIG. 14A, the signal line driving circuit 34 sets the signal S[j] to the reference electric potential VREF, and the electric potential control circuit 36 sets the electric potential VEL[i] to the electric potential V2. Accordingly, the voltage VGS between the gate and the source of the driving transistor TDR of each pixel circuit U of the i-th row is set to the voltage VGS1 (VGS1=VREF−V2) shown in Equation (1) for the period h1 of the unit period H[i−3] as the reset period PRS.

In addition, also for the three periods h1 (the period h1 of each of the unit periods H[i−2] to H[i]) before start of the period h2 of the unit period H[i], similarly to the period h1 of the unit period H[i−3], the selection switch TSL and the control switch TCR1 of each pixel circuit U of the i-th row are controlled to be in the ON state, and the signal S[j] is set to the reference electric potential VREF. On the other hand, the electric potential control circuit 36 changes the electric potential VEL[i] of the feed line 16 of the i-th row to the electric potential V1 after the period h1 of the unit period H[i−3] elapses.

Accordingly, the first compensation operation is performed in each pixel circuit U of the i-th row for the period h1 of each of the unit periods H[i−2] to H[i] as the compensation period PCP.

Since the selection switch TSL and the control switch TCR1 are controlled to be in the OFF state are in the OFF state for the period h of each of the unit periods H[i−3] to H[i] (that is, a period for which the gray scale electric potential VDATA of the pixel circuit U that is positioned not in the i-th row is supplied to the signal line 14), the voltage VGS between the gate and the source of the driving transistor TDR of the i-th row does not change. In other words, by intermittently performing the first compensation operation in each pixel circuit U of the i-th row over each period hi of the three unit periods H[i−2] to H[i], the voltage VGS of the driving transistor is set to the threshold voltage VTH.

When the unit period H[i] elapses, the scanning line driving circuit 32 sets the scanning signal GA[i] to the inactive level, and whereby the selection switch TSL is changed to be in the OFF state. The control signal GB[i] is maintained to be the active level after the unit period H[i] elapses. Accordingly, similarly to the first embodiment, the driving current IDR shown in Equation (6) is supplied to the light emitting element E from the feed line 16 through the control switch TCR1 and the driving transistor TDR. The above-described operation for the pixel circuit U of the i-th row is repeated in the same manner for each row.

According to the above-described embodiment, the first compensation operation is performed over the period h1 of the plurality of unit periods H. Accordingly, compared to the first embodiment in which the first compensation operation is performed within one unit period H, there is an advantage that a temporal length sufficient for the voltage VGS of the driving transistor TDR to reach the threshold voltage VTH can be acquired for the first compensation operation even for a case where the temporal length of the unit period H is short.

C: Third Embodiment

Figure 15:
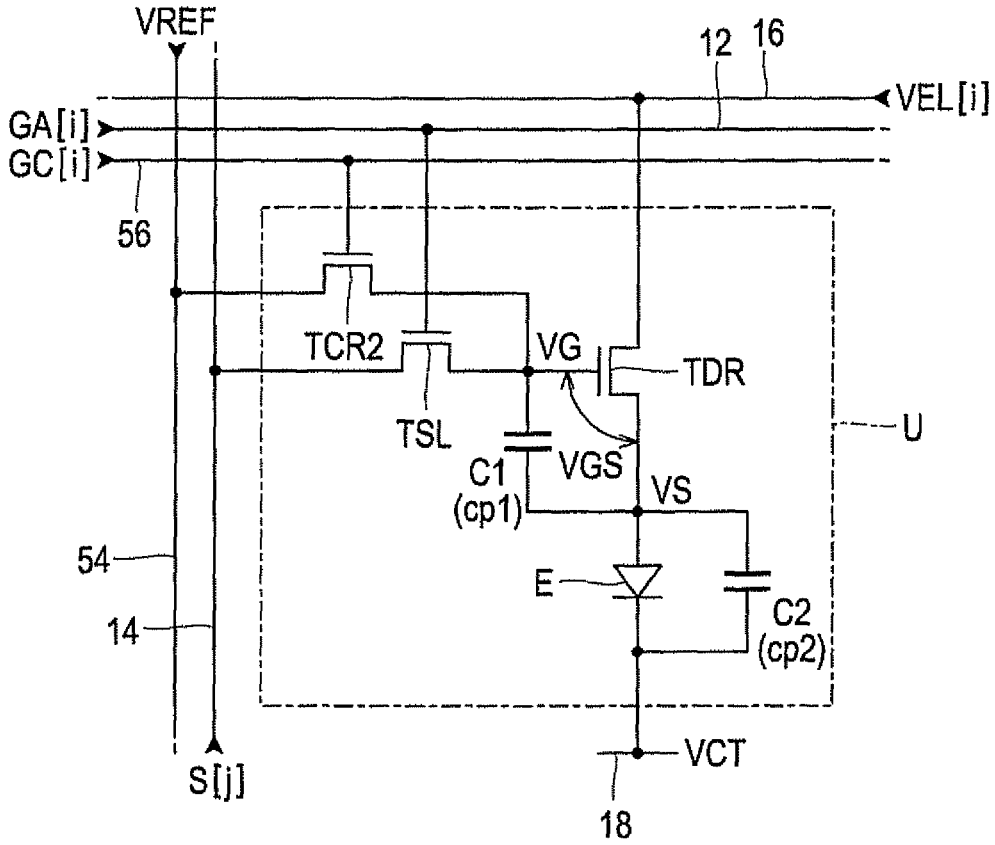
FIG. 15 is a circuit diagram showing a pixel circuit according to a third embodiment of the invention.

FIG. 15 is a circuit diagram of a pixel circuit U according to a third embodiment of the invention. As shown in FIG. 15, the pixel circuit U of this embodiment has a configuration in which a control switch TCR2 is added to the pixel circuit U of the first embodiment. The control switch TCR2 is interposed between the gate of the driving transistor TDR and the feed line 54. The control switch TCR2 is an N-channel transistor that controls electrical connection (conduction or non-conduction) between the gate of the driving transistor TDR and the feed line 54. To the feed line 54, the reference electric potential VREF is supplied. In other words, the signal line 14 is also used for the supply of the reference electric potential VREF to the pixel circuit U in the first embodiment or the second embodiment, but the reference electric potential VREP is supplied to each pixel circuit U by using the feed line 54 other than the signal line 14 in this embodiment.

In the component unit 10, m control lines 56 extending in the X direction are disposed together with the scanning line 12. As shown in FIG. 15, the gate of the control switch TCR2 of each of the pixel circuits U of the i-th row is connected to the control line 56 of the i-th row. In addition, control signals GC (GC[1] to GC[m]) are applied from the driving circuit 30 (for example, the scanning line driving circuit 32) to the control lines 56.

Figures 16A, 16B:
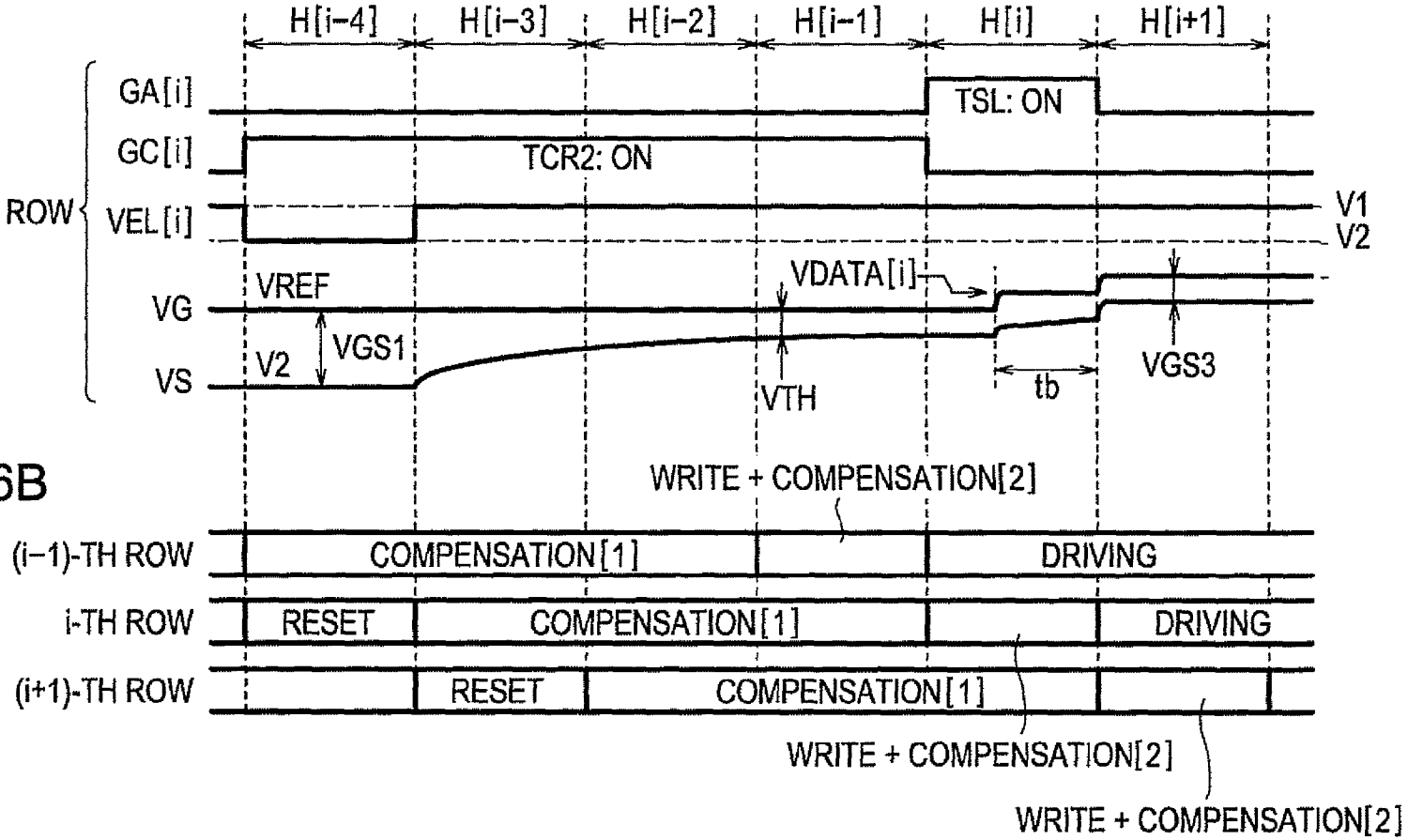
FIGS. 16A and 16B are timing charts showing the operation according to a third embodiment of the invention.

FIGS. 16A and 16B are timing charts for describing a method of driving the pixel circuit U. As shown in FIG. 16B, the driving circuit 30 sequentially performs supply of the gray scale electric potential VDATA and the second compensation operation for the pixel circuit U in units of rows for each unit period H. In other words, the unit period H[i] corresponds to the write period PWR of each pixel circuit U of the i-th row.

As shown in FIG. 16A, the scanning line driving circuit 32 sets the scanning signal GA[i] to the active level and sets the control signal GC[i] to the inactive level for the unit period H[i]. Accordingly, the selection switch TSL is in the ON state, and the control switch TCR2 is in the OFF state. On the other hand, the signal line driving circuit 34 changes the electric potential of the signal S[j] from the reference electric potential VREF to the gray scale electric potential VDATA[i] at a time point when the temporal length ta elapses from the start point of the unit period H[i]. Accordingly, as shown in FIG. 16A, in each pixel circuit U of the i-th row, the second compensation operation is performed over the temporal length tb within the unit period H[i].

In addition, the driving circuit 30 performs the reset operation for each pixel circuit U of the i-th row for the unit period H[i−4] as the reset period PRS and performs the first compensation operation for the unit periods H[i−3] to H[i−1] as the compensation period PCP. First, as shown in FIG. 16A, the scanning line driving circuit 32 controls the selection switch TSL to be in the OFF state by setting the scanning signal GA[i] to the inactive state and controls the control switch TCR2 to be in the ON state by setting the control signal GC[i] to the active level, for the unit period H[i−4]. Accordingly, to gate of the driving transistor TDR, the reference electric potential VREF is supplied from the feed line 54 through the control switch TCR2. On the other hand, the electric potential control circuit 36 sets the electric potential VEL[i] to the electric potential V2 for the unit period H[i−4]. Accordingly, same as in the first embodiment or the second embodiment, the voltage VGS between the gate and the source of the driving transistor TDR is reset to the voltage VGS1 (VGS1=VREF−V2) shown in Equation (1) for the unit period H[i−4].

In addition, also for each of the unit periods H[i−3] to H[i−1], same as for the unit period H[i−4], the control switch TCR2 is controlled to be in the ON state, and the reference electric potential VREF is supplied to the gate of the driving transistor TDR from the feed line 54 through the control switch TCR2. On the other hand, the electric potential control circuit 36 changes the electric potential VEL[i] to the electric potential V1 after the unit period H[i−4] elapses. Accordingly, as shown in FIG. 16B, the first compensation operation is continuously performed over the unit periods H[i−3] to H[i−1] for each pixel circuit U of the i-th row. On the other hand, each signal line 14 is disconnected from the pixel circuit U of the i-th row for the unit periods H[i−4] to H[i−1] and is used for supply of the gray scale electric potential VDATA to each pixel circuit U of the (i−4)-th row to the (i−1)-th row.

When the unit period H[i] elapses, the scanning line driving circuit 32 sets both the scanning signal GA[i] and the control signal GC[i] to the inactive level so as to control the selection switch TSL and the control switch TCR2 to be in the OFF state. Accordingly, same as in the first embodiment, the driving current IDR shown in Equation (6) is supplied from the feed line 16 to the light emitting element E through the driving transistor TDR. The above-described operation for the pixel circuits U of the i-th row is repeated in the same manner for each row.

In the above-described embodiment, the first compensation operation is performed over the plurality (three) of the unit periods H. Accordingly, same as in the second embodiment, acquisition of the temporal length of the first compensation operation and shortening of the unit period H can be achieved together.

In addition, according to the second embodiment, the supply of the reference electric potential VREF (for the period h1) and the supply of the gray scale electric potential VDATA (for the period h2) are performed by using the common signal line 14 for the unit period H in a time-division manner. Accordingly, a period that can be used as the write period PWR is only the period h2 within the unit period H. Accordingly, a maximum value of the temporal length tb of the second compensation operation is limited to the temporal length (for example, a half of the unit period H) of the period h2. On the other hand, according to this embodiment, the feed line 54 other than the signal line 14 is used for the supply of the reference electric potential VREF in the reset operation and the first compensation operation, and accordingly, the entire unit period H can be used as the write period PWR. Accordingly, there is an advantage that the temporal length tb of the second compensation operation can be set up to the temporal length of the unit period H as a maximum length (that is, the width of change in the temporal length tb can be sufficiently acquired). Above all, according to the second embodiment, the signal line 14 is commonly used for the supply of the reference electric potential VREF and the supply of the gray scale electric potential VDATA, and accordingly, there is an advantage that the configuration of the component unit 10 is simplified (the number of wirings is decreased), compared to the third embodiment.

D: Fourth Embodiment

Next, a fourth embodiment of the invention will be described. In the first embodiment, a configuration in which the temporal length tb of the second compensation operation in the write period PWR is controlled to be changed in accordance with the gray scale value D has been exemplified. According to this embodiment, in addition to the control of the temporal length tb of the second compensation operation, the temporal length of the first compensation operation in the compensation period PCP is controlled to be changed in accordance with the gray scale value D. The configuration of the pixel circuit U is the same as that of the first embodiment (FIG. 2).

Figure 17:
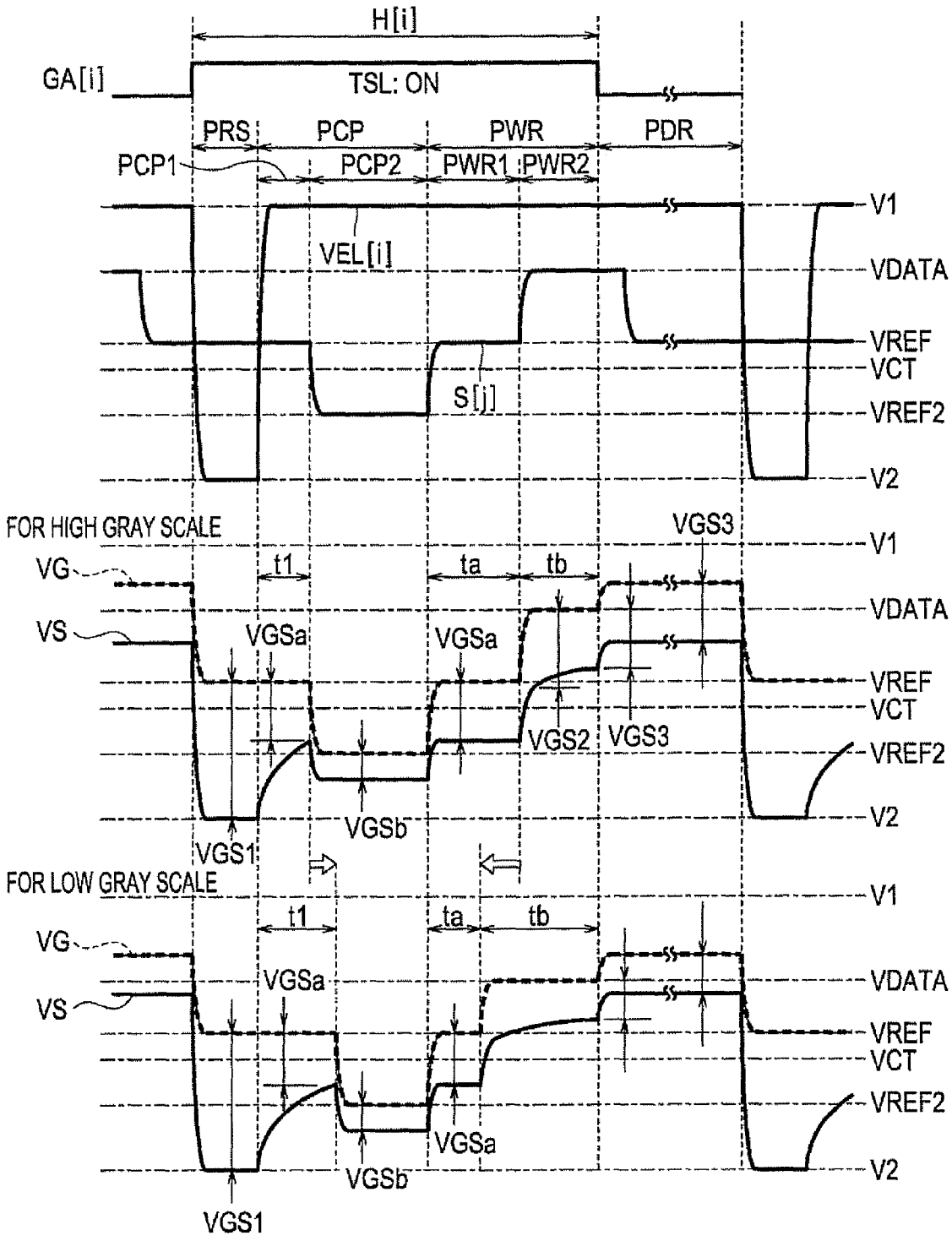
FIG. 17 is a timing chart showing the operation according to a fourth embodiment of the invention.

FIG. 17 is a timing chart showing the operation of a light emitting device 100 (pixel circuit U) according to this embodiment. As shown in FIG. 17, the compensation period PCP is divided into an operation period PCP1 and a hold period PCP2. The operation period PCP1 is a period from the start point of the compensation period PCP (the end point of the reset period PRS) to a time when the temporal length t1 elapses. In addition, the hold period PCP2 is the remaining period of the compensation period PCP (a period from the end point of the operation period PCP1 to the end point of the compensation period PCP). The temporal length t1 of the operation period PCP1, similar to the temporal length tb of the operation period PWR2, is set to be changed in accordance with the gray scale value D that is designated to the pixel circuit U. In other words, as shown in FIG. 17, the temporal length t1 for a case where the gray scale value D designates a high gray scale (high luminance) is shorter than the temporal length t1 for a case where the gray scale value D designates a low gray scale (low luminance).

As shown in FIG. 17, similar to the compensation period PCP according to the first embodiment, the electric potential VEL[i] is set to the electric potential V1 in a state, in which the driving transistor TDR is maintained to be in the ON state continuously from the reset period PRS, for the operation period PCP1, and accordingly, the first compensation operation in which the voltage VGS between the gate and the source of the driving transistor TDR gradually approaches the threshold voltage VTH is performed. According to the first embodiment, the first compensation operation is continued until the voltage VGS coincides with the threshold voltage VTH. However, according to this embodiment, the first compensation operation is stopped at the start point of the hold period PCP2 (a time point when the temporal length t1 elapses from the start point of the compensation period PCP)

before reach of the voltage VGS to the threshold voltage VTH. The stopping of the first compensation operation will be described in detail as below.

As shown in FIG. 17, when the hold period PCP2 is started, the signal line driving circuit 34 changes the electric potential of the signal S[j] to a reference electric potential VREF2. The reference electric potential VREF2 is lower than the reference electric potential VREF. Since the selection switch TSL is maintained to be continuously in the ON state for the operation period PCP1, the electric potential VG of the gate of the driving transistor TDR is changed (decreased) from the reference electric potential VREF at the operation period PCP1 to the reference electric potential VREF2 when the hold period PCP2 is started.

Since the storage capacitor C1 is interposed between the gate and the source of the driving transistor TDR, as shown in FIG. 17, the electric potential VS of the source of the driving transistor TDR is changed (decreased) by an amount (ΔVREF·cp1/(cp1+cp2)) that is acquired by dividing the amount of change ΔVREF (ΔVREF=VREF−VREF2) of the electric potential VG in accordance with the ratio of the capacitance value of the storage capacitor C1 to that of the capacitor C2. Accordingly, the voltage VGSB right after the start of the hold period PCP2 can be represented as the following Equation (12) by using the voltage VGSa between the gate and the source of the driving transistor TDR at the end point of the operation period PCP1.

$$VGSb = VGSa - \Delta VREF \cdot cp2/(cp1+cp2) \quad \text{Equation (12)}$$

The reference electric potential VREF2 is set such that the voltage VGSb shown in Equation (12) is lower than the threshold voltage VTH of the driving transistor TDR. Accordingly, the driving transistor TDR is transited to the OFF state for the hold period PCP2. In other words, the first compensation operation is stopped at the start of the hold period PCP2, and the voltage VGS of the driving transistor TDR is maintained at the voltage VGSb shown in Equation (12) until the end point of the hold period PCP2 is reached.

When the write period PWR (the standby period PWR1) is started, the signal line driving circuit 34 changes the electric potential of the signal S[j] to the reference electric potential VREF that is the same as that for the operation period PCP1 of the compensation period PCP. Accordingly, the voltage VGS between the gate and the source of the driving transistor TDR returns to the voltage VGSa, which is the voltage at the time when the first compensation operation ends, at the end point of the operation period PCP1. The operations thereafter are the same as those of the first embodiment.

When the correlation between a total time T acquired by summing the temporal length t1 of the operation period PCPB and the temporal length tb of the operation period PWR2 and the error in the driving current IDR is checked, similarly to the correlation between the temporal length tb exemplified in FIG. 10 and the error in the driving current IDR, a total time T for which the error in the driving current IDR becomes a minimum is individually determined for each gray scale electric potential VDATA.

For example, as the gray scale electric potential VDATA becomes higher, the total time T for which the error in the driving current IDR becomes the minimum is shortened. The temporal length t1 and the temporal length tb are set to values that are acquired by dividing a total time T that is determined for each gray scale electric potential VDATA in the above described order. However, the temporal length t1 is set to a temporal length that is shorter than a time for which the voltage VGS of the driving transistor TDR reaches the threshold voltage VTH by performing the first compensation operation. In addition, the temporal length tb is set to a temporal length that is shorter than a time for which the voltage VGS reaches the threshold voltage VTH by performing the second compensation operation.

The control of the temporal length t1 of the operation period PCP1 is implemented by using a configuration that is the same as that shown in FIG. 11. In other words, the time adjusting unit 46 changes the time point when the electric potential selecting unit 44 changes the reference electric potential VREF to the reference electric potential VREF2 to be changed in accordance with the gray scale value D. An upper limit is set to the temporal length t1, similar to the temporal length tb.

According to the above-described embodiment, the temporal length t1 of the first compensation operation, in addition to the temporal length tb of the second compensation operation, is also controlled to be changed in accordance with the gray scale value D. Accordingly, a large width of change in the temporal length of the compensation operation can be acquired, compared to the first embodiment in which only the temporal length tb is controlled. Therefore, it is possible to suppress the error in the driving current IDR for the gray scale electric potential VDATA over a wider range. In addition, as shown in FIG. 17, the electric potential of the signal S[j] is set to the reference electric potential VREF for the standby period PWR1 of the write period PWR and then, is changed to the gray scale electric potential VDATA at the start point of the operation period PWR2. However, a configuration in which the electric potential of the signal S[j] is maintained at the reference electric potential VREF2 also in the standby period PWR1 continuously from the prior hold period PCP2, and the electric potential of the signal S[j] is changed from the reference electric potential VREF2 to the gray scale electric potential VDATA at the start point of the operation period PWR2 may be employed.

E: Fifth Embodiment

Figure 18:
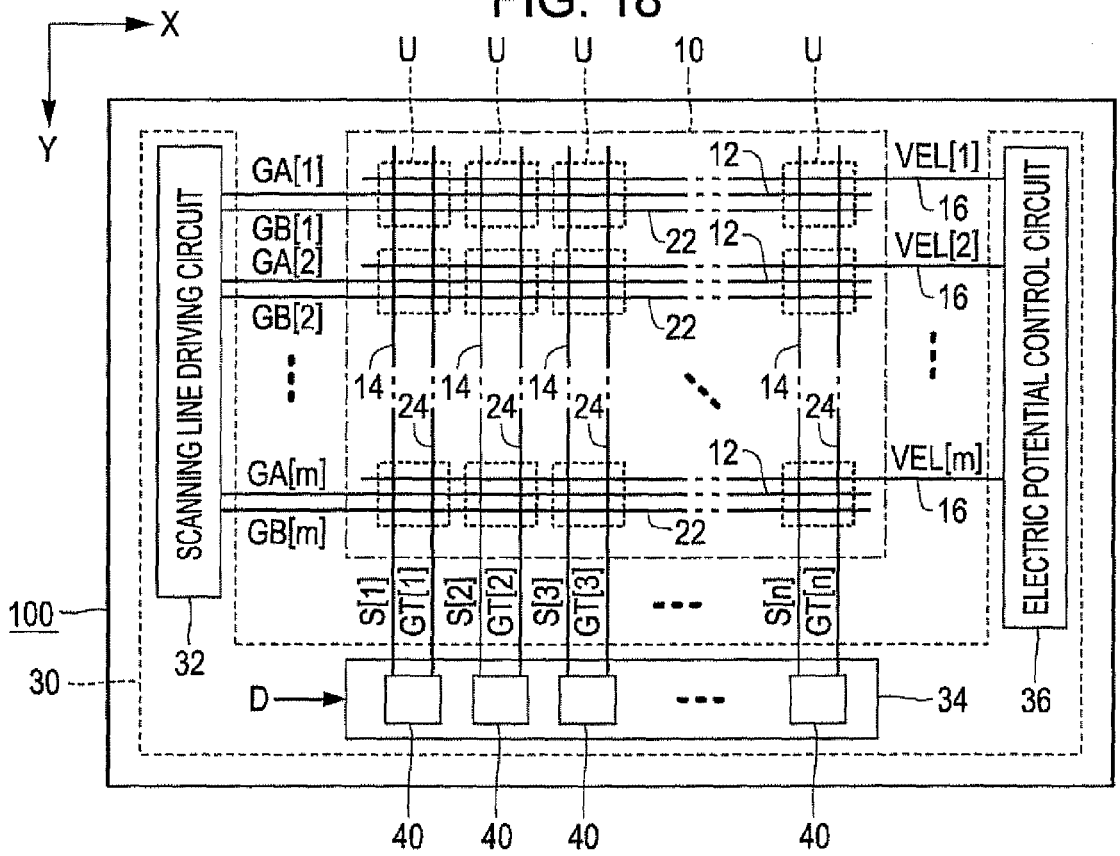
FIG. 18 is a block diagram showing a light emitting device according to a fifth embodiment of the invention.

FIG. 18 is a block diagram showing a light emitting device according to a fifth embodiment of the invention. In a component unit 10, m feed lines 16 and m control lines 22 that extend in the X direction together with scanning lines 12 and n control lines 24 that extend in the Y direction together with signal lines 14 are formed, which is different from each of the above-described embodiment.

The scanning line driving circuit 32 outputs scanning signals GA[1] to GA[m] to the scanning lines 12 and outputs control signals GB[1] to GB[m] to the control lines 22. Here, a configuration in which the scanning signals GA[1] to GA[m] and the control lines GB[1] to GB[m] are generated by different circuits may be employed.

The signal line driving circuit 34 outputs signals S[1] to S[n] to the signal lines 14 and outputs control signals GT[1] to GT[n] to the control lines 24. In addition, a unit circuit 40 of the j-th column (here, j=1 to n) generates a signal S[j] and a control signal GT[j] and outputs the signals to the signal line 14 and the control line 24 of the j-th column. Here, a configuration in which the signals S[1] to S[n] and the control signals GT[1] to GT[n] are generated by different circuits may be used.

Figure 19:
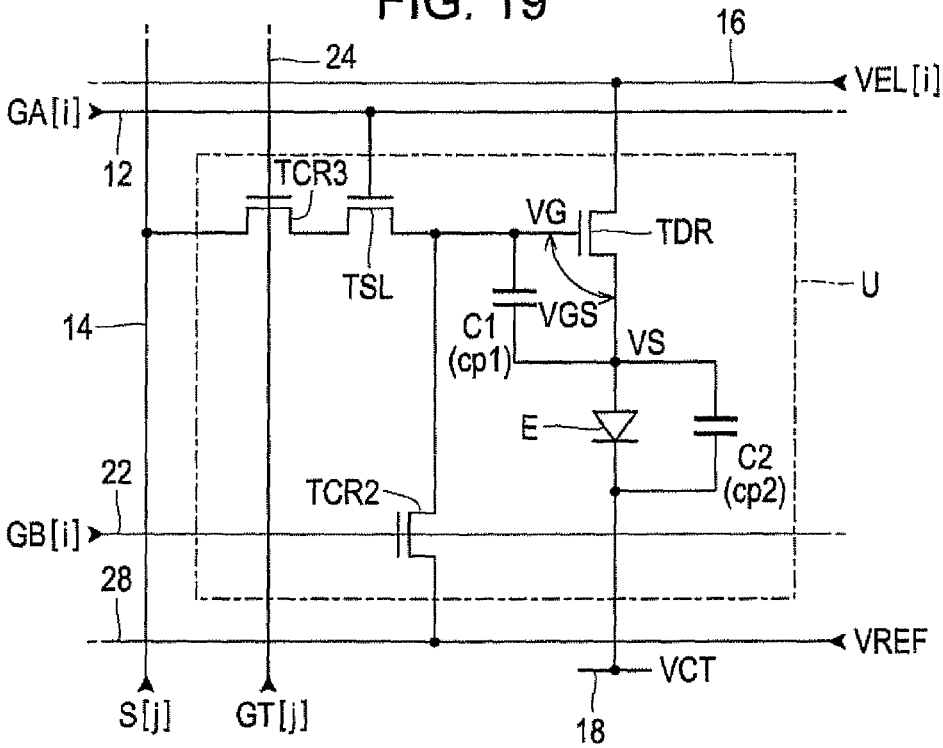
FIG. 19 is a circuit diagram showing a pixel circuit according to the fifth embodiment.

FIG. 19 is a circuit diagram of a pixel circuit U according to this embodiment. In FIG. 19, only one pixel circuit U of the j-th column that belongs to the i-th row (i=1 to m) is representatively shown. As shown in FIG. 19, the pixel circuit U includes a light emitting element E, a driving transistor TDR, a storage capacitor C1, a selection switch TSL, a control switch TCR3, and a control switch TCR2. The switches (the selection switch TSL, the control switch TCR3, and the control switch TCR2) within the pixel circuit U, for example, are N-channel transistors (for example, thin film transistors).

The selection switch TSL and the control switch TCR3 are connected in series between the signal line 14 and the gate of the driving transistor TDR. The selection switch TSL and the control switch TCR3 control electrical connection (conduction or non-conduction) between the signal line 14 and the gate of the driving transistor TDR. The gates of the selection switches TSL of the pixel circuits U belonging to the i-th row are commonly connected to the scanning line 12 of the i-th row, and the gates of the control switches TCR3 of the pixel circuits U belonging to the j-th column are commonly connected to the control line 24 of the j-th column. In addition, as shown in FIG. 19, the selection switch TSL is disposed on the driving transistor TDR side, and the control switch TCR3 is disposed on the signal line 14 side. However, a configuration in which the selection switch TSL is disposed on the signal line 14 side, and the control switch TCR3 is disposed on the driving transistor TDR side may be employed.

The control switch TCR2 is interposed between the gate of the driving transistor TDR and a feed line 28. The control switch TCR2 controls electrical connection between the gate of the driving transistor TDR and the feed line 28.

To the feed line 28, a reference electric potential VREF is supplied. The feed line 28, for example, is a wiring that extends in the X direction for each row of the pixel circuit U (or a wiring that extends in the Y direction for each column) as shown in FIG. 19 or a wiring that is continuous over the pixel circuits U within the component unit 10. The gates of the control switches TCR2 of the pixel circuits U belonging to the i-th row are commonly connected to the control line 22 of the i-th row.

Next, the operation (a method of driving the pixel circuit U) of the driving circuit 30 will be described with reference to FIG. 20 with focusing on the pixel circuit U of the j-th column belonging to the i-th row. The scanning line driving circuit 32 sequentially selects each pixel circuit U in units of rows by sequentially setting the scanning signals GA[1] to GA[m] to the active level in a predetermined order. In other words, as shown in FIG. 20, the scanning signal GA[i] is set to an active level (a high level representing selection of the scanning line 12) for the i-th horizontal scanning period H[i] within the vertical scanning period and is maintained at an inactive level (low level) for a period other than the horizontal scanning period H[i] For the horizontal scanning period H[i] in which the scanning line driving circuit 32 selects the i-th row, the signal line driving circuit 34 sets the signal S[j] to the gray scale electric potential VDATA[i] corresponding to the gray scale value D that is designated to the pixel circuit U of the j-th column belonging to the i-th row.

Figure 20:
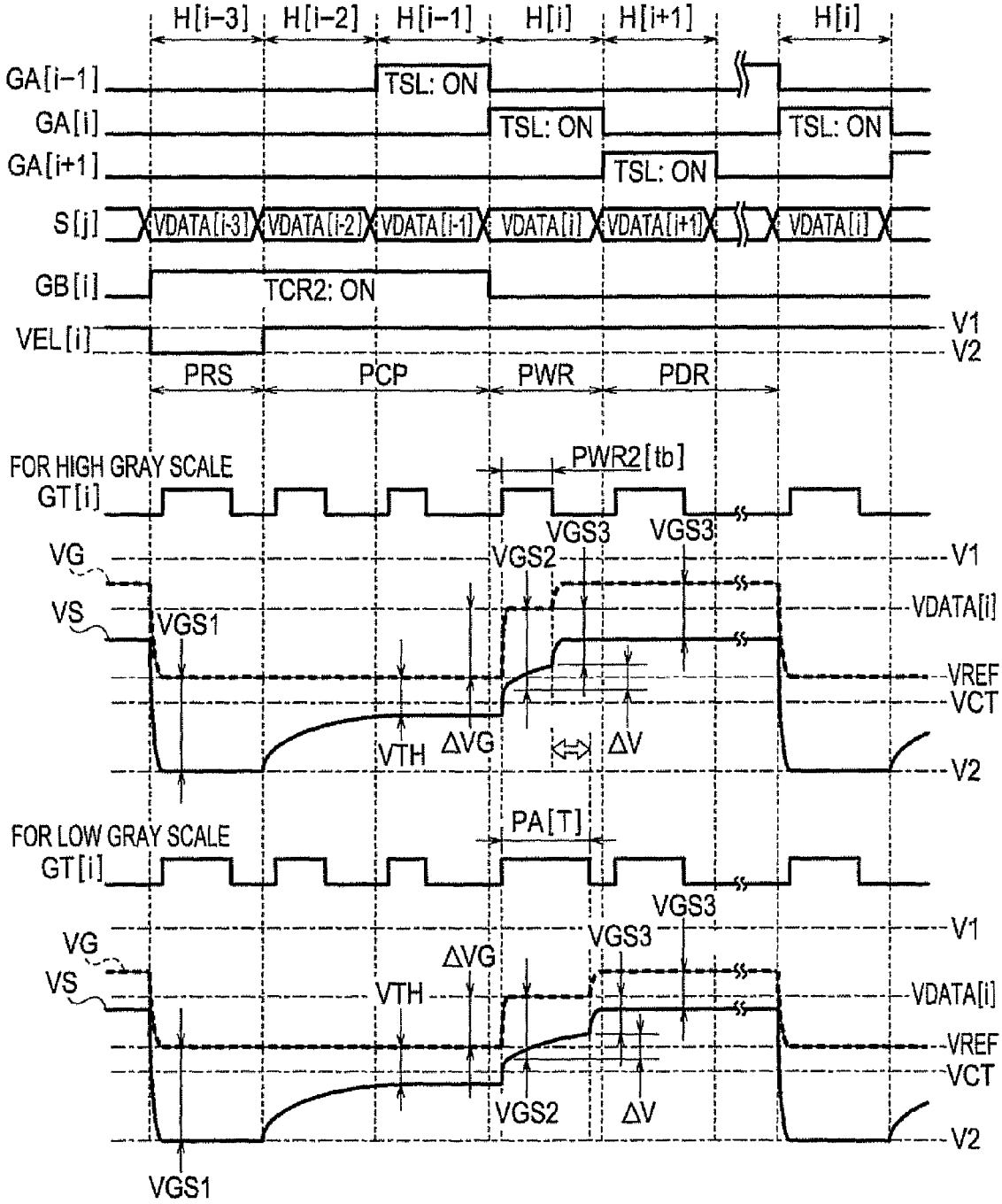
FIG. 20 is a timing chart showing operations of a light emitting device according to the fifth embodiment.

As show in FIG. 20, the horizontal scanning period H[i] is used as a write period PWR for which the gray scale electric potential VDATA[i3] is supplied to each pixel circuit U of the i-th row. In addition, a plurality of horizontal scanning periods (the horizontal scanning period H[i−2] and the horizontal scanning period H[i−1] shown in FIG. 3) before start of the write period PWR (the horizontal scanning period H[i]) of the i-th row is used as the compensation period PCP of the i-th row, and one horizontal scanning period H[i−3] before start of the compensation period PCP is used as the reset period PRS of the i-th row.

The voltage VGS (that is, the voltage between both ends of the storage capacitor C1) between the gate and the source of the driving transistor TDR is reset to a predetermined voltage for the reset period PRS, gradually approaches the threshold voltage VTH of the driving transistor TDR for the compensation period PCP, and is set to a voltage corresponding to the gray scale electric potential VDATA[i] for the write period PWR. For the driving period PDR after elapse of the write period PWR, a driving current IDR according to the voltage VGS of the driving transistor TDR is supplied from the feed line 16 to the light emitting element E through the driving transistor TDR. The light emitting element E emits light with luminance according to the driving current IDR.

As shown in FIG. 20, the scanning line driving circuit 32 sets the control signal GB[i] to the active level (the high level) for the reset period PRS of the i-th row and the compensation period PCP (the horizontal scanning period H[i−3] to H[i−1]) and maintains the control signal GB[i] to the inactive level (the low level) in other periods. The electric potential control circuit 36 sets the electric potential VEL[i] to the electric potential V2 for the reset period PRS of the i-th row and maintains the electric potential VEL[i] at the electric potential V1 in a period other than the reset period PRS.

As shown in FIG. 20, an operation period PWR2 is set over a temporal length tb from a time point delayed by a predetermined time from the start point of the write period PWR within each write period PWR (each of horizontal scanning periods H[1] to H[m]). The operation period PWR2 is a period for which the gray scale electric potential VDATA[i] is actually supplied to the pixel circuit U. As shown in FIG. 20, the signal line driving circuit 34 sets the control signal GT[j] to the active level (the high level) for the operation period PWR2 within each write period PWR and maintains the control signal GT[j] at the inactive level (the low level) for a period other than the operation period PWR2 within each write period PWR.

Next, a detailed operation of the pixel circuit U will be described separately for the reset period PRS, the compensation period PCP, the write period PWR, and the driving period PDR. In addition, hereinafter, the operation will be described with focusing on the pixel circuit U of the j-th column belonging to the i-th row. However, the same operation is performed for each pixel circuit U within the component unit 10.

Figure 21:
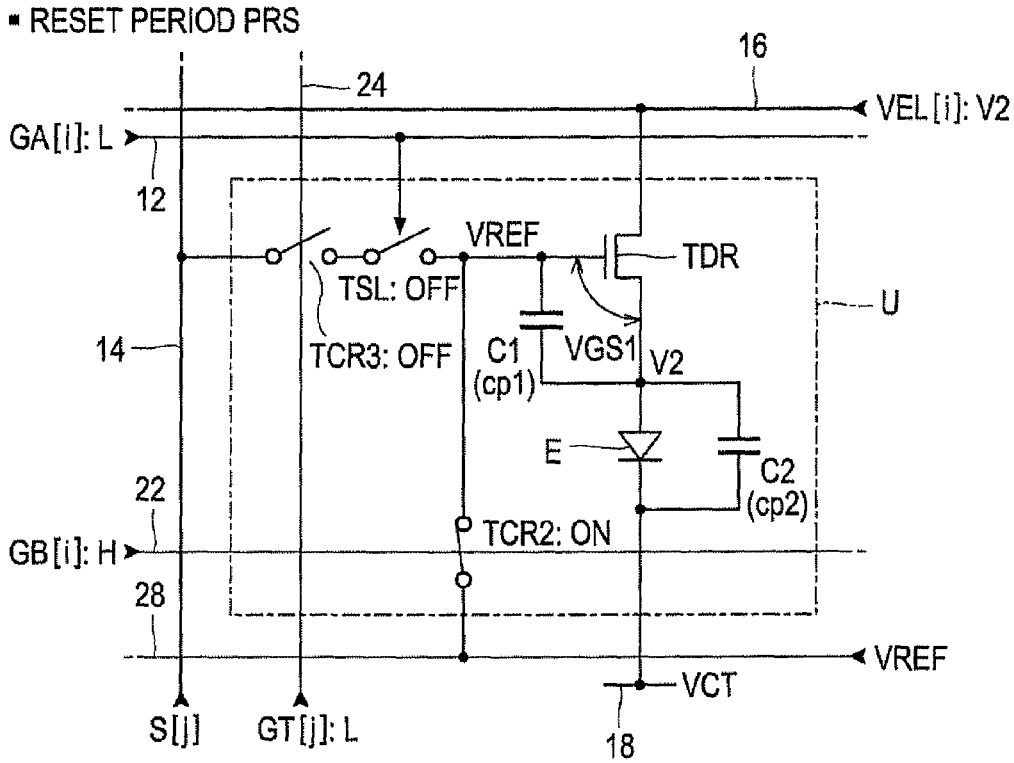
FIG. 21 is a circuit diagram showing the state of the pixel circuit for a reset period.

[1] Reset Period PRS (FIG. 21)

As shown in FIGS. 20 and 21, for the reset period PRS of the i-th row (the horizontal scanning period H[i−3]), the control signal GB[i] is set to the active level, and thereby the control switch TCR2 is controlled to be in the ON state. Since the selection switch TSL and the control switch TCR3 are maintained to be in the OFF state, the electric potential VG of the gate of the driving transistor TDR is set as the reference electric potential VREF of the feed line 28 through the control switch TCR2. On the other hand, the electric potential control circuit 36 supplies the electric potential V2 (the electric potential VEL[i]) to the feed line 16, and thereby the electric potential VS of the source of the driving transistor TDR is set to the electric potential V2. In other words, the voltage VGS (the voltage between both ends of the storage capacitor C1) between the gate and the source of the driving transistor TDR is reset to a difference voltage VGS1 (VGS1=VREF−V2) between the reference electric potential VREF and the electric potential V2.

The reference electric potential VREF and the electric potential V2 are set such that a difference voltage VGS1 between the reference electric potential VREF and the electric potential V2 is sufficiently higher than the threshold voltage VTH of the driving transistor TDR, and a voltage (V−VCT) between both ends of the light emitting element E is sufficiently lower than the threshold voltage VTH_OLED of the light emitting element E. Therefore, for the reset period PRS, the driving transistor TDR is in the ON state, and the light emitting element E is in the OFF state (non-emitting state).

Figure 22:
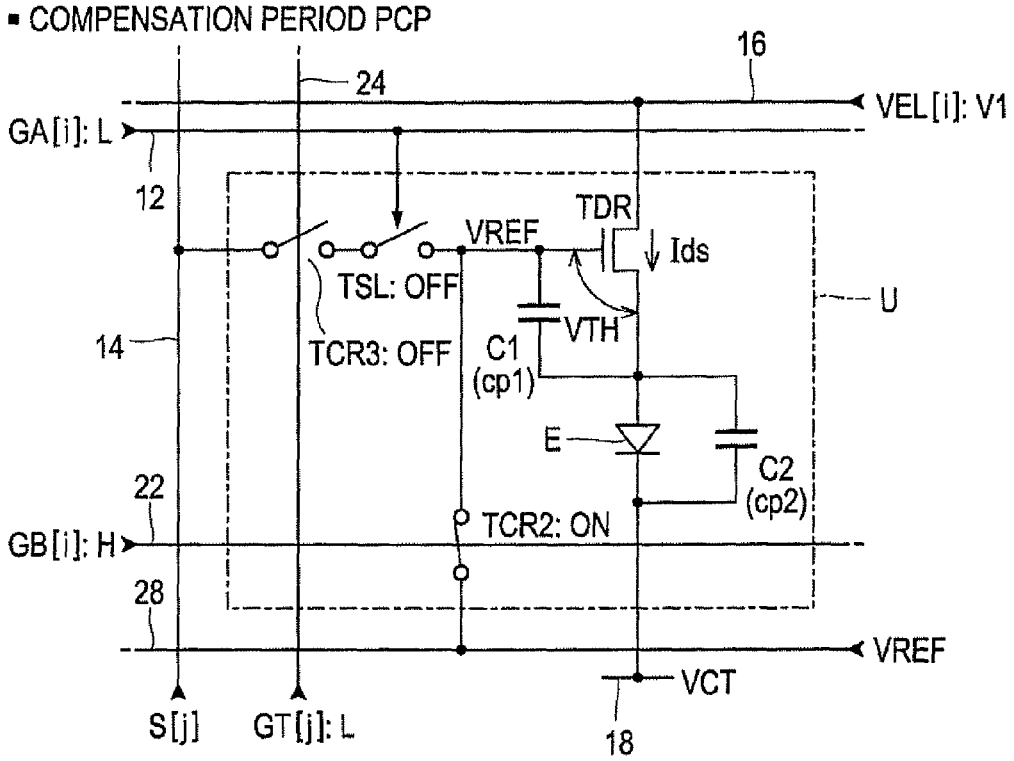
FIG. 22 is a circuit diagram showing the appearance of a pixel circuit for a compensation period.

[2] Compensation Period PCP (FIG. 22)

As shown in FIGS. 20 and 22, when the compensation period PCP is started, the electric potential control circuit 36 changes the electric potential VEL[i] of the feed line 16 (that is, the electric potential of the drain of the driving transistor TDR) to the electric potential V1. As shown in FIG. 20, the electric potential V1 is sufficiently higher than the electric potential V2 or the reference electric potential VREF. On the other hand, the control switch TCR2 is controlled to be in the ON state continuously from the reset period PRS. Since the driving transistor TDR is transited to the ON state for the reset period PRS, under the above-described state, as shown in FIG. 22, the current Ids represented in the above-described Equation (3) flows between the drain and the source of the driving transistor TDR.

As the current Ids flows from the feed line 16 through the driving transistor TDR electric charges are charged in the storage capacitor C1 and the capacitor C2. Accordingly, as shown in FIG. 20, the electric potential VS of the source of the driving transistor TDR rises slowly. Since the electric potential VG of the gate of the driving transistor TDR is maintained at the reference electric potential VREF of the feed line 28, the voltage VGS between the gate and the source of the driving transistor TDR decreases with the rise of the electric potential VS of the source. As can be known from Equation (3), as the voltage VGS decreases so as to approach the threshold voltage VTH, the current Ids decreases. Thus, an operation (hereinafter, referred to as a "first compensation operation") for having the voltage VGS of the driving transistor TDR gradually approach the threshold voltage VTH from the voltage VGS1 (VGS1=VREF−V2) that is set in the reset period PRS is performed for the compensation period PCP. The temporal length (the number of the horizontal scanning periods H) of the compensation period PCP, as shown in FIGS. 20 and 22, is set such that the voltage VGS of the driving transistor TDR sufficiently approaches (ideally, coincides with) the threshold voltage VTH at the end point of the compensation period PCP. Accordingly, the driving transistor TDR is mostly in the OFF state at the end point of the compensation period PCP.

Figure 23:
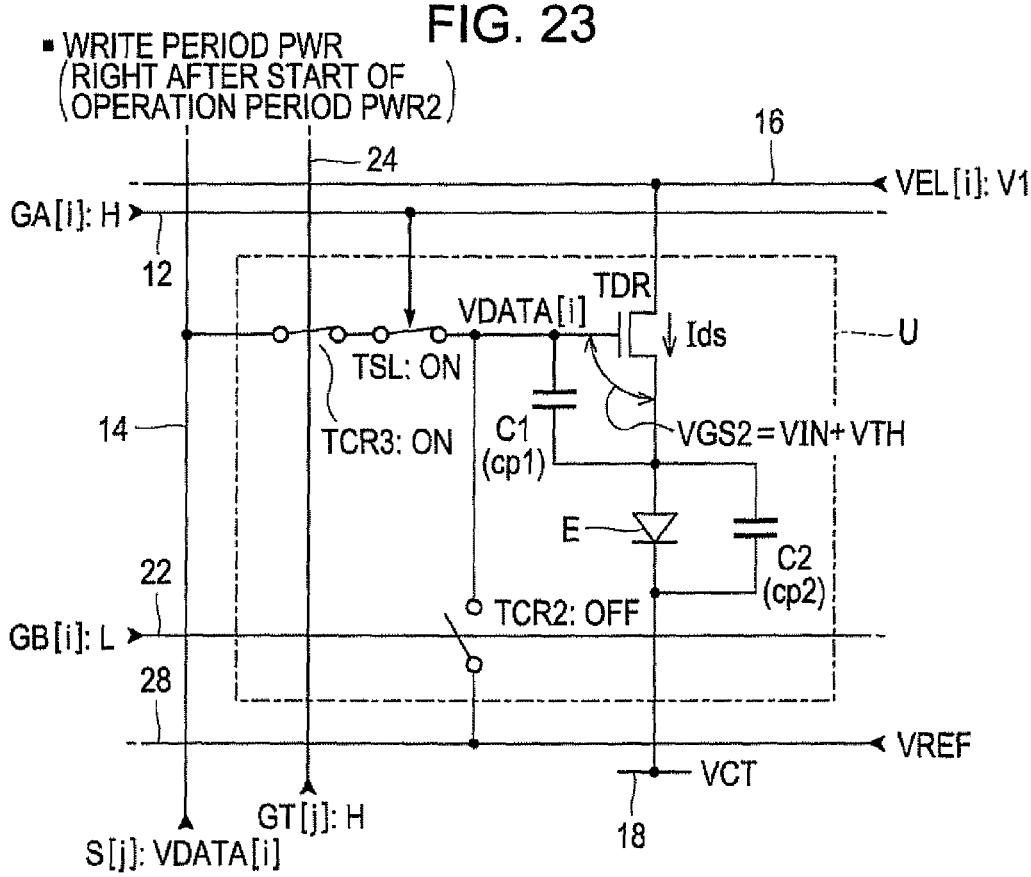
FIG. 23 is a circuit diagram showing the appearance of a pixel circuit right after the start of an operation period within a write period.

[3] Write Period PWR (FIG. 23)

As shown in FIG. 20, when the write period PWR (the horizontal scanning period H[i]) of the i-th row is started, the control signal GB[i] is set to the non-active level, and accordingly, the control switch TCR2 is transited to the OFF state. In other words, supply of the reference electric potential VREF to the gate of the driving transistor TDR is stopped. In addition, for the write period PWR of the i-th row, the signal S[j] supplied to the signal line 14 is set to the gray scale electric potential VDATA[i], and the scanning signal GA[i] is changed to the active level, whereby the selection switch TSL is controlled to be in the ON state. However, before start of the operation period PWR2 within the write period PWR, the control signal GT[j] is set to the inactive level, and accordingly, the control switch TCR3 is maintained to be in the OFF state (in other words, the gate of the driving transistor TDR is not conductive to the signal line 14), whereby the gray scale electric potential VDATA[i] of the signal S[j] is not supplied to the gate of the driving transistor TDR.

As shown in FIGS. 20 and 23, when the operation period PWR2 is started, the control signal GT[j] is set to the active level, and whereby the control switch TCR3 is changed to be in the ON state. In other words, the gate of the driving transistor TDR is conductive to the signal line 14 through the selection switch TSL and the control switch TCR3. Accordingly, the electric potential VG of the gate of the driving transistor TDR is changed from the reference electric potential VREF before the start of the operation period PWR2 to the gray scale electric potential VDATA. The storage capacitor C1 is interposed between the gate and the source of the driving transistor TDR, and accordingly, as shown in FIG. 20, the electric potential VS of the source of the driving transistor TDR changes (rises) in association with the electric potential VG of the gate. The amount of change of the electric potential VS right after the start of the operation period PWR2 corresponds to a voltage (ΔVDATA·cp1/(cp1+cp2)) that is acquired by dividing the amount of change ΔVDATA (ΔVDATA=VDATA−VREF) of the electric potential VG in accordance with the ratio of capacitance values of the storage capacitor C1 and the capacitor C2. Accordingly, the voltage VGS2 between the gate and the source of the driving transistor TDR (both ends of the storage capacitor C1) right after the start of the operation period PWR2, as shown in FIG. 23, can be represented in a same form as Equation (4).

As described above, as the voltage VGS2 between the gate and the source is set to a voltage value above the threshold voltage VTH in accordance with the gray scale electric potential VDATA (described in more details, a difference ΔVDATA between the gray scale electric potential VDATA and the reference electric potential VREF), the driving transistor TDR is transited to be in the ON state. Accordingly, the current Ids flows between the drain and the source of the driving transistor TDR.

The electric potential VS of the source of the driving transistor TDR (the voltage between both ends of the capacitor C2) slowly rises in accordance with charging the storage capacitor C1 and the capacitor C2 by the current Ids. On the other hand, the electric potential VG of the gate of the driving transistor TDR is maintained at the gray scale electric potential VDATA in the operation period PA. Accordingly, the voltage VGS between the gate and the source of the driving transistor TDR decreases from the voltage VGS2 right after the start of the operation period PWR2 in accordance with the rise of the electric potential VS. As the voltage VGS approaches the threshold voltage VTH, the current Ids decreases. Accordingly, an operation (hereinafter, referred to as a "second compensation operation") for having the voltage VGS of the driving transistor TDR gradually approach the threshold voltage VTH from the voltage VGS2, which is set by supply of the gray scale electric potential VDATA, is performed in the operation period PWR2 of the write period PWR, similarly to the compensation period PCP. Accordingly, as shown in FIG. 20, the voltage VGS at the end point of the operation period PWR2 is set to a voltage VGS3 that is lower than the voltage VGS2 by the voltage ΔV. The voltage VGS3 is represented in the same form as the above-described Equation (5), and the voltage ΔV shown in Equation (5) corresponds to the amount of change of the electric potential VS of the source of the driving transistor TDR that is made by the second compensation operation.

The temporal length tb of the operation period PWR2 within the write period PWR (the horizontal scanning period H[i]) of the i-th row, in which the control signal GT[j] is set to the active level, is set to be changed in accordance with the gray scale value D (the gray scale electric potential VDATA [i]) of the pixel circuit U of the j-th column belonging to the i-th row. In other words, as shown in FIG. 20, the temporal length tb of a case where the gray scale value D designates the high gray scale (high luminance) is shorter than the temporal length tb of a case where the gray scale value D designates the low gray scale (low luminance). A temporal length from the start point of the operation period PWR2 to the time when the driving transistor TDR is changed to be in the ON state is sufficiently short, and accordingly, the temporal length T of the operation period PWR2 corresponds to a temporal length in which the second compensation operation is performed. In addition, considering that the above-described voltage ΔV depends on the temporal length tb of the operation period PWR2, the operation for controlling the temporal length tb of the operation period PWR2 in accordance with the gray scale value D may be also perceived as an operation for controlling the voltage VGS3 (the voltage ΔV) to be changed in accordance with the gray scale value D.

The temporal length tb of the operation period PWR2 is set within the range in which the voltage VGS3 between the gate and the source of the driving transistor TDR at the end point of the operation period PWR2 is a voltage that is equivalent to the threshold voltage VTH (for a case where the gray scale value D designates a minimum gray scale) or a voltage that is higher than the threshold voltage VTH. In other words, in a case where the gray scale value D designates a gray scale other than the minimum gray scale, the driving transistor TDR is maintained to be in the ON state at the end point of the operation period PWR2. In addition, a detailed method of setting the temporal length tb is the same as that of the above-described first embodiment.

Figure 24:
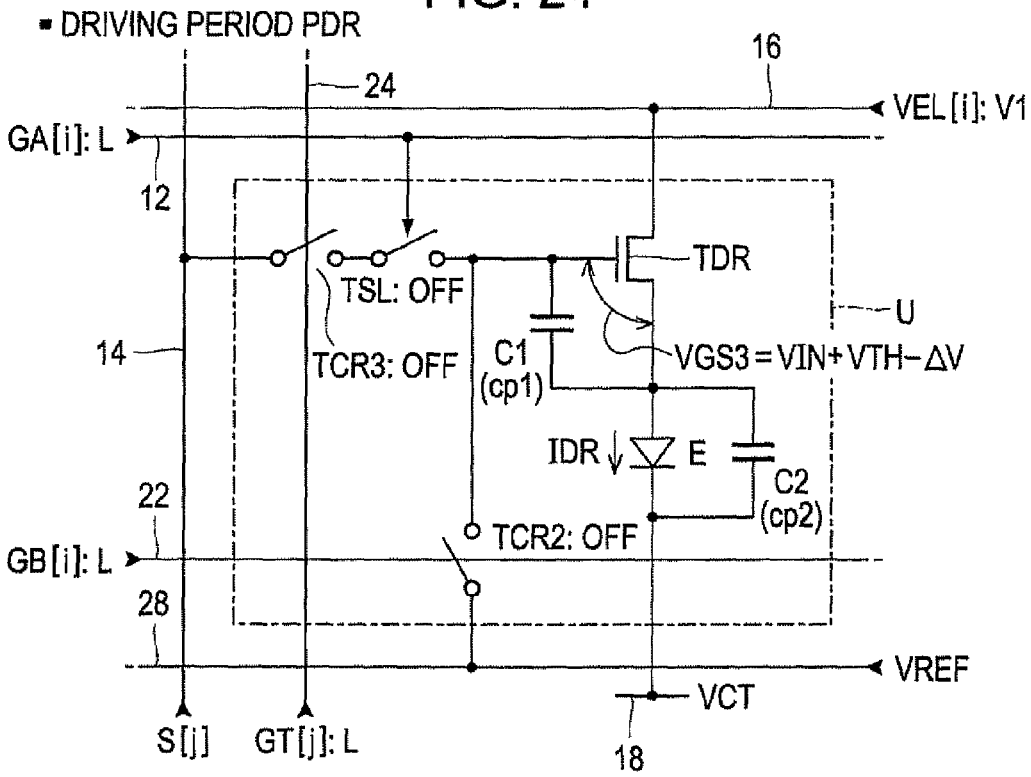
FIG. 24 is a circuit diagram showing the appearance of a pixel circuit for a driving period.

[4] Driving Period PDR (FIG. 24)

When the operation period PWR2 within the write period PWR ends, the control signal GT[i] is changed to the inactive level, and accordingly, the control switch TCR3 is transited to the OFF state. Accordingly, the gate of the driving transistor TDR is disconnected from the signal line 14 so as to be in an electrically-floating state. In other words, the supply of the electric potential to the gate of the driving transistor TDR is stopped. When the driving transistor TDR is in the ON state (that is, the gray scale value D designates a gray scale other than the lowest gray scale) at the end point of the operation period PWR2, the current Ids shown in Equation (3) continues to flow between the drain and the source of the driving transistor TDR after the elapse of the operation period PWR2, whereby the capacitor C2 is charged. Accordingly, as shown in FIG. 20, the voltage (the electric potential VS of the source of the driving transistor TDR) between both ends of the capacitor C2 is increased slowly while the voltage VGS of the driving transistor TDR is maintained at the voltage VGS3 that is a voltage at the end point of the operation period PWR2. Then, when the voltage between both ends of the capacitor C2 reaches the threshold voltage VTH_OLED of the light emitting element E, the current Ids flows through the light emitting element E as the driving current IDR. The driving current IDR can be represented in the same form as the above-described Equation (6).

The supply of the driving current IDR to the light emitting element E is started from a time point when the voltage between both ends of the capacitor C2 reaches the threshold voltage VTH_OLED of the light emitting element E, is continued over a time after the start of the driving period PDR, and ends at the start point of the horizontal scanning period H[i] in which the scanning signal GA[i] becomes the active level next time. As described above, since the driving current IDR depends on the voltage VGS3 on which the gray scale electric potential VDATA[i] is reflected, the light emitting element E emits light with luminance according to the gray scale electric potential VDATA[i] (that is, the gray scale value D).

In FIG. 20, a case where the time point when the voltage of both ends of the capacitor C2 reaches the threshold voltage VTH_OLED of the light emitting element E (that is, a time point when the rise of the electric potential VG of the gate of the driving transistor TDR and the electric potential VS of the source is stopped) is within the write period PWR has been described as an example. However, there are cases where the voltage between both ends of the capacitor C2 reaches the threshold voltage VTH_OLED after the start of the driving period PDR depending on the temporal length from the end point of the operation period PWR2 to the end point of the write period PWR or the voltage VGS3 at the end point of the operation period PWR2.

Also in this embodiment, as in each of the above-described embodiments, even when there is error in the threshold voltage VTH of the driving transistor TDR of each pixel circuit U, the driving current IDR is set to a target value corresponding to the gray scale electric potential VDATA In other words, the error in the driving current IDR due to the threshold voltage VTH of the driving transistor TDR of each pixel circuit U is compensated by performing the first compensation operation for the compensation period PCP.

As described with reference to FIG. 20, the operation period PWR2 within the write period PWR ends as the control switch TCR3 is changed to be in the OFF state from the ON state. Thus, each unit circuit 40 of the signal line driving circuit 34 sets the temporal length tb of the operation period PWR2 to be changeable by adjusting the time point when the control signal GT[j] is changed from the active level to the inactive level within each write period PWR in accordance with the gray scale value D. Accordingly, as a circuit of the unit circuit 40 that generates the control signal GT[j], a counting circuit that starts counting together with transiting the control signal GT[j] to the inactive level at the start point of the operation period PWR2 and transits the control signal GT[i] to the inactive level at a time point when the counting value reaches a number corresponding to the gray scale value D (a time point when a temporal length T elapses from the start of the counting) is appropriately used.

Figure 25:
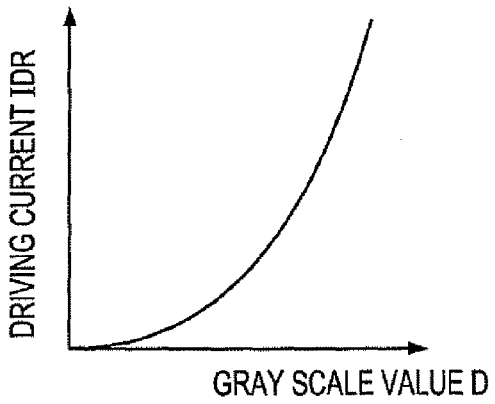
FIG. 25 is a graph showing the correlation between a gray scale value and a driving current.

FIG. 25 is a graph showing the relationship between the gray scale value D and the driving current IDR in a case where the temporal length tb of the operation period PWR2 is set as shown in FIG. 10. By setting the temporal length tb such that a value acquired by multiplying the gray scale electric potential VDATA by the temporal length tb becomes a predetermined value, the driving current IDR (or the luminance of the light emitting element E) is adjusted to have the amount of current corresponding to a value acquired by multiplying the gray scale value D by "2.2". In other words, there is an advantage that the gamma characteristic for a gamma value of "2.2" is implemented by setting the temporal length tb.

In addition, the current Ids (driving current IDR) at the time when the above-described Equation (11) is satisfied can be represented by the following Equation (13). In other words, the current Ids depends on the capacitance value C (C=cp1+cp2), the voltage VIN, and the temporal length tb.

$$Ids = C \cdot VIN / 4tb \qquad \text{Equation (13)}$$

Accordingly, in order to acquire a sufficient amount of current for the driving current IDR to the degree for which an image displayed in the component unit 10 has desired brightness, an increase in the capacitance value C or the voltage VIN or a decrease in the temporal length tb is needed. However, in order to increase the capacitance value C, the area of the storage capacitor C1 needs to be increased. Thus, in such a case, there is a problem that disposition (layout) of other elements of the pixel circuit U is limited. In addition, in order to increase the voltage VIN, the amplitude of the electric potential of the gate of the selection switch TSL needs to be increased. Thus, in such a case, high-voltage resistance of the scanning line driving circuit 32 is needed. According to this embodiment, the driving current Ids is adjusted in accordance with the temporal length tb of the operation period PWR2, and accordingly, there is an advantage that such a problem occurring for the case where the capacitance value C or the voltage VIN is increased does not occur.

When the load (the number of the pixel circuits U) that is associated with the control line 24 for supplying the control signal GT[j] is high, distortion of the waveform of the control signal GT[j] is exposed. Thus, when the pulse width (the temporal length T) of the control signal GT[j] is short, in particular, there is a problem that the accuracy of the temporal length tb of the operation period PWR2 is decreased. On the other hand, under a configuration in which the pixel circuits U, for example, corresponding to each of a plurality of colors (for example, a red color, a green color, and a blue color) are arranged in the X direction, frequently, the number n of columns (the total number of the signal lines 14) of the pixel circuit U of the component unit 10 is larger than the number m of rows (the total number of the scanning lines 12). In this embodiment in which the control line 24, together with the signal line 14, extends in the Y direction, the total number m of the pixel circuits U that become the load of one control line 24 is smaller than the total number n of the pixel circuits U within one row. Accordingly, the load of the control line 24 is decreased, for example, compared to a configuration in which n pixel circuits U arranged in the x direction commonly use one control line 24. As a result, there is also an advantage that the desired driving current IDR can be generated by sufficiently shortening the pulse width (the temporal length T) of the control signal GT[j] while suppressing a decrease in the accuracy (distortion of the waveform of the control signal GT[j]) for adjusting the temporal length tb of the operation period PWR2.

As a configuration in which the reference electric potential VREF is supplied to each pixel circuit U for resetting the voltage VGS of the driving transistor TDR or performing the first compensation operation, a configuration in which the selection switch TSL is controlled to be in the ON state for the reset period PRS and the compensation period PCP, and the reference electric potential VREF is supplied to each pixel circuit U as the signal S[j] of the signal line 14 may be considered. However, in a configuration in which one signal line 14 is commonly used for the supply of the gray scale electric potential VDATA and the supply of the reference electric potential VREF as described above, resetting the voltage VGS or the first compensation operation needs to be performed for the horizontal scanning period H[i] in which the selection switch TSL is controlled to be in the ON state.

Accordingly, in order to have the voltage VGS between the gate and the source of the driving transistor TDR to assuredly reach the threshold voltage VTH by performing the first compensation operation, the temporal length of the horizontal scanning period H[i] needs to be sufficiently acquired. However, as the horizontal scanning period H[i] is lengthened, an increase in the precision (an increase in the number of the rows) of the pixel circuit U is restricted.

According to this embodiment, the reference electric potential VREF is supplied to each pixel circuit U from the feed line 28 other than the signal line 14, and accordingly, the first compensation operation can be performed regardless of the temporal length of one horizontal scanning period H. For example, as shown in FIG. 20, a plurality of the horizontal scanning periods H is acquired for the first compensation operation. As a result, there is an advantage that reliability of the first compensation operation (the certainty that the voltage VGS reaches the threshold voltage VTH) and shortening the horizontal scanning period H (or an increase in the precision of the pixel circuits U) can be simultaneously acquired.

F: Sixth Embodiment

Figure 26:
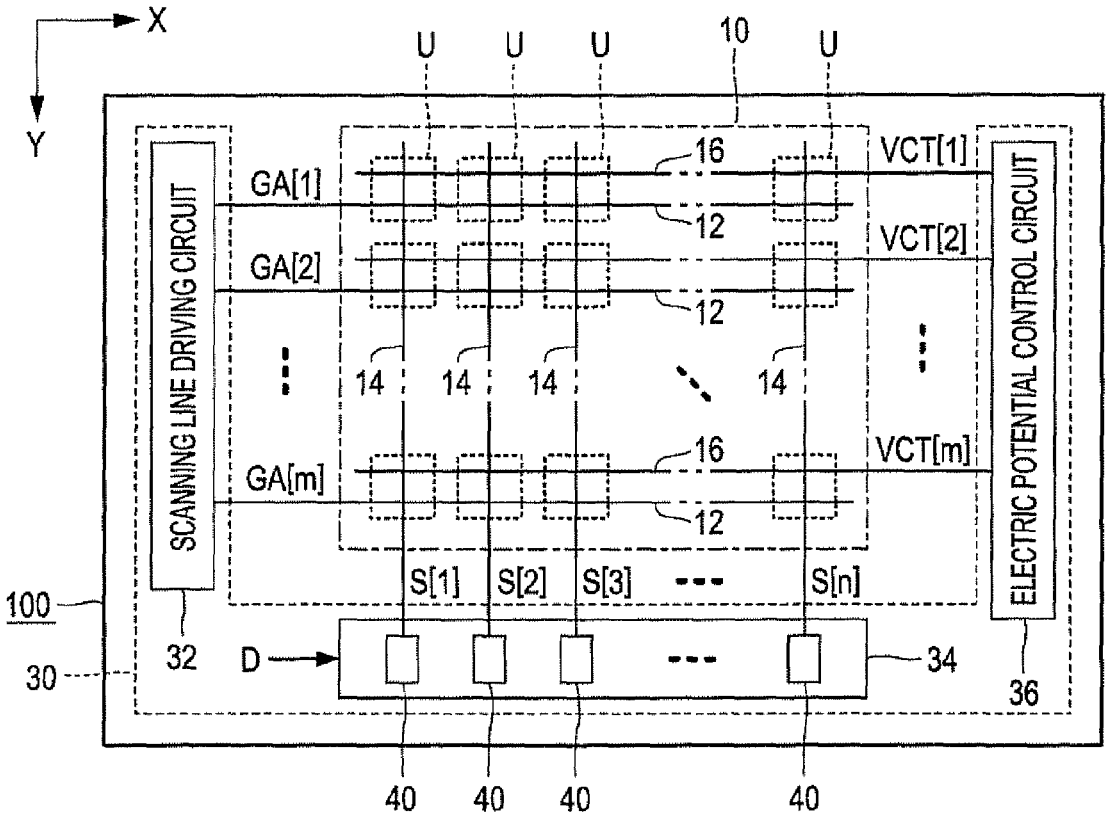
FIG. 26 is a block diagram of a light emitting device according to a sixth embodiment of the invention.

FIG. 26 is a block diagram showing a light emitting device according to a sixth embodiment of the invention, The embodiment is different from the first embodiment in that the electric potential control circuit 36 generates the electric potentials VCT (VCT[1] to VCT[m]) and outputs the electric potentials to each feed line 16.

Figure 27:
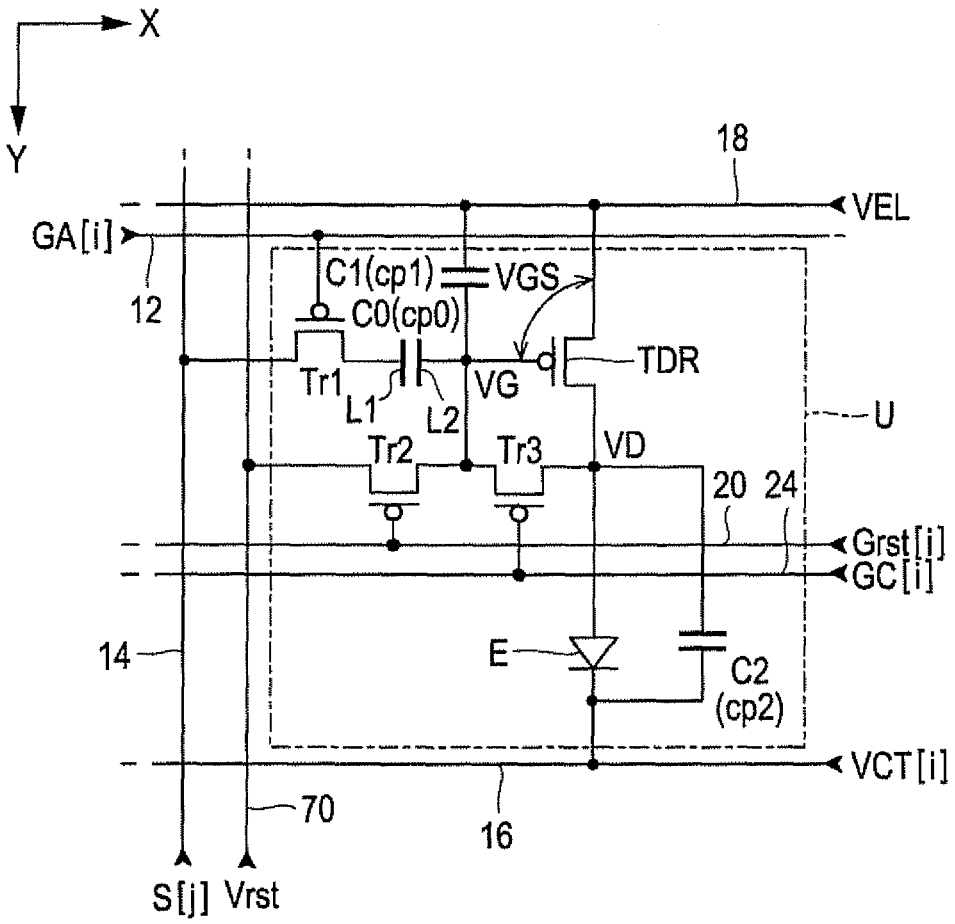
FIG. 27 is a circuit diagram of a pixel circuit according to the sixth embodiment.

FIG. 27 is a circuit diagram showing a pixel circuits U according to the embodiment. In FIG. 27, one pixel circuit U of the j-th column belonging to the i-th row (here, i=1 to m) is representatively shown. As shown in FIG. 27, in the component unit 10, the first and second control lines 20 and 26 extending in the X direction are disposed in one-to-one correspondence with the m scanning lines 12. A predetermined signal is applied from the driving circuit 30 (for example, the scanning line driving circuit 32) to each of the first and second control lines 20 and 26. More specifically, the reset signal Grst[i] is applied to the first control line 20, and the control signal GC[i] is applied to the second control line 26. In addition, as shown in FIG. 27, in the component unit 10, the reset lines 70 extending in the Y direction are disposed in correspondence with the signal lines 14. The reset electric potential Vrst is applied from a power supply circuit (not shown) to the reset line 70.

As shown in FIG. 27, the pixel circuit U includes a light emitting element E, a driving transistor TDR, a first switching device Tr1, a second switching device Tr2, a third switching device Tr3, a capacitor element C0 (capacitance value cp0), and a storage capacitor C1 (capacitance value cp1). The light emitting element E and the driving transistor TDR are serially connected in a path that connects the feed line 18 and the feed line 16. The feed line 18 is applied with a predetermined electric potential VEL from a power supply circuit (not shown). As shown in FIG. 27, the anode of the light emitting element E is connected to the driving transistor TDR, and the cathode thereof is connected to the feed line 16.

As shown in FIG. 27, the driving transistor TDR is a P-channel transistor (for example, a thin film transistor) of which source is connected to the feed line 18 and of which drain is connected to the anode of the light emitting element E. The capacitor element C0 has a first electrode L1 and a second electrode L2. The second electrode L2 is connected to the gate of the driving transistor TDR. The first switching device Tr1 that is a P-channel transistor is interposed between the first electrode L1 and the signal line 14. The gate of the first switching device Tr1 is connected to the scanning line 12. When the scanning signal GA[i] is transited to the low level, the first switching device Tr1 is in the ON state, so that the first electrode L1 and the signal line 14 are electrically conducted. When the scan signal GA[i] is transited to the high level, the first switching device Tr1 is in the OFF state, so that the first electrode L1 and the signal line 14 are not electrically conducted.

As shown in FIG. 27, the second switching device Tr2 that is a P-channel transistor is interposed between the gate of the driving transistor TDR and the reset line 70. The gate of the second switching device Tr2 is connected to the first control line 20. When the reset signal Grst[i] is transited to the low level, the second switching device Tr2 is in the ON state, so that the gate of the driving transistor TDR and the reset line 70 are electrically conducted. When the reset signal Grst[i] is transited to the high level, the second switching device Tr2 is in the OFF state, so that the gate of the driving transistor TDR and the reset line 70 are not electrically conducted.

As shown in FIG. 27, the third switching device Tr3 that is a P-channel transistor is interposed between the gate and drain of the driving transistor TDR. The gate of the third switching device Tr3 is connected to the second control line 26. When the control signal GC[i] is transited to the low level, the third switching device Tr3 is in the ON state, so that the gate and the drain of the driving transistor TDR are electrically conducted. If the control signal GC[i] is transited to the high level, the third switching device Tr3 is in the OFF state, so that the gate and the drain of the driving transistor TDR are not electrically conducted.

As shown in FIG. 27, the storage capacitor C1 is interposed between the gate and source of the driving transistor TDR. The storage capacitor C1 is an element for maintaining the gate-to-source voltage of the driving transistor TDR. The one electrode of the storage capacitor C1 is connected to the gate of the driving transistor TDR, and the other electrode thereof is connected to the feed line 18.

Figure 28:
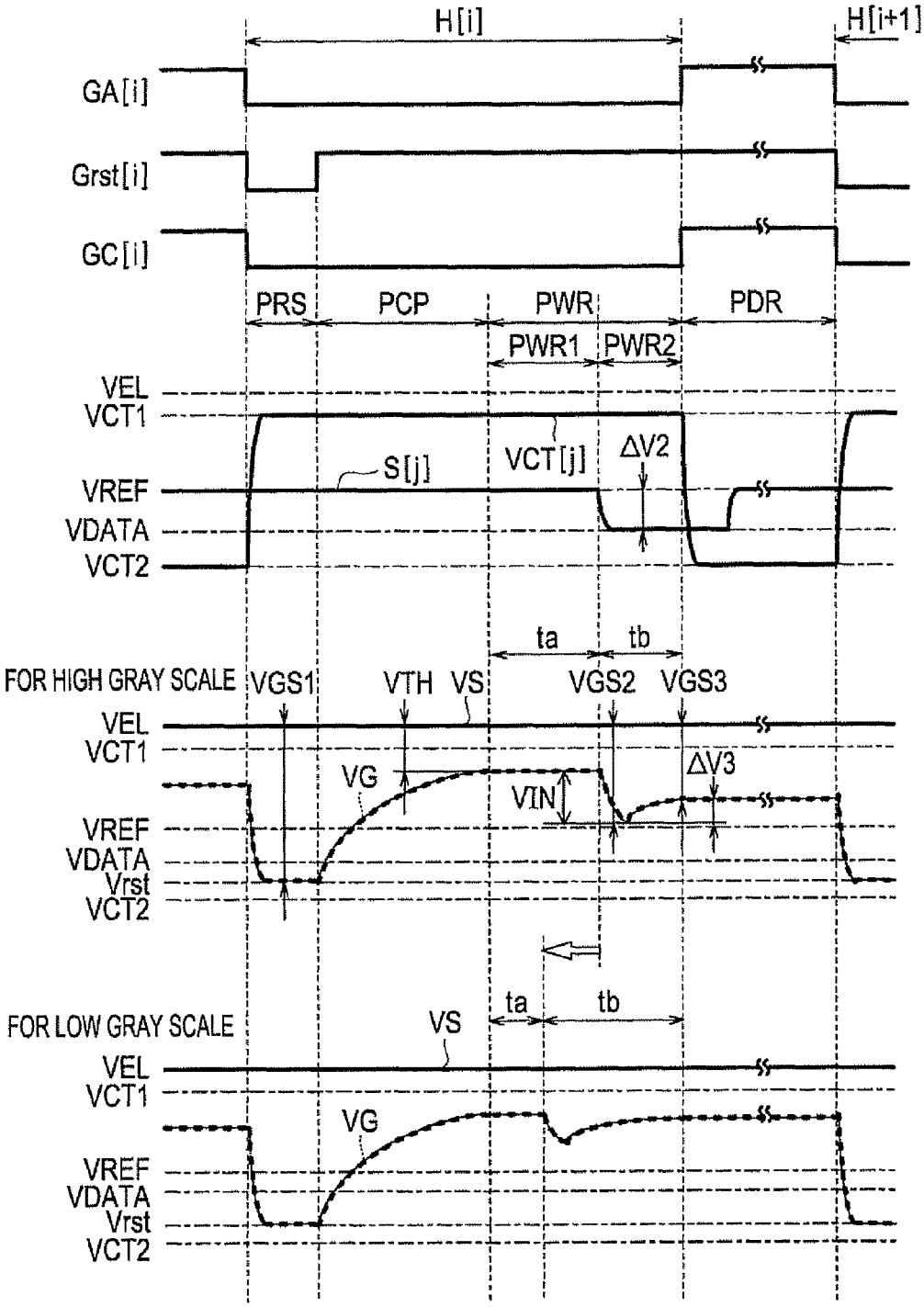
FIG. 28 is a timing chart showing the operation of a light emitting device according to the sixth embodiment.

Next, the operation (a method of driving the pixel circuit U) of the driving circuit 30 will be described with reference to FIG. 28 with focusing on the pixel circuit U positioned in the i-th row and the j-th column. As shown in FIG. 28, the scanning line driving circuit 32 sets the scanning signal GA[i] to the low level in the i-th unit period H[i] within the vertical scanning period. When the scanning signal GA[i] is set to the low level, the first switching elements Tr1 of n pixel circuits U belonging to the i-th row are transited to the ON state simultaneously.

As shown in FIG. 28, the unit period H[i] includes a reset period PRS, a compensation period PCP, and a write period PWR. For the reset period PRS, the driving transistor TDR is in the conductive state by resetting the electric potential VG of the gate of the driving transistor TDR. For the compensation period PCP after the elapse of the reset period PRS, the voltage VGS between the gate and the source of the driving transistor TDR gradually approaches the threshold voltage VTH of the driving transistor TDR by performing diode-connection of the driving transistor TDR. For the write period PWR after the elapse of the compensation period PCP, the voltage VGS of the driving transistor TDR is changed from the voltage set for the compensation period PCs to a voltage according to the gray scale value D that is designated to the pixel circuit U and is controlled to gradually approach the threshold voltage VTH of the driving transistor TDR. For the driving period PDR after the elapse of the write period PWR, a driving current IDR according to the voltage VGS of the driving transistor TDR is supplied to the light emitting element E. The light emitting element E emits light with luminance according to the driving current IDR.

Hereinafter, a detailed operation of the pixel circuit U will be described separately for the reset period PRS, the compensation period PCP, the write period PWR, and the driving period PDR.

Figure 29:
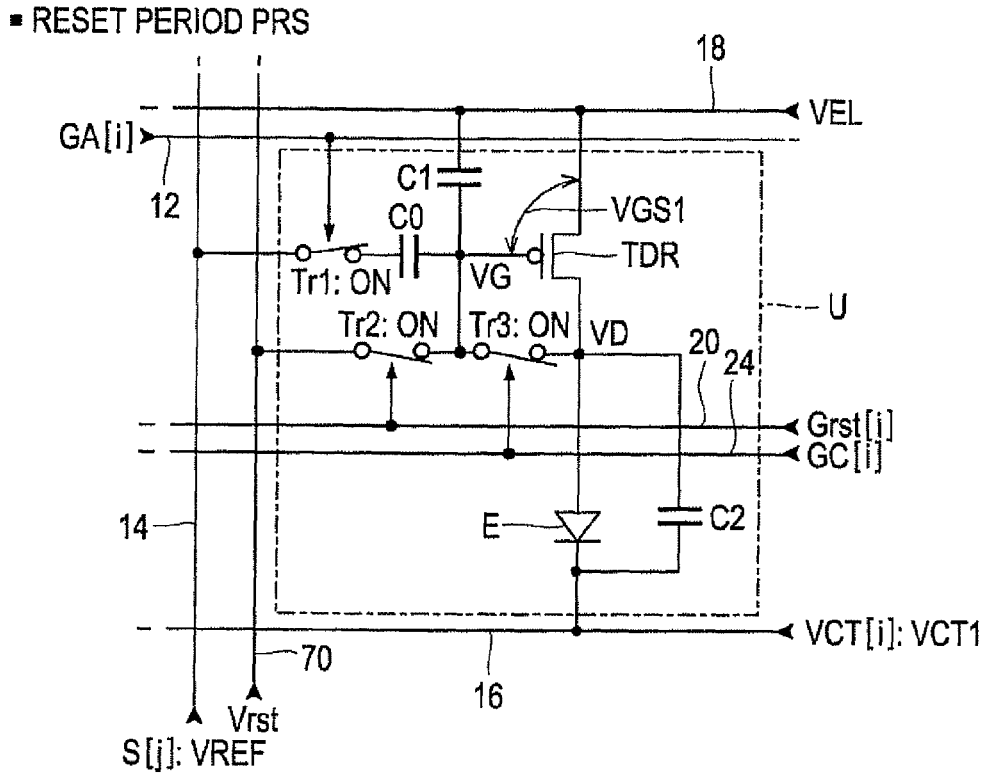
FIG. 29 is a circuit diagram showing the appearance of a pixel circuit for a reset period.

[1] Reset period PRS (FIG. 29)

As shown in FIG. 28, the driving circuit 30 (for example, the scanning line driving circuit 32) sets the reset signal Grst[i] to the low level. Therefore, as shown in FIG. 29, the second switching device Tr2 is transited to be in the ON state, and the gate of the driving transistor TDR is electrically connected to the reset line 70 through the second switching device Tr2. Accordingly, the electric potential VG of the gate of the driving transistor TDR is set to the reset electric potential Vrst. In addition, the electric potential VS of the source of the driving transistor TDR is maintained at a constant electric potential VEL (>Vrst). Therefore, the gate-to-source voltage VGS of the driving transistor TDR is reset to a voltage difference VGS1 (=VEL−Vrst) between the constant electric potential VEL and the reset electric potential Vrst.

The reset electric potential Vrst is set such that the gate-to-source voltage VGS1 of the driving transistor TDR is sufficiently higher than the threshold voltage VTH of the driving transistor TDR, as represented by the following Equation (14). Therefore, in the reset period PRS, the driving transistor TDR is in the ON state.

$$V_{GS1} = V_{EL} - V_{rst} \gg V_{TH} \quad \text{Equation (14)}$$

As shown in FIG. 28, the electric potential control circuit 36 sets the electric potential VCT[i], which is output to the feed line 16, to the first electric potential VCT1. The first electric potential VCT1, as the following Equation (15), is set such that a difference voltage (=VEL−VCT1) between the electric potential VEL of the feed line 18 and the first electric potential VCT1 is set to be sufficiently lower than the threshold voltage VTH_OLED of the light emitting element E. Accordingly, for the reset period PRS, the light emitting element F is in the OFF state (non-emitting state).

$$V_{EL} - V_{CT1} \ll V_{TH_OLED} \quad \text{Equation (15)}$$

In addition, as shown in FIG. 28, the driving circuit 30 sets the control signal GC[i] to the low level. Therefore, as shown in FIG. 29, the third switching device Tr3 is transited to the ON state, and the drain and the gate of the driving transistor TDR are connected to each other (that is, in the diode connection state) through the third switching device Tr3. As described above, since the gate of the driving transistor TDR is electrically conducted through the second switching device Tr2 to the reset line 70, the drain of the driving transistor TDR is electrically conducted through the third switching device Tr3 and the second switching device Tr2 to the reset line 70. As a result, the drain voltage of the driving transistor TDR is set (reset) to the reset electric potential Vrst.

As described above, since the driving transistor TDR is in the ON state, and the light emitting element E is in the OFF state, the current Ids flowing between the source and the drain of the driving transistor TDR flows from the drain of the driving transistor TDR to the reset line 70 through the third switching element Tr3 and the second switching element Tr2. The current Ids can be represented in the same form as the above-described Equation (3).

In addition, as shown in FIGS. 28 and 29, the signal line driving circuit 34 sets the signal S[j] to the reference electric potential VREF. For the reset period PRS, since the first switching device Tr1 is in the ON state, the first electrode L1 of the capacitor element C0 is electrically conducted to the signal lines 14 through the first switching device Tr1. Therefore, the voltage of the first electrode L1 is set to the first reference electric potential VREF. On the other hand, since the voltage of the second electrode L2 of the capacitor element C0 (that is, the electric potential VG of the gate of the driving transistor TDR) is set to the reset electric potential Vrst, and the voltage across the capacitor element C0 is maintained at the voltage VREF-Vrst.

Figure 30:
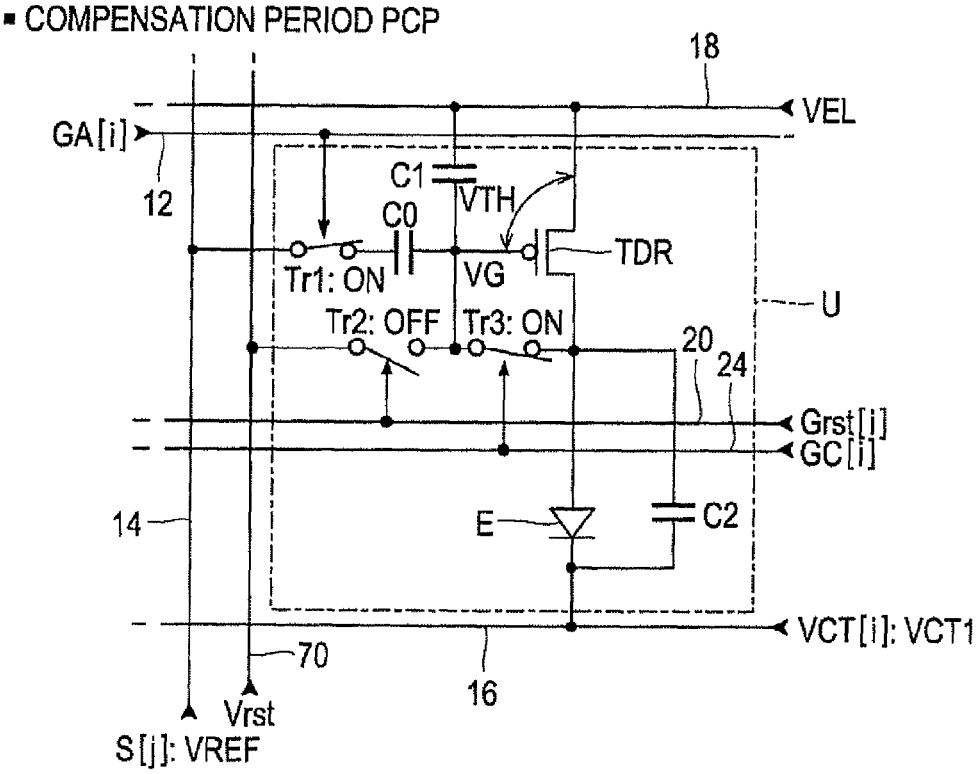
FIG. 30 is a circuit diagram showing the appearance of a pixel circuit for a compensation period.

[2] Compensation Period PCP (FIG. 30)

As shown in FIG. 28, when the compensation period PCP1 starts, the driving circuit 30 sets the reset signal Grst[i] to the high level. Therefore, as shown in FIG. 30, the second switching device Tr2 is transited to the OFF state. On the other hand, the control signal GC[i] is maintained at the low level, so that the driving transistor TDR is continuously in the diode-connection state. In addition, the electric potential control circuit 36 maintains the electric potential VCT[i] at the first electric potential VCT1, and the signal line driving circuit 34 maintains the signal S[j] at the reference electric potential VREF.

Accordingly, the current Ids flows to the gate of the driving transistor TDR through the third switching element Tr3. Therefore, electric charges are charged in the capacitor element C0 and the storage capacitor C1, and the electric potential VG of the gate of the driving transistor TDR slowly rises as shown in FIG. 28. Since the electric potential VS of the source of the driving transistor TDR is fixed to the electric potential VEL of the feed line 18, the voltage VGS between the gate and the source of the driving transistor TDR decreases with the rise of the electric potential VG of the gate. As can be known from Equation (3), as the voltage VGS decreases so as to approach the threshold voltage VTH, the current Ids decreases. Thus, an operation (hereinafter, referred to as a "first compensation operation") for having the voltage VGS of the driving transistor TDR temporarily decrease from the voltage VGS1 (VGS1=VEL−Vrst) that is set in the reset period PRS and gradually approach the threshold voltage VTH is performed for the compensation period PCP. The temporal length of the compensation period PCP is set such that the voltage VGS between the gate and the source of the driving transistor TDR sufficiently approaches (ideally, coincides with) the threshold voltage VTH at the end point of the compensation period PCP. Accordingly, the driving transistor TDR is mostly in the OFF state at the end point of the compensation period PCP.

Figure 31:
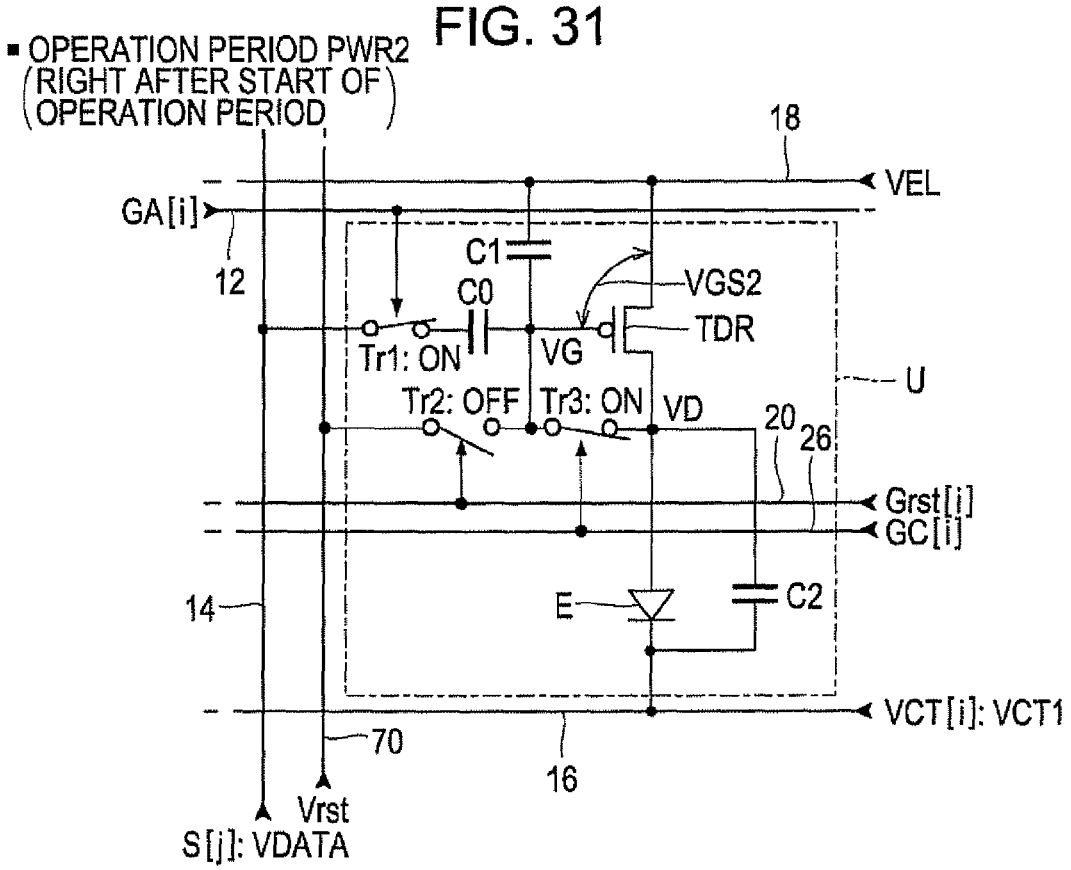
FIG. 31 is a circuit diagram showing the state of the pixel circuit for a writing period.

[3] Write Period PWR (FIG. 31)

As shown in FIG. 28, the write period PWR is divided into a standby period PWR1 and an operation period PWR2. The standby period PWR1 is a period from the start point of the write period PWR to the elapse of a temporal length ta. In addition, the operation period PWR2 is the remaining period of the write period PWR (a temporal length tb from the end point of the standby period PWR1 to the end point of the write period PWR). The temporal length tb of the operation period PWR2 is set to be changed in accordance with the gray scale value D that is designated to the pixel circuit U. In other words, as shown in FIG. 28, the temporal length tb of a case where the gray scale value D designates a high gray scale (high luminance) is shorter than the temporal length tb of a case where the gray scale value D designates a low gray scale (low luminance). Since the temporal length of the write period PWR is a fixed value, the temporal length ta of the standby period PWR1 is changed in accordance with the temporal length tb (gray scale value D). In addition, setting of the temporal length tb of the operation period PWR2 will be described later.

As shown in FIG. 28, the state of the compensation period PCP is maintained in the standby period PWR1. In other words, the driving transistor TDR maintains to be in the OFF state as the result of setting the voltage VGS to the threshold voltage VTH in the first compensation operation, with the supply of the reference electric potential VREF to the first electrode L1 of the capacitor element C0 continued.

As shown in FIG. 28 and FIG. 31, when the start point of the operation period PWR2 is reached as the temporal length ta elapses, the signal line driving circuit 34 changes the signal S[j] to have a gray scale electric potential VDATA. The gray scale electric potential VDATA is set to be changed in accordance with the gray scale value D that is designated to the pixel circuit U (light emitting element E). Since the first switching element Tr1 maintains to be in the ON state also in the write period PWR, the electric potential of the first electrode L1 of the capacitor element C0 changes from the reference electric potential VREF in the standby period PWR1 to the gray scale electric potential VDATA. Then, the electric potential VS of the gate of the driving transistor TDR changes in accordance with the amount of change ΔV2 (ΔV2=VREF−VDATA) of the electric potential of the first electrode L1. For the operation period PWR2, the driving transistor TDR is diode-connected continuously from the standby period PWR1, and accordingly, the gate and the drain of the driving transistor TDR are in the conductive state. Therefore, the amount of change of VG right after the start of the operation period PWR2 corresponds to a voltage (ΔV2·cp0/(cp0+cp1+cp2)) that is acquired by dividing the amount of change ΔV of the electric potential of the first electrode L1 in accordance with the ratio of the capacitance value of the capacitor element C0, the capacitance value of the storage capacitor C1, and the capacitance value C2 that is accompanied with the light emitting element E.

Accordingly, the voltage VGS2 between the gate and the source of the driving transistor TDR right after the start of the operation period PWR2 can be represented in the following Equation (16). A voltage VIN in Equation (16) corresponds to the amount of change (ΔV2·cp0/(cp0+cp1+cp2)) of the electric potential VG of the gate of the driving transistor TDR at the time when the gray scale electric potential VDATA is supplied to the first electrode L1.

$$VGS2 = VTH + \Delta V2 \cdot cp0/(cp0 + cp1 + cp2) \quad \text{Equation (16)}$$
$$= VIN + VTH$$

As described above, as the voltage VGS2 is set to a voltage value above the threshold voltage VTH in accordance with the gray scale electric potential VDATA (described in more details, a difference between the gray scale electric potential VDATA and the reference electric potential VREF), the driving transistor TDR is changed to be in the ON state.

As described above, since the driving transistor TDR is diode-connected for the operation period PWR2, the current Ids flows to the gate of the driving transistor TDR through the third switching element Tr3. Accordingly, as shown in FIG. 28, the electric potential VG of the gate of the driving transistor TDR slowly rises. Since the electric potential VS of the source of the driving transistor TDR is fixed to the electric potential VEL, the voltage VGS between the gate and the source of the driving transistor TDR decreases with the rise of the electric potential VG of the gate. In other words, an operation (hereinafter, referred to as a "second compensation operation") for having the voltage VGS between the gate and the source of the driving transistor TDR gradually approach the threshold voltage VTH from the voltage VGS2, which is set by supply of the gray scale electric potential VDATA, is performed in the operation period PWR2 of the write period PWR, similarly to the compensation period PCP. Accordingly, in the end point of the operation period PWR2 (the end point of the write period PWR), as shown in FIG. 28, the voltage VGS between the gate and the source of the driving transistor TDR is set to a voltage VGS3, shown in Equation (17), that is lower than the voltage VGS2 shown in Equation (16) by a voltage ΔV3. The voltage ΔV3 corresponds to the amount of change of the electric potential VG of the gate of the driving transistor TDR that is made by the second compensation operation.

$$VGS3 = VGS2 - \Delta V3 \quad \text{Equation (17)}$$
$$= VIN + VTH - \Delta V3$$

The voltage VGS3 changes in accordance with the gray scale electric potential VDATA and the temporal length tb. Thus, the operation for controlling the temporal length tb of the operation period PWR2 in accordance with the gray scale value D may be also perceived as an operation for controlling the voltage VGS3 at the end point of the operation period PWR2 to be changed in accordance with the gray scale value D.

The temporal length from the start point of the operation period PWR2 to a time when the driving transistor TDR is changed to be in the ON state is sufficiently short, and thus, the temporal length tb of the operation period PWR2 corresponds to a temporal length in which the second compensation operation is performed. The temporal length tb is set within the range in which the voltage VGS3 between the gate and the source of the driving transistor TDR at the end point of the operation period PWR2 is a voltage that is equivalent to the threshold voltage VTH (for a case where the gray scale value D designates a minimum gray scale) or a voltage that is higher than the threshold voltage VTH. In other words, in a case where the gray scale value D designates a gray scale other than the minimum gray scale, the driving transistor TDR is maintained to be in the ON state at the end point of the operation period PWR2.

Figure 32:
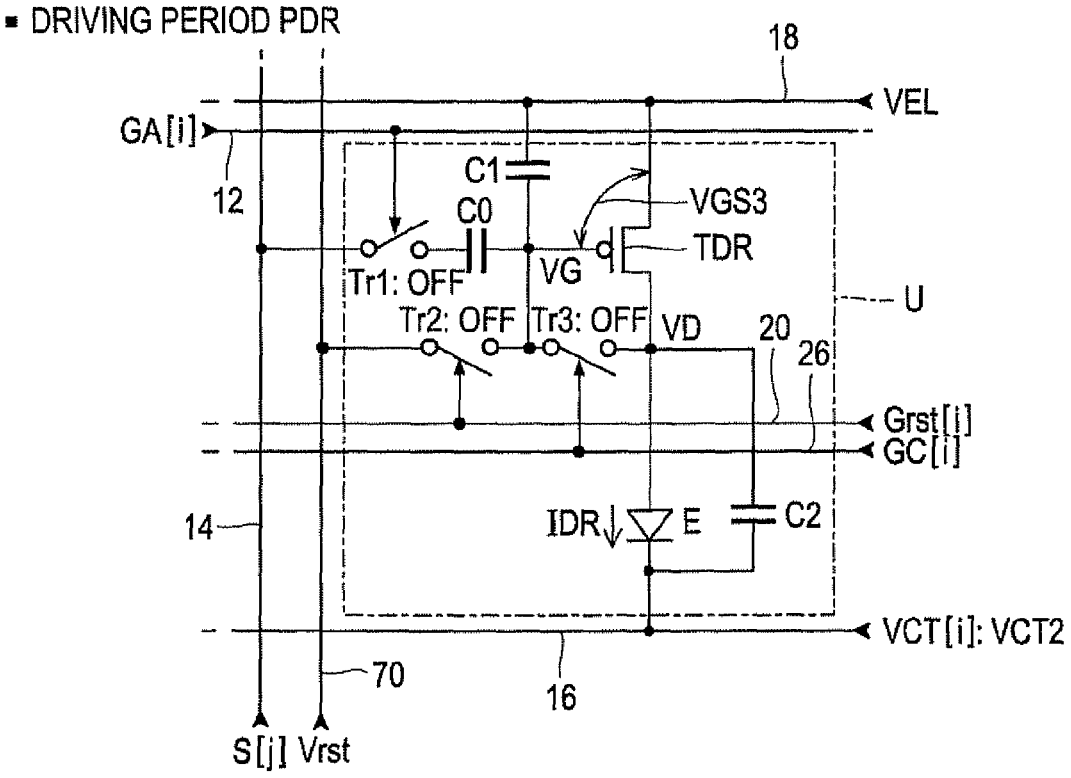
FIG. 32 is a circuit diagram showing the state of the pixel circuit for a driving period.

[4] Driving Period PDR (FIG. 32)

As shown in FIG. 28, when the driving period PDR is started, the driving circuit 30 changes the scanning signal GA[i] to have the high level (inactive level). Accordingly, as shown in FIG. 32, the first switching element Tr1 of each pixel circuit U of the i-th row is changed to be in the OFF state, and therefore supply of the electric potential to the first electrode L1 of the capacitor element C0 is stopped. In addition, as shown in FIG. 28, the driving circuit 30 sets the control signal GC[i] to the high level. Accordingly, the third switching element Tr3 is transited to the OFF state, and whereby diode-connection of the driving transistor TDR is released.

In addition, as shown in FIGS. 28 and 32, the electric potential control circuit 36 sets the electric potential VCT[i] output to the feed line 16 to the second electric potential VCT2. The second electric potential VCT2 is set such that a voltage difference (=VEL−VCT2) between the electric potential VEL of the feed line 18 and the second electric potential VCT2 is sufficiently higher than the threshold voltage VTH_OLED of the light emitting element E, as represented by the following Equation (18).

$$VEL - VCT2 >> VTH_OLED \quad \text{Equation (18)}$$

In this case, the current Ids flows into the light emitting element E, so that the capacitance C2 is charged.

Therefore, in the state in which the gate-to-source voltage VGS of the driving transistor TDR is maintained at the voltage VGS3 shown in Equation (17), the voltage across the capacitance C2 (that is, the electric potential of the drain of the driving transistor TDR) is gradually increased. In addition, at the time that the voltage across the capacitance C2 approaches the threshold voltage VTH_OLED of the light emitting element B, the current Ids is supplied as the driving current TDR to the light emitting element E. The driving current IDR can be represented by the following Equation (19).

$$\begin{aligned} IDR &= 1/2 \cdot \mu \cdot W/L \cdot Cox \cdot (VGS3 - VTH)^2 \quad \text{Equation (19)} \\ &= 1/2 \cdot \mu \cdot W/L \cdot Cox \cdot \\ &\quad \{(VIN + VTH - \Delta V3) - VTH\}^2 \\ &= K \cdot (VIN - \Delta V3)^2 \end{aligned}$$

$$(\text{Here, } K = 1/2 \cdot \mu \cdot W/L \cdot Cox)$$

In this manner, since the driving current IDR is controlled to a current amount according to the voltage VGS3 corresponding to the gray scale electric potential VDATA, the light emitting element E emits light with a luminance corresponding to the gray scale electric potential VDATA (that is, the gray scale value D). The light emitting of the light emitting element E is maintained until the starting point of the reset period PSL where the scan signal GA[i] becomes in the active level.

Thus, as shown in Equation (19), the driving current IDR does not depend on the threshold voltage VTH. Accordingly, even when there is an error in the threshold voltage VTH of the driving transistor TDR of each pixel circuit U, the driving current IDR is set as a target value corresponding to the gray scale electric potential VDATA.

Here, the voltage ΔV3 (the amount of change in the voltage VGS between the gate and the source of the driving transistor TDR that is made by the second compensation operation) shown in Equation (19) depends on the mobility μ of the driving transistor TDR. Additionally described in detail, as the mobility μ of the driving transistor TDR increases, the voltage ΔV3 is increased. As described above, since the mobility μ of the driving transistor TDR is reflected on the driving current IDR by performing the second compensation operation, the error in the driving current IDR due to the mobility μ of the driving transistor TDR can be compensated by performing the second compensation operation in the write period PWR (the operation period PWR2).

However, under the configuration (hereinafter, referred to as a "comparative example") in which the temporal length tb of the second compensation operation is fixed to a predetermined value that does not depend on the gray scale value X, as described below, there is a problem that the error in the mobility μ of the driving transistor TDR can be effectively compensated only in a case where a specific gray scale value D (the gray scale electric potential VDATA) is designated.

Figure 33:
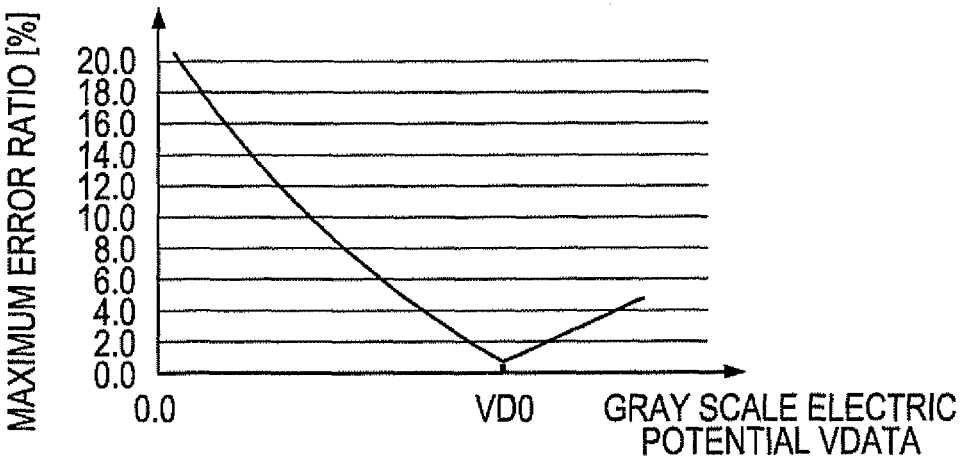
FIG. 33 is a graph showing a relationship between a gray scale electric potential and the error in a driving current in a comparative example.

FIG. 33 is a graph showing the correlation between the gray scale electric potential VDATA and the error in the current amount of the driving current IDR, according to the comparative example. In FIG. 33, the horizontal axis represents a voltage value of the gray scale electric potential VDATA, and the vertical axis represents a relative ratio (maximum error ratio) of the maximum value of the current amount of the driving current IDR to the minimum value of the current amount for a case where a same gray scale value D is designated. As can be known from FIG. 33, in a case where the temporal length tb of the second compensation operation is set to a fixed value, when the gray scale electric potential VDATA is set to a specific value VD0, the error in the driving current IDR is decreased assuredly. However, in such a case, as the gray scale electric potential VDATA is apart far from the specific value VD0, the error in the driving current increases. In other words, in the comparative example, it is difficult to eliminate the error in the driving current IDR over a broad range of the gray scale electric potentials VDATA.

Figure 34:
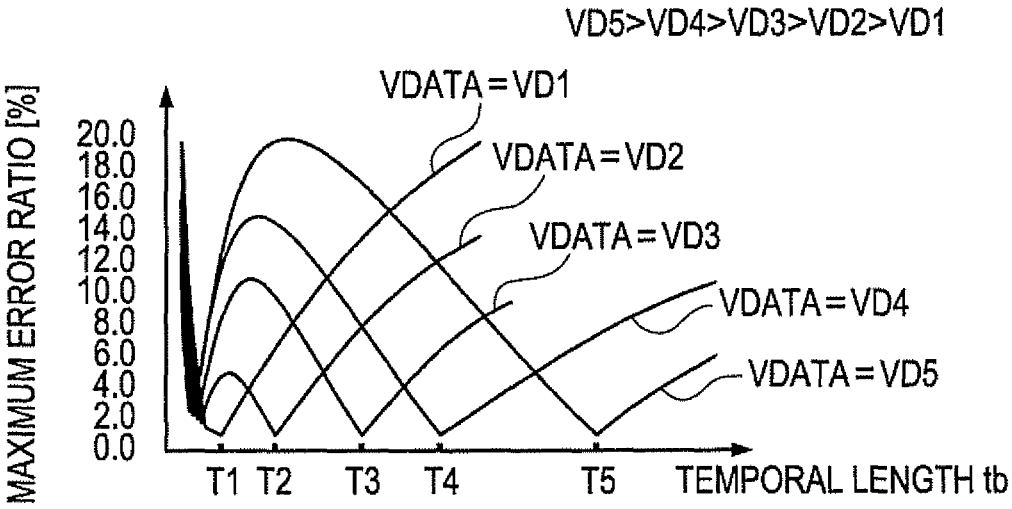
FIG. 34 is a graph showing the relationship between the temporal length of an operating period and the error in the driving current.

FIG. 34 is a graph showing the relationship between the temporal length tb of the operation period PWR2 and the error (the maximum error ratio) in the driving current IDR according to this embodiment for a plurality of cases where the gray scale electric potential VDATA is changed (Vt1<VD2<VD3<VD4<VD5). The tendency that the temporal length tb, in which the error in the driving current IDR becomes the minimum, is different depending on the gray scale electric potential VDATA is found from FIG. 34. As can be known from description above, according to this embodiment, by setting the temporal length tb of the operation period PWR2 to be changed in accordance with the gray scale value D (the gray scale electric potential VDATA), the error in the driving current IDR is suppressed regardless of the gray scale electric potential VDATA. For example, in such a state, when the gray scale electric potential VDATA is set to the electric potential VD1 shown in FIG. 34, the temporal length tb is set to a specific value T1. On the other hand, in the state, when the gray scale electric potential VDATA is set to an electric potential VD2 that is higher than the electric potential VD1, the temporal length tb is set to a specific value T2 (T2>T1)

Next, the second compensation operation within the operation period PWR2 will be reviewed in detail. The relationship shown in the following Equation (23) is satisfied between the current Ids that flows between the drain and the source of the driving transistor TDR in performing the second compensation operation and the capacitance values of the capacitors (the capacitor element C0, the storage capacitor C1, and the capacitor C2) that are charged by the current Ids. In addition, C shown in Equation (23) is a sum (C=cp0+cp1+cp2) of the capacitance values of the capacitor element C0, the storage capacitor C1, and the capacitor C2.

$$Ids=dQ/dt=C\cdot(dVD/dt) \quad \text{Equation (20)}$$

In addition, when considering the fact (dVD/dt−dΔV3/dt) that the temporal change of the electric potential VD of the drain of the driving transistor TDR is equivalent to that of the voltage ΔV3, the following Equation (21) is derived from Equation (19) and Equation (20). The voltage ΔV3(t) shown in Equation (21) represents that the voltage ΔV3 shown in Equation (19) changes with respect to a time t elapsed from the start of the second compensation operation (the start point of the operation period PWR2).

$$C(d\Delta V3/dt)=K(VIN-\Delta V3(t))^2 \quad \text{Equation (21)}$$

When Equation (21) is integrated under the condition that the voltage ΔV3(t) at the start point (t=0) (ΔV3(0)) of the operation period PWR2 is zero, the following Equation (9) that represents the current Ids (tb) between the drain and the source of the driving transistor TDR at the end point (t=tb) of the operation period PWR2 is derived. This equation is represented in a same form as the above-described Equation (9). The coefficient K shown in Equation (9) includes the mobility μ of the driving transistor TDR. Accordingly, the coefficient K corresponds to an index that represents the degree of error in the mobility μ. The driving current IDR that is supplied to the light emitting element E for the driving period PDR depends on the current Ids(tb) shown in Equation (9). Thus, in order to minimize the error in the driving current IDR, it is needed to minimize the error in the current Ids (tb) with respect to the variance of the coefficient K (mobility μ). A case where the error in the current Ids(tb) with respect to the variance of the coefficient K becomes the minimum is a case where the result of differentiating Equation (9) with respect to the coefficient K becomes zero. From the above-described condition, Equation (10) is derived. Accordingly, the condition under which the effect of compensation for the driving current IDR made by the second compensation operation becomes the maximum can be represented in a same form as the above-described Equation (11).

Since the voltage VIN shown in the above-described Equation (11) is set in accordance with the gray scale electric potential VDATA, a condition (as the gray scale electric potential VDATA becomes lower, the temporal length tb is shortened) that is the same as that described with reference to FIG. 34 for the gray scale electric potential VDATA and the temporal length tb of the operation period PWR2 can be found in Equation (11). Described in more details, when a value acquired by multiplying the voltage VIN by the temporal length tb of the operation period PWR2 (or a value acquired by multiplying the gray scale electric potential VDATA by the temporal length tb) is a predetermined value, the effect of compensation, which is performed by the second compensation operation, for the driving current IDR becomes the maximum.

Figure 35:
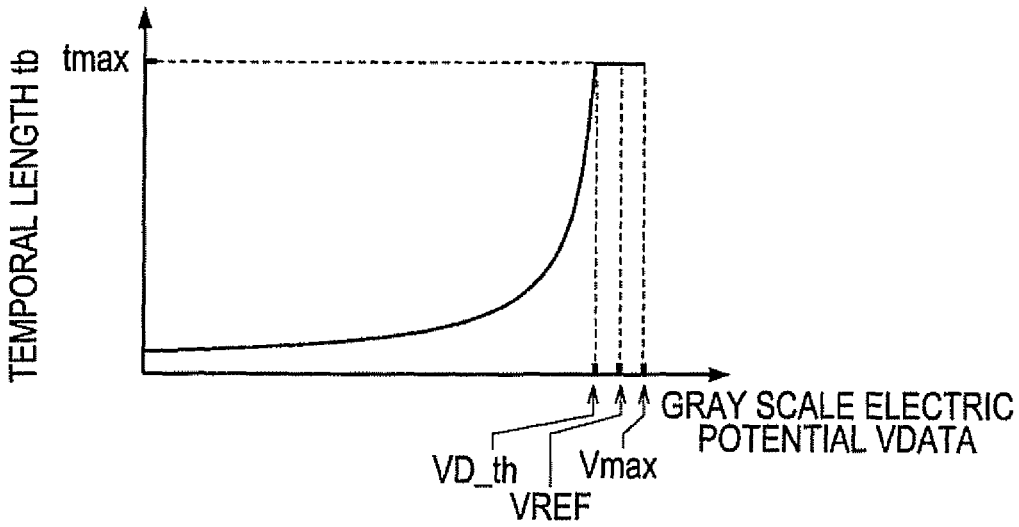
FIG. 35 is a graph showing a relationship between the gray scale electric potential and the temporal length of the operating period.

Based on the contents described above, according to this embodiment, the relationship between the gray scale electric potential VDATA and the temporal length tb is set as shown in FIG. 35. As shown in FIG. 35, as the gray scale electric potential VDATA becomes lower (the amount VIN of the change in the voltage VGS between the gate and the source of the driving transistor TDR due to supply of the gray scale electric potential VDATA becomes larger), the temporal length tb of the operation period PWR2 is set to a shorter time interval. Described in more details, as can be known from Equation (11), the temporal length tb is set such that a value acquired by multiplying the gray scale electric potential VDATA (voltage VIN) by the temporal length tb becomes a predetermined value (the temporal length tb is in inverse proportion to the gray scale electric potential VDATA). For example, the temporal length tb corresponding to each of a plurality of types of the gray scale electric potentials VDATA is set such that the error in the driving current IDR, which is set in accordance with the gray scale electric potential VDATA, is decreased (minimized, ideally), to be 1% or less.

However, the temporal length tb for minimizing the error in the driving current IDR becomes longer as the gray scale electric potential VDATA becomes higher. Thus, when the error in the driving current IDR is to be strictly minimized even in a case where the gray scale electric potential VDATA is sufficiently high (for example, in a case where the lowest gray scale is designated), the temporal length tb needs to be set to an excessively long time. Thus, the signal line driving circuit 34 according to this embodiment, as shown in FIG. 35, sets (clips) the temporal length tb of the operation period PWR2 to a predetermined value tmax, which does not depend on the gray scale value D, when the gray scale value D below a predetermined value is designated (when the gray scale electric potential VDATA is higher than the electric potential VD_th shown in FIG. 35). The maximum value tmax is limited to a time that is shorter than a temporal length needed for decreasing the voltage VGS of the driving transistor TDR to the threshold voltage VTH by performing the second compensation operation. Under the above-described configuration, it is possible to shorten the write period PWR (additionally, the unit period).

As described with reference to FIG. 28, the second compensation operation within the write period PWR is started as the signal S[j] is changed from the reference electric potential VREF to the gray scale electric potential VDATA. Accordingly, each unit circuit 40 of the signal line driving circuit 34 controls the temporal length tb (the temporal length ta of the standby period PWR1) of the operation period PWR2 to be changeable by adjusting the time point for changing the signal S[j] from the reference electric potential VREF to the gray scale electric potential VDATA in accordance with the gray scale value D.

The configuration of the unit circuit 40 of the signal line driving circuit 34 is the same as that of the above-described first embodiment (see FIG. 11).

Figure 36:
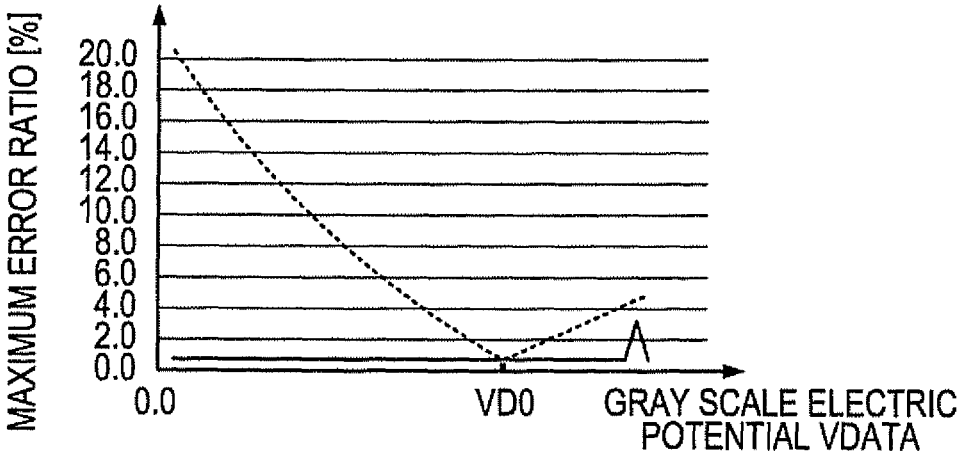
FIG. 36 is a graph for describing the advantage according to the sixth embodiment.

FIG. 36 is a graph showing the relationship (solid line) between the gray scale electric potential VDATA and the error in the driving current IDR according to this embodiment. In FIG. 36, the correlation (FIG. 33) between the gray scale electric potential VDATA and the error in the driving current IDR according to a comparative example is represented in a broken line additionally. As shown in FIG. 36, according to this embodiment, there is an advantage that the error in the driving current IDR is suppressed over a broad range of the gray scale electric potentials VDATA, compared to a comparative example (for example, JP-A-2007-310311) where the temporal length tb of the second compensation operation is fixed instead of being changed in accordance with the gray scale value D.

As shown in FIG. 36, the error in the driving current IDR is slightly increased in a high-electric potential area of the gray scale electric potential VDATA. This is caused by the influence of limiting the upper limit of the temporal length tb to the maximum value tmax. Above all, it is apparent from FIG. 36 that the error in the driving current IDR is enhanced markedly, compared to the comparative example, although the error in the driving current IDR is increased on the high-electric potential side.

Major reasons for the error in the driving current IDB are the threshold voltage VTH of the driving transistor TDR and the error in the mobility μ of the driving transistor TDR. Since the error in the threshold voltage VTH is compensated by the first compensation operation in which the voltage VGS of the driving transistor TDR is set to the threshold voltage VTH, the second compensation operation can be also perceived as an operation for compensating for the error in the mobility μ of the driving transistor TDR. In other words, the temporal length tb of the operation period PWR2 is controlled so as to be changed in accordance with the gray scale value D, so that the error in the mobility μ of the driving transistor TDR is compensated over a wide range of the gray scale electric potential VDATA.

G: Seventh Embodiment

Next, a seventh embodiment of the invention will be described. According to the sixth embodiment, the first compensation operation is performed for each pixel circuit U in the i-th row in the compensation period PCP within the unit period H[i]. However, when it takes a considerable time for the voltage VGS between the gate and the source of the driving transistor TDR to reach the threshold voltage VTH, the unit period H[i] needs to be set to a long time. In addition, there is a problem that an increase in the precision (an increase of the number of rows) of the pixel circuit U is restricted as the unit period H[i] becomes longer. Thus, according to this embodiment, by performing the first compensation operation over a plurality of unit periods H, the voltage VGS of the driving transistor TDR is assuredly set to the threshold value VTH while shortening the temporal length of the unit period H. In addition, the configuration of the pixel circuit U according to this embodiment is the same as that according to the sixth embodiment.

Figures 37A, 37B:
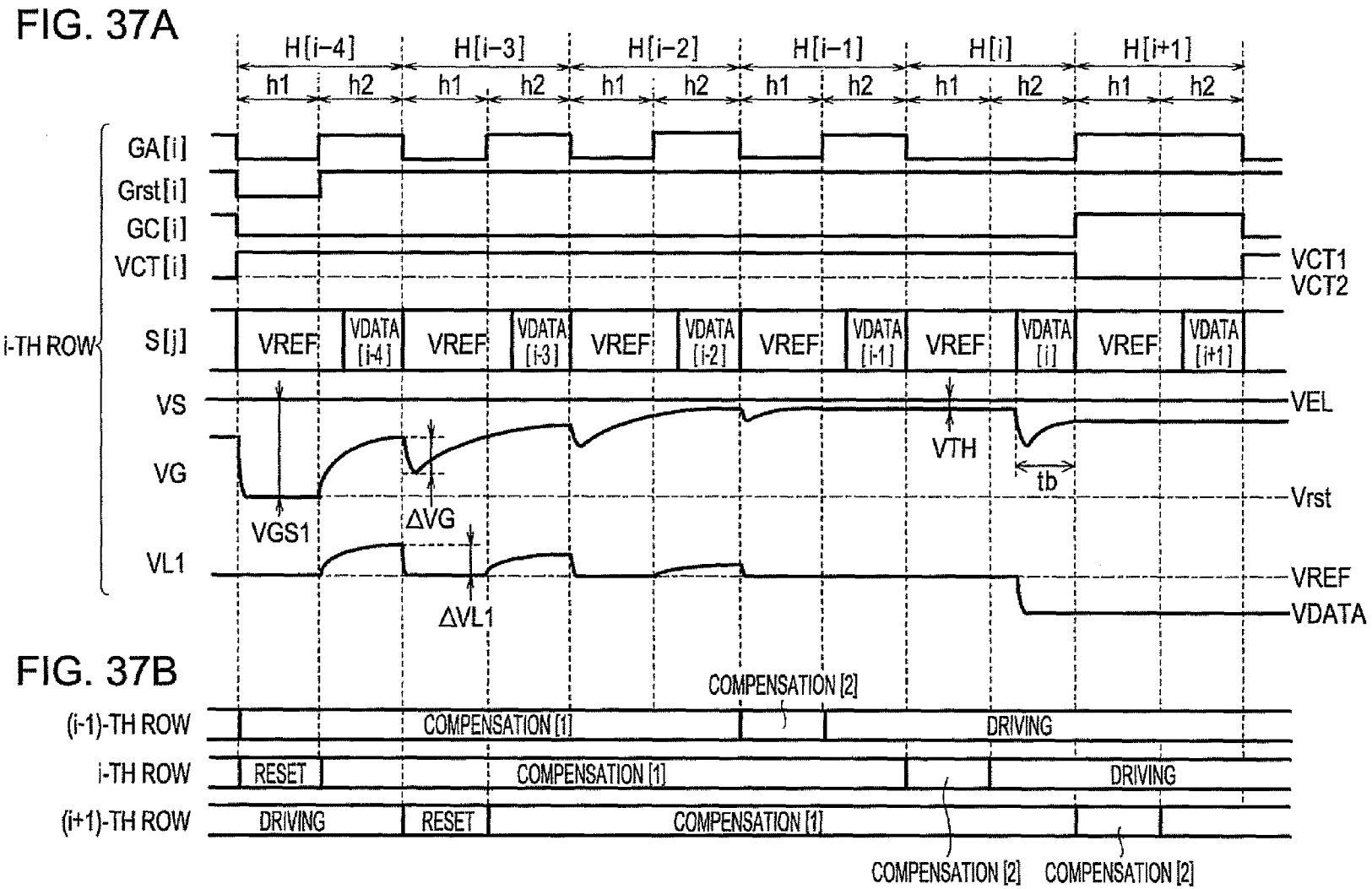
FIGS. 37A and 37B are timing charts showing the operation of a light emitting device according to a seventh embodiment of the invention.

FIGS. 37A and 37B are timing charts for describing a method of driving the pixel circuit U. As shown in FIG. 37A, each of a plurality of unit periods H ( . . . , H[i−4], H[i−3], H[i−2], H[i−1], H[i], H[i+1], . . . ) is divided into a first period hi and a second period h2. The first period h1 is a period of a first half of the unit period H, and the second period h2 is a period of the second half of the unit period H. The driving circuit 30 sequentially performs supply of the gray scale electric potential VDATA to the pixel circuit U and the second compensation operation ("compensation[2]" shown in FIG. 37B) in units of rows for each second period h2 of the unit period H. In other words, the second period h2 of the unit period H[i] corresponds to the write period PWR of each pixel circuit U of the i-th row.

As shown in FIG. 37A, the scanning signal GA[i] is set to the low level (active level) for the second period h2 of the unit period H[i], and the first switching element Tr1 of each pixel circuit U of the i-th row is controlled to be in the ON state. In addition, the control signal GC[i] is set to the low level, and the third switching element Tr3 of each pixel circuit U of the i-th row is set to be in the ON state. Accordingly, the driving transistor TDR of each pixel circuit U of the i-th row is diode-connected. On the other hand, the signal S[j] is changed from the reference electric potential VREF to the gray scale electric potential VDATA[i] of the pixel circuit U of the i-th row at a time point (the start point of the operation period PWR2) when the temporal length ta elapses from the start point of the second period h2 of the unit period H[i]. Accordingly, as shown in FIG. 37A, in each pixel circuit U of the i-th row, the second compensation operation is performed over the temporal length tb according to the gray scale value D within the second period h2 of the unit period H[i].

In addition, the driving circuit 30 (for example, the scanning line driving circuit 32) performs the reset operation ("resetting" shown in FIG. 37B) of each pixel circuit U of the i-th row and the first compensation operation ("compensation [1]" shown in FIG. 37B) for a plurality of the first periods h1 and the second periods h2 before the start of the second period h2 of the unit period H[i]. First, the driving circuit 30 sets the second switching element Tr2 of each pixel circuit U of the i-th row to be in the ON state by setting the reset signal Grst[i] to the low level for the first period h1 of the unit period H[i−4] that is a unit period four unit periods before the unit period H[i]. Accordingly, the voltage VGS between the gate and the source of the driving transistor TDR of each pixel circuit U of the i-th row is set to the voltage VGS1 (VGS1=VEL−Vrst) shown in Equation (16) for the first period h1 of the unit period H[i−4] as the reset period PRS. In other words, the first period h1 of the unit period H[i−4] corresponds to the reset period PRS of each pixel circuit U of the i-th row. In addition, the first switching element Tr1 and the third switching element Tr3 are set to be in the ON state, the signal S[j] is set to the reference electric potential VREF, and the electric potential VCT[i] is set to the first electric potential VCT1, which are the same as those in the reset period PRS according to the sixth embodiment.

As shown in FIG. 37A, the control signal GC[i] is set to the low level over a period from the second period h2 of the unit period H[i−4] to the first period h1 of the unit period H[i], and accordingly, the driving transistor TDR is diode-connected. Therefore, the first compensation operation is performed in each pixel circuit U of the i-th row over the period from the second period h2 of the unit period H[i−4] to the first period h1 of the unit period H[i]. In other words, the period from the second period h2 of the unit period H[i−4] to the first period h1 of the unit period H[i] corresponds to the compensation period PCP of each pixel circuit U of the i-th row.

In other words, as shown in FIG. 37A, the electric potential VG of the gate of the driving transistor TDR rises with the elapse of time over the period from the second period h2 of the unit period H[i−4] to the first period h1 of the unit period H[i]. However, as shown in FIG. 37A, the electric potential VG of the gate of the driving transistor TDR decreases right after the start of the first period h1. The decrease in the electric potential VG will be described as below.

For each first period h1 of the unit period H[i−4] to the unit period H[i], the scanning signal GA[i] is set to the low level, and the signal S[j] is set to the reference electric potential VREF. Accordingly, the electric potential of the first electrode L1 of each pixel circuit U of the i-th row is set to the reference electric potential VREF. On the other hand, for each second period h2 of the unit period H[i−4] to the unit period H[i−1], the scanning signal GA[i] is set to the high level, and accordingly, the first electrode L1 of each pixel circuit U of the i-th row is disconnected from the signal line 14 so as to be in an electrically-floating state. For each second period h2 of the unit period H[i−4] to the unit period H[i−1], the signal S[j] supplied to the signal line 14 is set to the gray scale electric potential VDATA of the pixel circuit U of a row other than the i-th row. However, the first switching element Tr1 of each pixel circuit U of the i-th row is set to be in the OFF state, and accordingly, the gray scale electric potential VDATA is not supplied to each pixel circuit U of the i-th row.

Accordingly, the electric potential VL1 of the first electrode L1 of each pixel circuit U of the i-th row, as shown in FIG. 37A, is maintained at the reference electric potential VREF for each first period h1 of the unit period H[i−4] to the unit period H[i] and is changed (rises) in association with the change in the electric potential VG of the gate (the second electrode L2) of the driving transistor TDR for each second period h2 of the unit period H[i−4] to the unit period H[i−1]. In other words, when the first period h1 is started, the electric potential VL1 of the first electrode n1 decreases by the amount of change ΔVL from the electric potential at the end point of the second period h2 prior to the first period h1 to the electric potential VREF. Accordingly, at a time point right after the start of the first period h1, the electric potential VG of the gate of the driving transistor TDR decreases by the amount of change ΔVG in association with the amount of change ΔVL in the electric potential of the first electrode L1.

The amount of change ΔVL1 in the electric potential of the first electrode L1 right after the start of the first period h1 depends on the amount of increase in the electric potential VG of the gate of the driving transistor TDR for the second period h2 prior to the first period h1. The amount of increase in the electric potential VG of the gate of the driving transistor TDR decreases as the voltage VGS between the gate and the source of the driving transistor TDR approaches the threshold voltage VTH (in other words, as a time elapses from the start of the first compensation operation). Accordingly, as shown in FIG. 37A, the amount of change ΔVL1 in the electric potential VL1 of the first electrode L1 right after the start of the first period h1 decreases as the time elapses from the start (the start point of the second period h2 of the unit period H[i−4] according to this embodiment) of the first compensation operation. Therefore, the amount of change ΔVG of the electric potential VG of the gate of the driving transistor TDR right after the start of the first period h1 decreases with the elapse of the time. As described above, since the amount of change ΔVG in the electric potential VG of the gate of the driving transistor TDR decreases with the elapse of the time, the voltage VGS between the gate and the source sufficiently approaches the threshold voltage VTH over a period from the unit period H[i−4] to the unit period H[i] regardless of the decrease in the electric potential VG each time the first period h1 is started.

As described above, the first compensation operation is performed in each pixel circuit U of the i-th row over the first period h1 of the unit period U[i] and a plurality of the unit periods U before the start of the unit period U[i]. Accordingly, the voltage VGS between the gate and the source of the driving transistor TDR is set to the threshold voltage VTH. Therefore, when compared to the first embodiment in which the first compensation operation is performed within one unit period H, there is an advantage that a temporal length sufficient for the voltage VGS of the driving transistor TDR to reach the threshold voltage VTH can be acquired for the first compensation operation even for a case where the temporal length of the unit period H is short.

As shown in FIG. 37A, when the unit period H[i] elapses, the scanning signal GA[i] is set to the high level (non-active level), and accordingly, the first switching element Tr1 is changed to be in the OFF state. In addition, the control signal GC[i] is set to the high level, and the third switching element Tr3 is changed to be in the OFF state, whereby diode-connection for the driving transistor TDR is released. In addition, the electric potential VCT[i] output to the feed line 16 is set as the second electric potential VCT2. Accordingly, similarly to the sixth embodiment, the driving current IDR shown in Equation (21) is supplied to the light emitting element E from the feed line 18 through the driving transistor TDR. The above-described operation described for the pixel circuit U of the i-th row is repeated for each row in the same manner.

H: Eighth Embodiment

Figure 38:
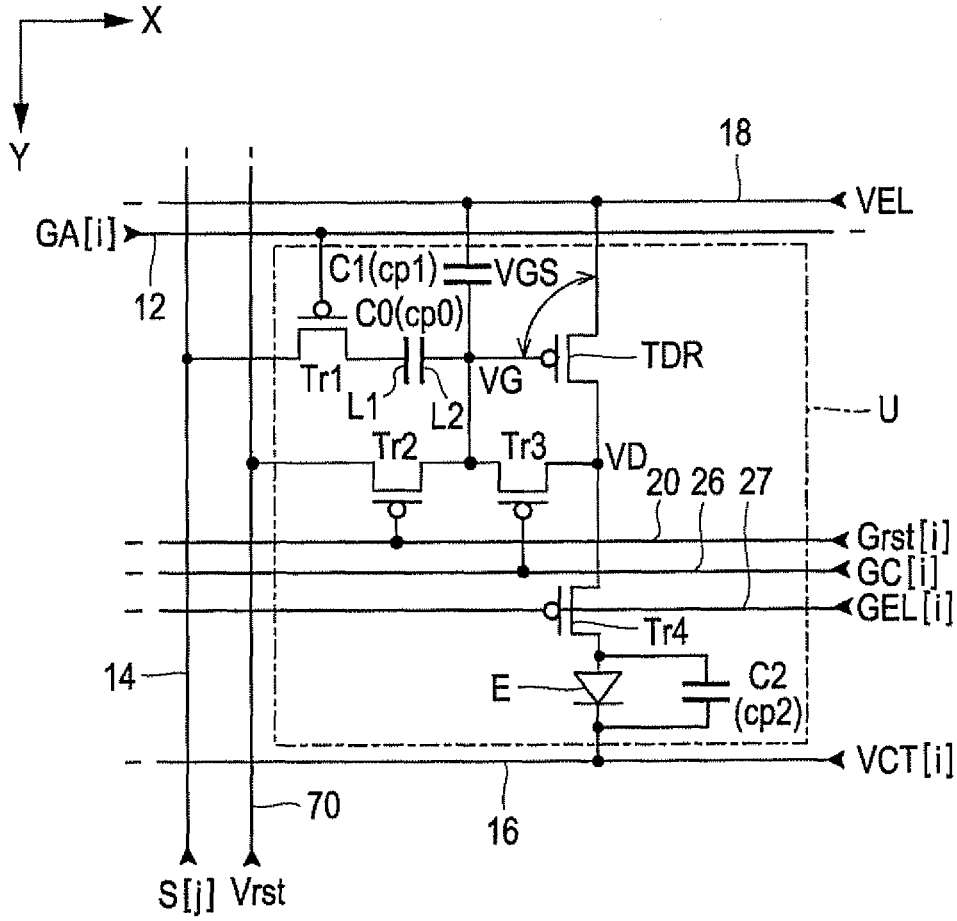
FIG. 38 is a circuit diagram of a pixel circuit according to an eighth embodiment of the invention.

FIG. 38 is circuit diagram showing a pixel circuits U according to a sixth embodiment of the invention. In FIG. 38, one pixel circuit U of the j-th column belonging to the i-th row is representatively shown. As shown in FIG. 38, in the component unit 10, the third control lines 27 extending in the X direction are disposed in correspondence with the m scanning lines 12. The light-emitting control signal GEL[i] is applied from the driving circuit 30 (for example, the scanning line driving circuit 32) to the third control line 27.

As shown in FIG. 38, the pixel circuit U further includes a fourth switching device Tr4 that is disposed in a path of the driving current IDR. As shown in FIG. 38, the fourth switching device Tr4 that is a P-channel transistor is interposed between the drain of the driving transistor TDR and the light emitting element E, and the gate of the fourth switching device Tr4 is connected to the third control line 27. When the light-emitting control signal GEL[i] is transited to the low level, the fourth switching device Tr4 is in the ON state, so that the drain of the driving transistor TDR and the anode of the light emitting element E are electrically conducted. When the light-emitting control signal GEL[i] is transited to the high level, the fourth switching device Tr4 is in the OFF state, so that the drain of the driving transistor TDR and the anode of the light emitting element E are not electrically conducted.

Figures 39A, 39B:
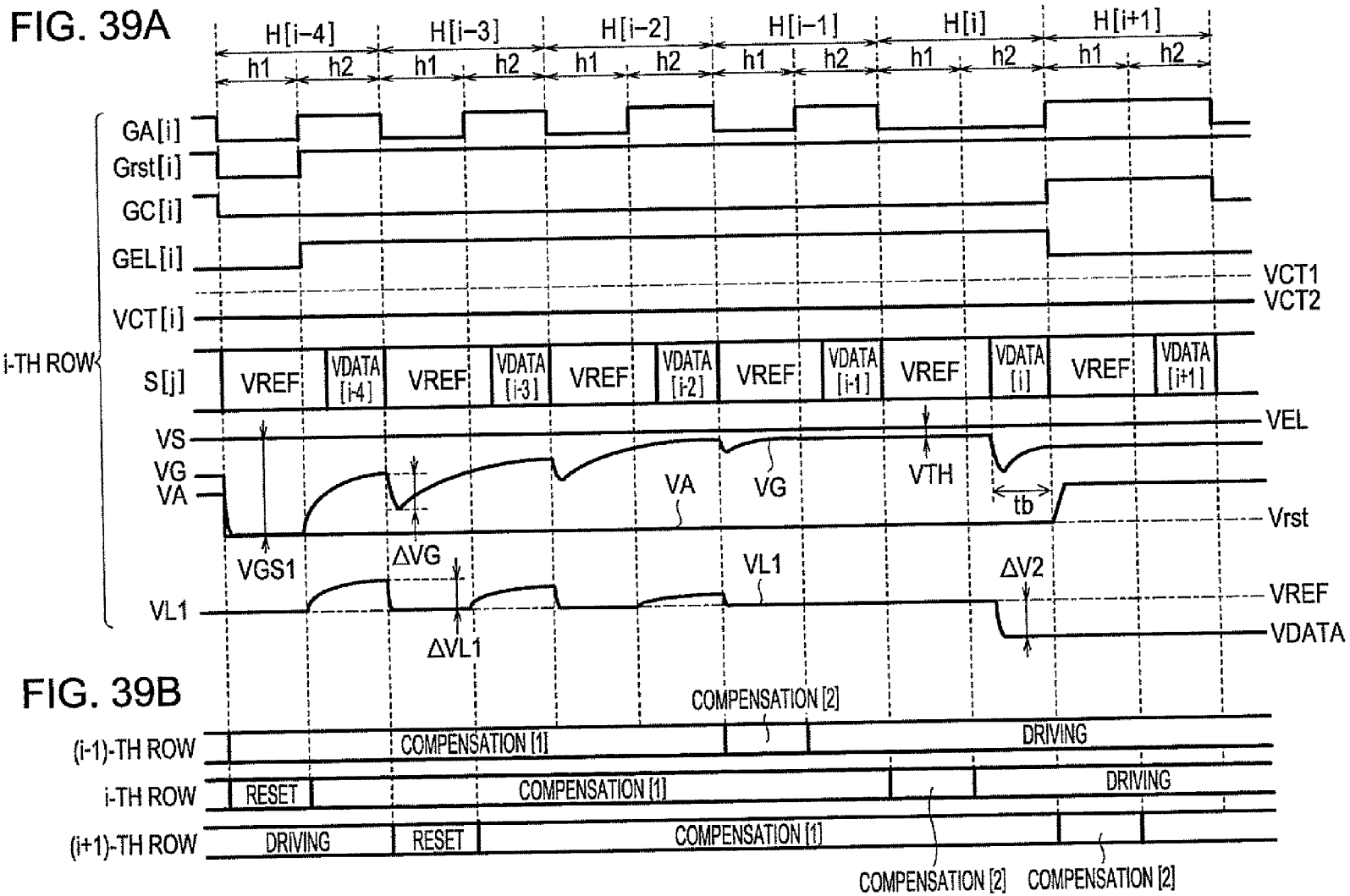
FIGS. 39A and 39B are timing charts showing the operation of a light emitting device according to the eighth embodiment.

FIGS. 39A and 39B are timing charts showing the operation of a light emitting device according to this embodiment. According to this embodiment, the control operation other than control of the light emitting control signal GEL[i] and the electric potential VCT[i] is the same as that according to the seventh embodiment. As shown in FIG. 39A, the driving circuit 30 sets the light emitting control signal GEL[i] to the low level for the first period h1 (corresponding to the reset period PRS) of the unit period H[i−4] that is a unit period four unit periods before the unit period H[i]. Accordingly, the fourth switching element Tr4 shown in FIG. 38 is transited to the ON state, and the drain of the driving transistor TDR and the anode of the light emitting element E are in a conductive state through the fourth switching element Tr4. As described above, according to the reset period PRS, the drain of the driving transistor TDR is in a conductive state with the reset line 24 through the third switching element Tr3 and the second switching element Tr2. Accordingly, the anode of the light emitting element E is in a conductive state with the reset line 24 through the fourth switching element Tr4, the third switching element Tr3, and the second switching element Tr2. Therefore, as shown in FIG. 39A, the electric potential VA of the anode of the light emitting element E is set (reset) to the reset electric potential Vrst together with the drain of the driving transistor TDR.

As shown in FIG. 39A, the electric potential VCT[i] that is output to the feed line 16 is set to the second electric potential VCT2 over all the unit periods H. Then, the second electric potential VCT2 and the reset electric potential Vrst, as in the following Equation (22), are set such that a difference voltage between the second electric potential VCT2 and the reset electric potential Vrst is sufficiently lower than the threshold voltage VTH_OLED of the light emitting element E. Accordingly, the voltage between both ends of the light emitting element E is sufficiently lower than the threshold voltage VTH_OLED for the first period h1 (the reset period PRS) of the unit period H[i−4], and whereby the light emitting element E is in the OFF state (non-emitting state).

$$Vrst-VCT2 << VTH_OLED \quad \text{Equation (22)}$$

As shown in FIG. 39A, the driving circuit 30 sets the light emitting control signal GEL[i] to the high level over a period from the elapse of the first period h1 of the unit period H[i−4] to the elapse of the unit period H[i]. Accordingly, the fourth switching element Tr4 is transited to the OFF state, and whereby the drain of the driving transistor TDR and the anode of the light emitting element E are in a non-conductive state. Therefore, the light emitting element E is maintained to be in the OFF state (non-emitting state).

As described above, the electric potential of the first electrode L1 is changed from the reference electric potential VREF to the gray scale electric potential VDATA at a time point (the start point of the operation period PWR2) when the temporal length ta elapses from the start point of the second period h2 of the unit period H[i]. According to this embodiment, since the fourth switching element Tr4 is maintained to be in the OFF state for the unit period H[i], the drain of the driving transistor TDR and the anode of the light emitting element E are in a non-conductive state, and the amount of change in the electric potential VG at a time point when the temporal length ta elapses from the start point of the second period h2 of the unit period H[i] does not depend on the capacitance value (cp2) of the capacitor C2 that is accompanied by the light emitting element E. Accordingly, the amount of change of the electric potential VS at the time point when the temporal length ta elapses from the start point of the second period h2 of the unit period H[i] corresponds to a voltage (ΔV2·cp0/(cp0+cp1)) that is acquired by dividing the amount of change ΔV2 (VREF−VDATA) of the electric potential of the first electrode L1 in accordance with the ratio of capacitance values of the capacitor element C0 and the storage capacitor C1. According to this embodiment, an equation that represents the voltage VGS2 between the gate and the source of the driving transistor TDR at the time point (right after the start of the operation period PWR) when the temporal length ta elapses from the start point of the second period h2 of the unit period H[i] may be represented by the following Equation (23) instead of Equation (16).

$$VGS2=VTH+\Delta V2-cp0/(cp0+cp1) \quad \text{Equation (23)}$$

As can be known from Equation (23) and Equation (16), there is an advantage that the width of change in the reference electric potential VREF1 and the gray scale electric potential VDATA that is needed for setting the voltage VGS2 to a desired value according to the gray scale value D according to the sixth embodiment may be smaller than that according to the sixth embodiment and the seventh embodiment.

As shown in FIG. 39A, when the unit period H[i] elapses and the unit period H[i+1] is started, the driving circuit 30 sets the light emitting control signal GEL[i] to the low level. Accordingly, the fourth switching element Tr4 is transited to the ON state, and whereby the drain of the driving transistor TDR and the anode of the light emitting element E are in the conductive state through the fourth switching element Tr4. Then, the current Ids flows to the anode of the light emitting element E through the fourth switching element Tr4. Thus, as shown in FIG. 39A, when the electric potential VA rises, and the voltage (=VA−VCT2) between both ends of the light emitting element E reaches the threshold voltage VTH_OLED of the light emitting element E, the current Ids is supplied to the light emitting element E as the driving current IDR.

However, when the light emitting element S emits light for the unit periods H[i−4] to H[i] (a period corresponding to the compensation period PCP or the write period PWR) before start of the unit period H[i+1], there is a problem that the contrast of a displayed image is decreased. According to the sixth to the eighth embodiments, the light emitting element E is assuredly maintained to be in the OFF state (non-emitting state) for the compensation period PCP and the write period PWR. Accordingly, there is an advantage that a decrease in the contrast of a pixel can be suppressed.

According to the sixth embodiment or the seventh embodiment, the emission of the light emitting element E is stopped by changing the electric potential VCT[i]. On the contrary, according to this embodiment, the emission of the light emitting element E for the compensation period PCP and the write period PWR is stopped by turning off the fourth switching element Tr4, and accordingly, the electric potential VCT[i] does not need to be changed. Therefore, compared to the sixth embodiment or the seventh embodiment, the operation or the configuration of the electric potential control circuit 36 can be simplified. First of all, according to the sixth embodiment or the seventh embodiment, the fourth switching element Tr4 that forcedly stops the emission of the light emitting element E needs not to be arranged. Accordingly, there is an advantage that the configuration of the pixel circuit U is simplified, compared to the eighth embodiment.

I: Ninth Embodiment

Figure 40:
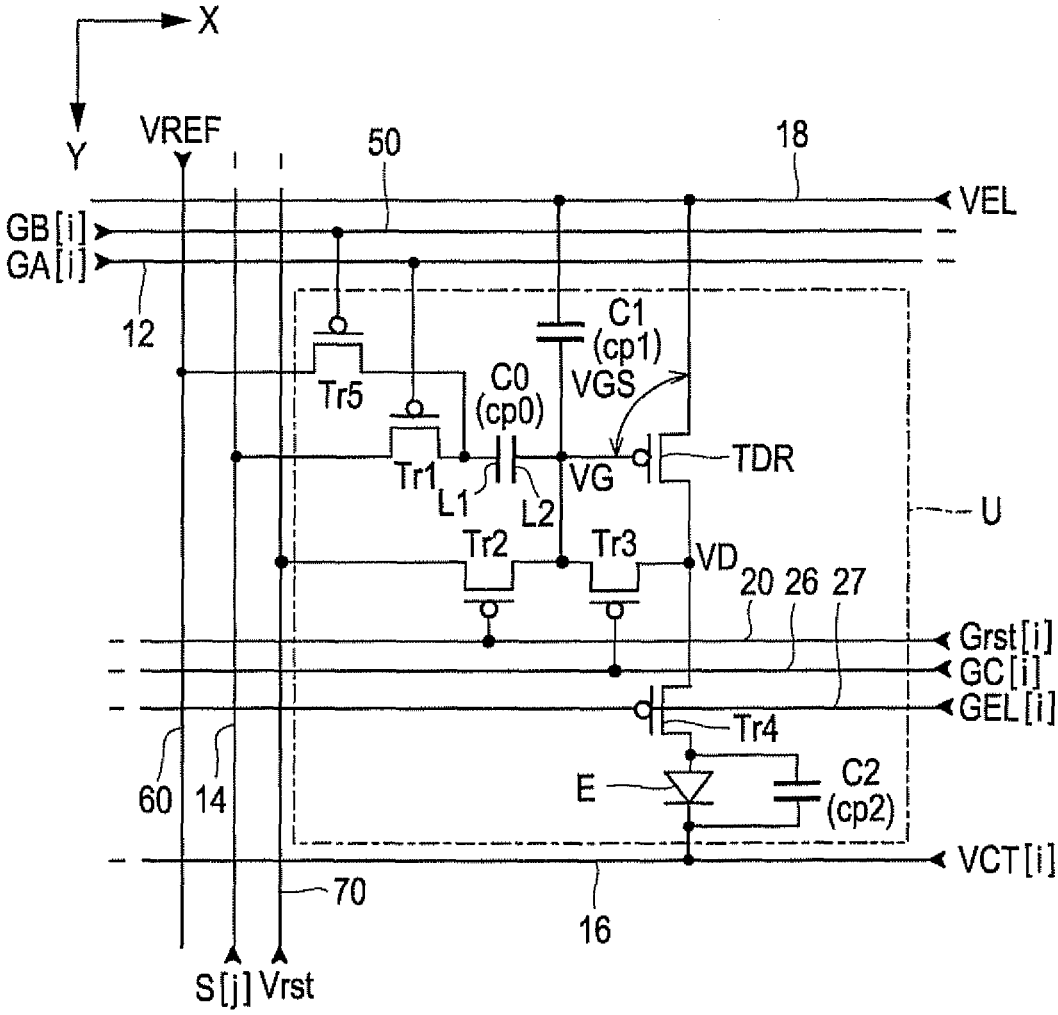
FIG. 40 is a circuit diagram of a pixel circuit according to a ninth embodiment of the invention.

FIG. 40 is a circuit diagram showing a pixel circuit according to a ninth embodiment of the invention. As shown in FIG. 40, the pixel circuit U has a configuration in which a fifth switching element Tr5 is added to the pixel circuit U according to the eighth embodiment. The fifth switching element Tr5 is interposed between a first electrode L1 and a feed line 60. The fifth switching element Tr5 is a P-channel transistor that controls electrical connection (conduction or non-conduction) between the first electrode L1 and the feed line 60. A reference electric potential VREF is supplied to the feed line 60. In other words, although the signal line 14 is commonly used for supply of the reference electric potential VREF to the pixel circuits U in the above-described sixth to the eighth embodiments, however, the feed line 60 other than the signal line 14 is used for supplying the reference electric potential VREF to each pixel circuit U in this embodiment.

In a component unit 10, m fourth control lines 50 extending in the X direction so as to be in correspondence with m scanning lines 12 are disposed. As shown in FIG. 16, the gate of the fifth switching element Tr5 of each pixel circuit U of the i-th row is connected to the fourth control line 50 of the i-th row. In addition, control signals GB (GB[1] to GB[m]) are supplied from a driving circuit 30 (for example, a scanning line driving circuit 32) to the fourth control lines 50.

Figures 41A, 41B:
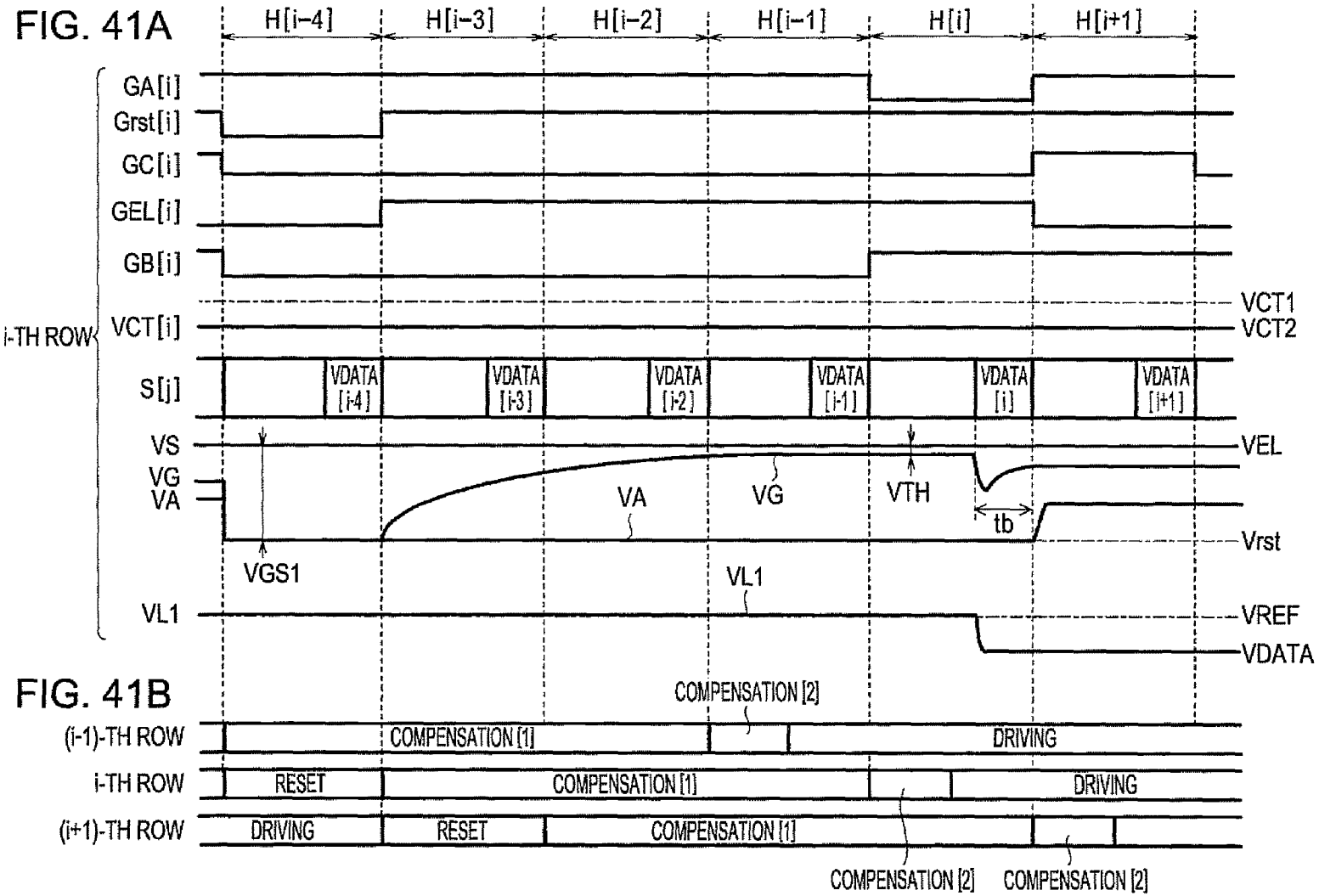
FIGS. 41A and 41B are timing charts showing the operation of a light emitting device according to the ninth embodiment.

FIGS. 41A and 41B are timing charts for describing a method of driving the pixel circuit U. As shown in FIG. 41B, the driving circuit 30 sequentially performs supply of the gray scale electric potential VDATA and the second compensation operation for the pixel circuit U in units of rows for each unit period H. In other words, the unit period H[i] corresponds to the write period PWR of each pixel circuit U of the i-th row.

As shown in FIG. 41A, the driving circuit 30 sets the scanning signal GA[i] and the control signal GC[i] to the low level and sets the light emitting control signal GEL[i] and the control signal GB[i] to the high level, for the unit period H[i]. Accordingly, the first switching element Tr1 and the third switching element Tr3 are in the ON state, and the fourth switching element Tr4 and the fifth switching element Tr5 are in the OFF state. On the other hand, the signal line driving circuit 34 changes the electric potential of the signal S[j] from the reference electric potential VREF to the gray scale electric potential VDATA[i] at a time point when the temporal length ta elapses from the start point of the unit period H[i]. Accordingly, as shown in FIG. 41A, in each pixel circuit U of the i-th row, the second compensation operation is performed over the temporal length tb within the unit period H[i].

In addition, the driving circuit 30 performs the reset operation for each pixel circuit U of the i-th row for the unit period H[i−4] as the reset period PRS and performs the first compensation operation for the unit periods H[i−3] to H[i−1] as the compensation period PCP. First, as shown in FIG. 41A, the driving circuit 30 sets the second switching element Tr2 of each pixel circuit U of the i-th row to be in the ON state for the unit period H[i−4] by setting the reset signal Grst[i] to the low level. Accordingly, the voltage VGS between the gate and the source of the driving transistor TDR of each pixel circuit U of the i-th row is set to the voltage VGS1 (VGS1=VEL−Vrst) shown in Equation (14) for the unit period H[i−4] as the reset period PRS. In addition, the first switching element Tr1, the third switching element Tr3, and the fourth switching element Tr4 are set to be in the ON state, which is the same as in the reset period PRS of the third embodiment. In addition, the driving circuit 30 controls the fifth switching element Tr5 to be in the ON state by setting the control signal GB[i] to the low level. Accordingly, the reference electric potential VREF is supplied to the first electrode L1 of each pixel circuit U of the i-th row from the feed line 30 through the fifth switching element Tr5.

In addition, also for each of the unit periods H[i−3] to H[i−1], same as for the unit period H[i−4], the fifth switching element Tr5 is controlled to be in the ON state, and the reference electric potential VREF is supplied to the first electrode L1 of each pixel circuit U of the i-th row from the feed line 30 through the fifth switching element Tr5. In addition, the third switching element Tr3 is set to be in the ON state, and accordingly, the driving transistor TDR is diode-connected. Accordingly, as shown in FIG. 41B, the first compensation operation is continuously performed over the unit periods H[i−3] to H[i−1] for each pixel circuit U of the i-th row. On the other hand, the first switching element Tr1 is set to be in the OFF state. Accordingly, each signal line 14 is disconnected from the pixel circuit U of the i-th row for the unit periods H[i−4] to H[i−1] and is used for supply of the gray scale electric potential VDATA to each pixel circuit U of the (i−4)-th row to the (i−1)-th row. In addition, the fourth switching element Tr4 is set to be in the OFF state, and accordingly, the light emitting element E is maintained to be in the OFF state.

According to this embodiment, the electric potential VL1 of the first electrode L1 is maintained at the reference electric potential VREF over the compensation period PCP (the unit periods H[i−3] to H[i−1]). Accordingly, the electric potential VG of the gate of the driving transistor TDR does not decrease in the middle of the first compensation operation. As a result, according to this embodiment, there is an advantage that the voltage VGS between the gate and the source of the driving transistor TDR can approach the threshold voltage VTH in a speedy manner, compared to the seventh embodiment and the eighth embodiment.

When the unit period H[i] elapses, the scanning signal GA[i] is set to the high level (inactive level), and the first switching element Tr1 is changed to be in the OFF state. In addition, the control signal GC[i] is set to the high level, and the third switching element Tr3 is changed to be in the OFF state, whereby the diode-connection of the driving transistor TDR is released. In addition, the light emitting control signal GEL[i] is set to the low level, and the fourth switching element Tr4 is transited to be the ON state, whereby the drain of the driving transistor TDR and the anode of the light emitting element E are in the conductive state through the fourth switching element Tr4. As a result, similarly to the third embodiment, the driving current IDR shown in Equation (21) is supplied to the light emitting element E from the feed line 18 through the driving transistor TDR. The above description for the pixel circuit U of the i-th row is repeated for each row in the same manner.

In this embodiment, the first compensation operation is performed over the plurality (three) of the unit periods H (the unit periods H[i−3] to H[i−1]). Accordingly, same as in the seventh embodiment or the eighth embodiment, acquisition of the temporal length of the first compensation operation and shortening of the unit period H can be achieved together.

In addition, according to the seventh embodiment and the eighth embodiment, the supply of the reference electric potential VREF (for the period h1) and the supply of the gray scale electric potential VDATA (for the period h2) are performed by using the common signal line 14 for the unit period H in a time-division manner. Accordingly, a period that can be used as the write period PWR is only the period h2 within the unit period H. Accordingly, a maximum value of the temporal length tb of the second compensation operation is limited to the temporal length of the period h2 (for example, a half of the unit period H). On the other hand, according to this embodiment, the feed line 30 other than the signal line 14 is used for the supply of the reference electric potential VREF in the reset operation and the first compensation operation, and accordingly, the entire unit period H can be used as the write period PWR. Accordingly, there is an advantage that the temporal length tb of the second compensation operation can be set up to the temporal length of the unit period H as a maximum length (that is, the width of change of the temporal length tb can be sufficiently acquired). Above all, according to the seventh embodiment and the eighth embodiment, the signal line 14 is commonly used for the supply of the reference electric potential VREF and the supply of the gray scale electric potential VDATA, and accordingly, there is an advantage that the configuration of the component unit 10 is simplified (the number of wirings is decreased), compared to the ninth embodiment.

J: Tenth Embodiment

Next, a tenth embodiment of the invention will be described. In the sixth embodiment, a configuration in which the temporal length tb of the second compensation operation in the write period PWR is controlled to be changed in accordance with the gray scale value D has been exemplified. According to this embodiment, in addition to the control of the temporal length tb of the second compensation operation, the temporal length of the first compensation operation in the compensation period PCP is controlled to be changed in accordance with the gray scale value D. The configuration of the pixel circuit U is the same as that of the sixth embodiment (FIG. 27).

Figure 42:
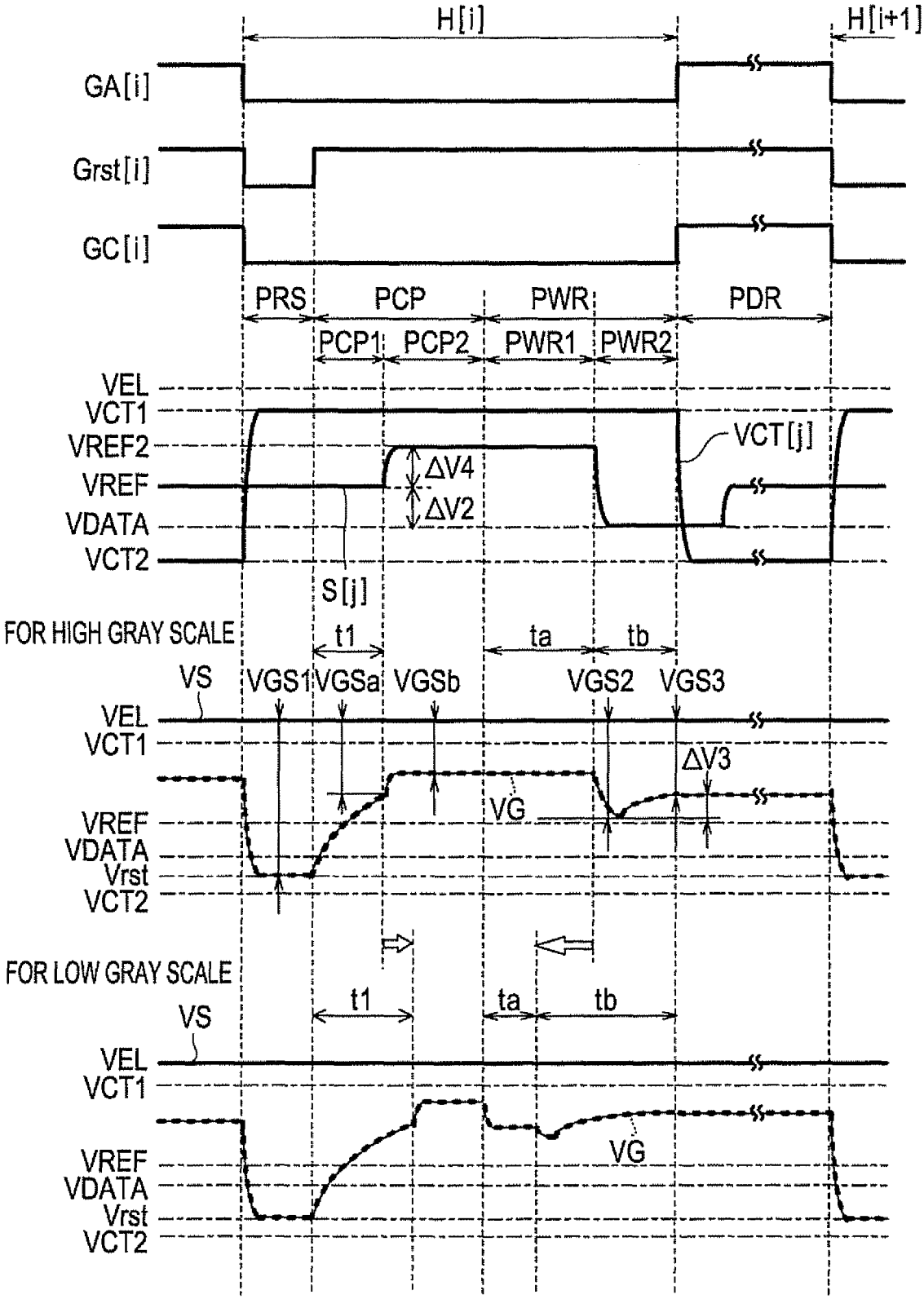
FIG. 42 is a timing chart showing the operation of a light emitting device according to a tenth embodiment of the invention.

FIG. 42 is a timing chart showing the operation of a pixel circuit U according to this embodiment. As shown in FIG. 42, the compensation period PCP is divided into an operation period PCP1 and a hold period PCP2. The operation period PCP1 is a period from the start point of the compensation period PCP (the end point of the reset period PRS) to a time when the temporal length t1 elapses. In addition, the hold period PCP1 is the remaining period of the compensation period PCP (a period from the end point of the operation period PCP1 to the end point of the compensation period PCP). The temporal length t1 of the operation period PCP1, similar to the temporal length tb of the operation period PWR2, is set to be changed in accordance with the gray scale value D that is designated to the pixel circuit U. In other words, as shown in FIG. 42, the temporal length t1 for a case where the gray scale value D designates a high gray scale (high luminance) is shorter than the temporal length t1 for a case where the gray scale value D designates a low gray scale (low luminance).

As shown in FIG. 42, similar to the compensation period PCP according to the first embodiment, by having the driving transistor TDR in the conductive state to be diode-connected for the operation period PCP1, the first compensation operation in which the voltage VGS between the gate and the source of the driving transistor TDR gradually approaches the threshold voltage VTH is performed. According to the sixth embodiment, the first compensation operation is continued until the voltage VGS coincides with the threshold voltage VTH. However, according to this embodiment, the first compensation operation is stopped at the start point of the hold period PCP2 (a time point when the temporal length t1 elapses from the start point of the compensation period PCP) before reach of the voltage VGS to the threshold voltage VTH. The stopping of the first compensation operation will be described in detail as below.

As shown in FIG. 42, when the hold period PCP2 is started, the signal line driving circuit 34 changes the electric potential of the signal S[i] to the reference electric potential VREF2. The reference electric potential VREF2 is higher than the reference electric potential VREF. Since the state of the first switching element Tr1, which is continued from the operation period PCP1, is maintained, the electric potential of the first electrode L1 of the capacitor element C0 changes from the reference electric potential VREF to the reference electric potential VREF2. Then, the electric potential VG of the gate of the driving transistor TDR is changed (rises) in accordance with the amount of change ΔV4 (ΔV4=VREF2−VREF) in the electric potential of the first electrode L1. The amount of change of electric potential VG right after the start of the hold period PCP2 corresponds to a voltage (ΔV−cp0/(cp0+cp1+cp2)) that is acquired by dividing the amount of change ΔV4 of the electric potential of the first electrode L1 in accordance with the ratio of the capacitance values of the capacitor element C0, the storage capacitor C1, and the capacitor C2. Accordingly, the voltage VGSb between the gate and the source of the driving transistor TDR right after the start of the hold period PCP2 can be represented as the following Equation (24) by using the voltage VGSa between the gate and the source of the driving transistor TDR at the end point of the operation period PCP1.

$$VGSb=VGSa-\Delta V4\cdot cp0/(cp0+cp1+cp2) \quad \text{Equation (24)}$$

The reference electric potential VREF2 is set such that the voltage VGSb shown in Equation (24) is lower than the threshold voltage VTH of the driving transistor TDR. Accordingly, by changing the electric potential of the first electrode L1 of the capacitor element C0 from the reference electric potential VREF to the reference electric potential VREF2 for the hold period PCP2, the driving transistor TDR is transited to be in the OFF state. In other words, the first compensation operation for having the voltage VGS between the gate and the source of the driving transistor TDR gradually approach the threshold voltage VTH is stopped in accordance with start of the hold period PCP2, and the voltage VGS of the driving transistor TDR is maintained at the voltage VGSb shown in Equation (24) until the end point of the hold period PCP2 is reached.

As shown in FIG. 42, the electric potential of the signal S[j] is maintained at the reference electric potential VREF2 for the standby period PWR1 of the write period PWR, continuously from the prior hold period PCP2. Then, when the operation period PWR2 is started, the signal line driving circuit 34 changes the electric potential of the signal S[j] to the gray scale electric potential VDATA. This operation is acquired by combining the operation for changing the electric potential of the signal S[j] to the reference electric potential VREF that is the same as that for the operation period PCP1 of the compensation period PCP and the operation for changing the electric potential of the signal S[j] from the reference electric potential VREF to the gray scale electric potential VDATA, same as that of the sixth embodiment. Accordingly, the voltage VGS2 between the gate and the source of the driving transistor TDR right after the start of the operation period PWR2 becomes a level that is equivalent to that acquired by being returned to the voltage VGSa that is a voltage at the time of the end point of the first compensation operation PCP1 and being additionally changed by VIN. The operation thereafter is the same as that according to the sixth embodiment.

When the correlation between a total time T acquired by summing the temporal length t1 of the operation period PCP1 and the temporal length tb of the operation period PWR2 and the error in the driving current IDR is checked, similarly to the correlation between the temporal length tb exemplified in FIG. 35 and the error in the driving current IDR, a total time T for which the error in the driving current IDR becomes a minimum is individually determined for each gray scale electric potential VDATA. For example, as the gray scale electric potential VDATA becomes lower, the total time T for which the error in the driving current IDR becomes the minimum is shortened. The temporal length t1 and the temporal length tb are set to values that are acquired by dividing a total time T that is determined for each gray scale electric potential VDATA in the above described order. However, the temporal length t1 is set to a temporal length that is shorter than a time for which the voltage VGS of the driving transistor TDR reaches the threshold voltage VTH by performing the first compensation operation. In addition, the temporal length tb is set to a temporal length that is shorter than a time for which the voltage VGS reaches the threshold voltage VTH by performing the second compensation operation.

The control of the temporal length t1 of the operation period PCP1 is implemented by using a configuration that is the same as that shown in FIG. 11. In other words, the time adjusting unit 46 changes the time point when the electric potential selecting unit 44 changes the reference electric potential VREF to the reference electric potential VREF2 to be changed in accordance with the gray scale value D. An upper limit is set to the temporal length t1, similar to the temporal length tb According to the above-described embodiment, the temporal length t1 of the first compensation operation, in addition to the temporal length tb of the second compensation operation, is also controlled to be changed in accordance with the gray scale value D. Accordingly, a large width of change in the temporal length of the compensation operation can be acquired, compared to the sixth embodiment in which only the temporal length tb of the second compensation operation is controlled. Therefore, it is possible to suppress the error in the driving current IDR for the gray scale electric potential VDATA over a wider range.

Figure 43:
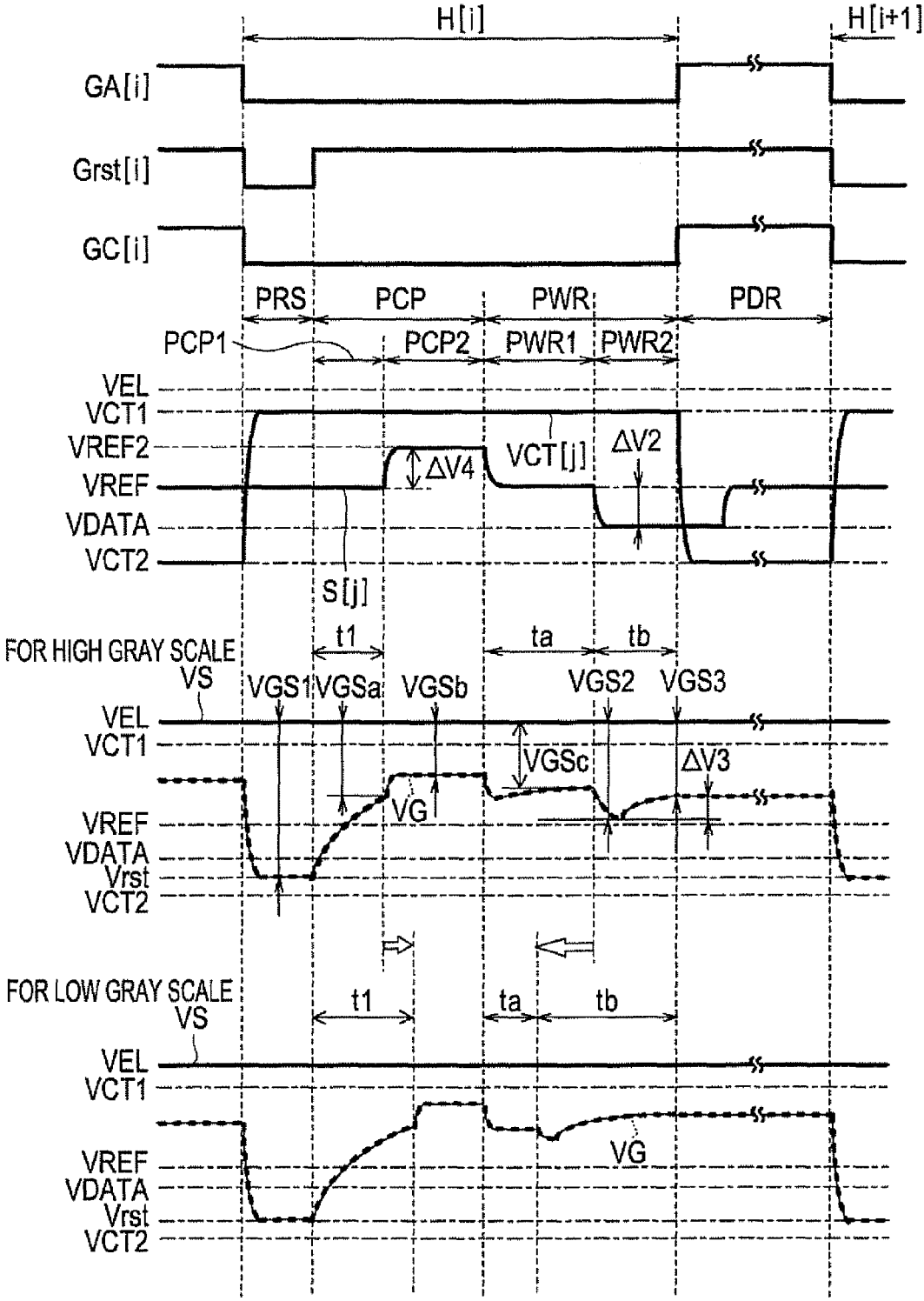
FIG. 43 is a timing chart showing the operation of a light emitting device according to a modified example of the tenth embodiment.

In addition, in FIG. 42, the electric potential of the signal S[j] is maintained at the reference electric potential VRF2 for the standby period PWR1, continuously from the prior hold period PCP2, and the electric potential of the signal S[j] is changed from the reference electric potential VREF2 to the gray scale electric potential VDATA at the start point of the operation period PWR2. However, for example, as shown in FIG. 43, a configuration in which the electric potential of the signal S[j] is set to the reference electric potential VREF for the standby period PWR1 of the write period PWR and then, is changed to the gray scale electric potential VDATA at the start point of the operation period PWR2 may be employed. In FIG. 43, when the write period PWR (the standby period PWR1) is started, the signal line driving circuit 34 changes the electric potential of the signal S[j] to the reference electric potential VREF that is the same as that for the operation period PCP1 of the compensation period PCP. Accordingly, the state for the standby period PWR1 is the same as that for the operation period PCP1 of the compensation period PCP. Therefore, the voltage VGS between the gate and the source of the driving transistor TDR is returned to the voltage VGSa that is the voltage at the end point of the operation period PCP1, and then gradually approaches the threshold voltage VTH of the driving transistor TDR. In other words, the first compensation operation is performed also for the standby period PWR1 of the write period PWRT, in addition to the operation period PCP1 of the compensation period PCP. As shown in FIG. 43, the voltage between the gate and the source of the driving transistor TDR at the end point of the standby period PWR1 (prior to the start of the second compensation operation) is denoted by VGSc (VGSc<VGSa). The operation thereafter is the same as that of the sixth embodiment.

K: MODIFIED EXAMPLES

The above-mentioned embodiments may be modified in various forms. Examples of detailed aspects of the modifications on the basis of the embodiments will be described in the following section. In addition, two or more aspects may be combined by optionally selecting those from the following examples.

(1) Modified Example 1

Figure 44:
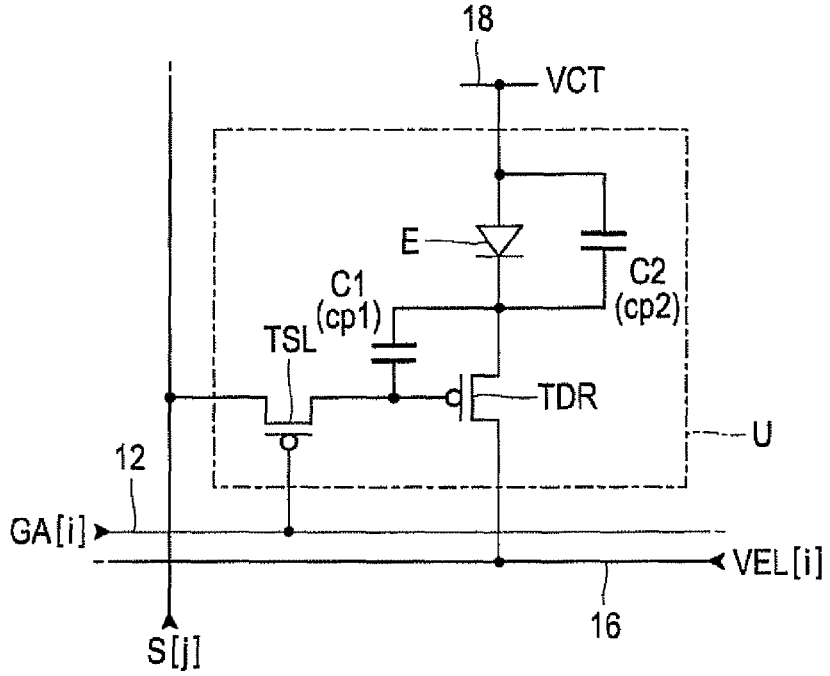
FIG. 44 is a circuit diagram showing a pixel circuit according to a modified example.

In each of the above-described embodiments, the conduction type of each switch that is disposed in the pixel circuit U may be any arbitrary type. According to the first to fourth embodiments, for example, as shown in FIG. 44, a configuration in which the driving transistor TDR or the selection switch TSL is the P-channel type may be employed. In the pixel circuit U shown in FIG. 44, the anode of the light emitting element E is connected to the feed line 18 (the electric potential VCT), and the drain of the driving transistor TDR is connected to the feed line 16 (the electric potential VEL[i]), and the source is connected to the cathode of the light emitting element E. The configuration in which the storage capacitor C1 is interposed between the gate and the source of the driving transistor TDR or the configuration in which the selection switch TSL is interposed between the gate of the driving transistor TDR and the signal line 14 are the same as those shown in FIG. 2. As described above, in a case where the P-channel driving transistor TDR is used, although the voltage relationship (low or high) is reversed, compared to a case where the N-channel driving transistor TDR is used, the basic operation is the same as the example described above. Thus, a detailed description thereof is omitted here. A configuration in which the control switch TCR1 according to the second embodiment or the control switch TCR2 according to the third embodiment is added to the pixel circuit U shown in FIG. 44 may be employed.

Figure 45:
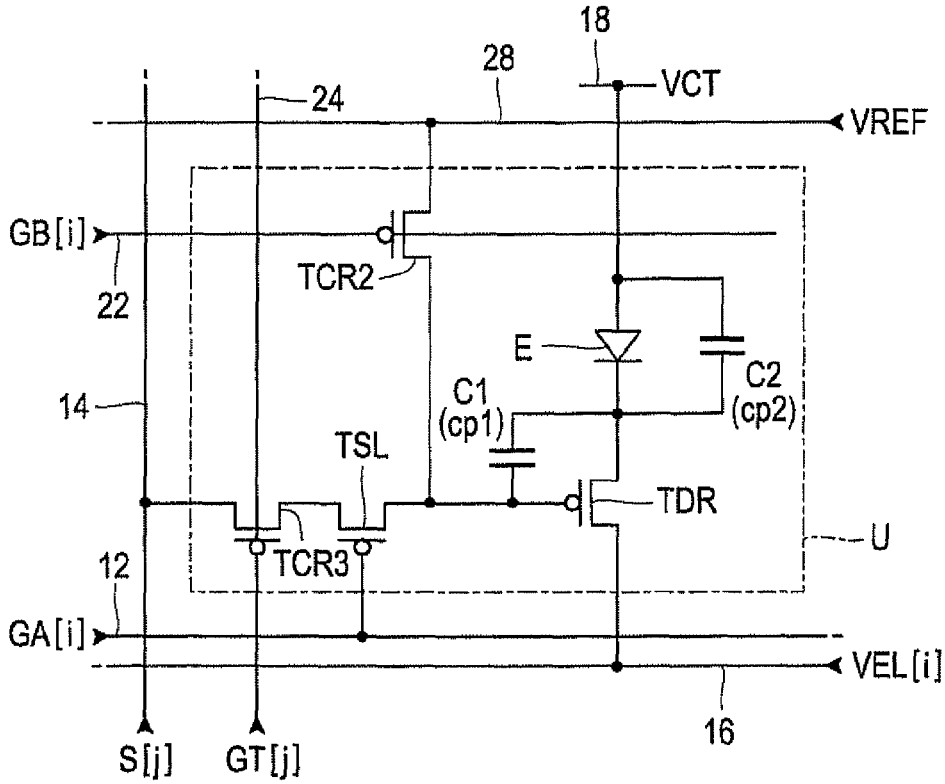
FIG. 45 is a circuit diagram showing a pixel circuit according to a modified example.

According to the fifth embodiment, for example, as shown in FIG. 45, a configuration in which the driving transistor TDR or each switch (the selection switch TSL, the control switch TCR3, the control switch TCR2) is the P-channel type may be employed. In the pixel circuit U shown in FIG. 45, the anode of the light emitting element E is connected to the feed line 18 (the electric potential VCT), and the drain of the driving transistor TDR is connected to the feed line 16 (the electric potential VEL[i]), and the source is connected to the cathode of the light emitting element E. The configuration in which the storage capacitor C1 is interposed between the gate and the source of the driving transistor TDR, the configuration in which the selection switch TSL and the control switch TCR3 are interposed between the gate of the driving transistor TDR and the signal line 14 in series, or the configuration in which the control switch TCR2 is interposed between the gate of the driving transistor TDR and the feed line 28 are the same as those shown in FIG. 19. As described above, in a case where the P-channel driving transistor TDR is used, although the voltage relationship (low or high) is reversed, compared to a case where the N-channel driving transistor TDR is used, the basic operation is the same as the example described above.

According to the sixth to tenth embodiments, for example, all or a part of the first to fifth switching elements Tr1 to Tr5 may be configured by using N-channel transistors.

(2) Modified Example 2

In the above-described fifth embodiment, the relationship between the write period PWR and the operation period PA may be appropriately changed. For example, a configuration in which the temporal length T is controlled to be changed by moving the end point of the operation period PA, which is started from the start point of the write period PWR, to the left side or the right side on the time axis or a configuration in which the temporal length T is controlled to be changed by moving the start point of the operation period PA, which ends at the end point of the write period PWR, to the left side or the right side on the time axis may be employed. In addition, a configuration in which the operation period PA is set such that the center point of the write period PWR and the center point of the operation period PA coincide with each other, and the temporal length T is controlled to be changed by moving both the start point and the end point of the operation period PA to the left side or the right side on the time axis may be employed.

(3) Modified Example 3

According to the above-described fifth embodiment, both the first compensation operation and the second compensation operation are performed. However, for example, when the error in the driving current IDR is suppressed to be within a desired range only by performing the second compensation operation, the first compensation operation may be omitted. In other words, the advantage according to an embodiment of the invention that the error in the driving current IDR is suppressed for a plurality of gray scale values D may be implemented by employing a configuration in which the temporal length T (in particular, the temporal length in which both the selection switch TSL and the control switch TCR3 are in the ON state) of the second compensation operation is controlled to be changed in accordance with the gray scale value D. Thus, the first compensation operation is not a necessary element of an embodiment of the invention.

(4) Modified Example 4

According to the above-described sixth and seventh embodiments, the light emitting element B is shifted between the ON state and the OFF state by changing the electric potential VCT[i] of the feed line 16. However, as in the eighth embodiment or the ninth embodiment, the light emission of the light emitting element E may be controlled by arranging a switching element (for example, the fourth switching element Tr4) on the path of the driving current IDR and shifting the switching element between the ON state and the OFF state.

(5) Modified Example 5

According to the above-described eighth and ninth embodiments, the light emission of the light emitting element E is controlled by shifting the fourth switching element Tr4 between the ON state and the OFF state. However, as in the sixth embodiment or the seventh embodiment, the light emitting element E may be shifted between the ON state and the OFF state by changing the electric potential VCT[i] of the feed line 16 without disposing the fourth switching element Tr4.

(6) Modified Example 6

According to the above-described eighth and ninth embodiments, the fourth switching element Tr4 is in the ON state for the reset period PRS. However, for example, it may be configured that the fourth switching element Tr4 is in the OFF state for the reset period PRS, and the fourth switching element Tr4 is in the ON state only in a period in which the driving current IDE is supplied to the light emitting element E (the driving period PDR).

(7) Modified Example 7

In the above-described embodiments, under the configuration in which a plurality of the pixel circuits U is arrayed in a matrix, in a case where the pixel circuits U are driven in units of rows in a time-division manner, there is a need for the selection switch TSL or the first switching device Tr1 to be disposed in each of the pixel circuits U. However, for example, in a configuration in which a plurality of the pixel circuits U is arrayed in only one column in the X direction, since the operation of selecting a plurality of rows in the time division manner is not needed, there is no need for the selection switch TSL or the first switching device Tr1 to be disposed in each of the pixel circuits U. For example, a light emitting device 100 where a plurality of the pixel circuits U are arrayed in only one row may be suitably adapted to an exposure apparatus that exposes an image carrier on a photosensitive drum or the like, in an electro-photographic image forming apparatus (printing apparatus).

(8) Modified Example 8

Figure 46:
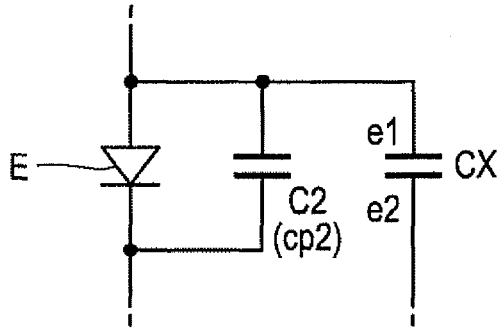
FIG. 46 is a circuit diagram of a pixel circuit according to a modified example.

In each of the above-described embodiments, the capacitance C2 that is accompanied by the light emitting element E is used. However, as shown in FIG. 46, a configuration in which a capacitor CX that is formed separately from the light emitting element E is used together with the capacitance C2 may be appropriately employed. In such a case, an electrode e1 of the capacitor CX is connected on a path (the source or the drain of the driving transistor TDR) connecting the driving transistor TDR and the light emitting element E. In addition, an electrode e2 of the capacitor CX is connected to a wiring (for example, the feed line 18 to which the electric potential VCT is supplied, the feed line 54 shown in FIG. 15 to which the reference electric potential VREF is supplied, the feed line 28 shown in FIG. 19, or the like) to which a predetermined electric potential is supplied. Under the above-described configuration, the capacitance value cp2 shown in Equation (4), Equation (12), Equation (16), Equation (23), and Equation (24) is a sum value of the capacitance of the capacitor CX and the capacitance C2 of the light emitting element E. Accordingly, the voltage VGS2 shown in Equation (4), Equation (16), and Equation (23) or the voltage VGSb shown in Equation (12) and Equation (24) can be appropriately adjusted in accordance with the capacitor CX.

(9) Modified Example 9

The organic EL device is merely an example of the light emitting device. For example, the invention may be applied to a light emitting device having light emitting elements, such as inorganic EL devices or LED (Light Emitting Diode) elements, arranged therein similarly to the above aspects. The light emitting device according to the embodiments of the invention is a component of which the gray scale (luminance) is changed by supplying current.

L: Applied Examples

Figure 47:
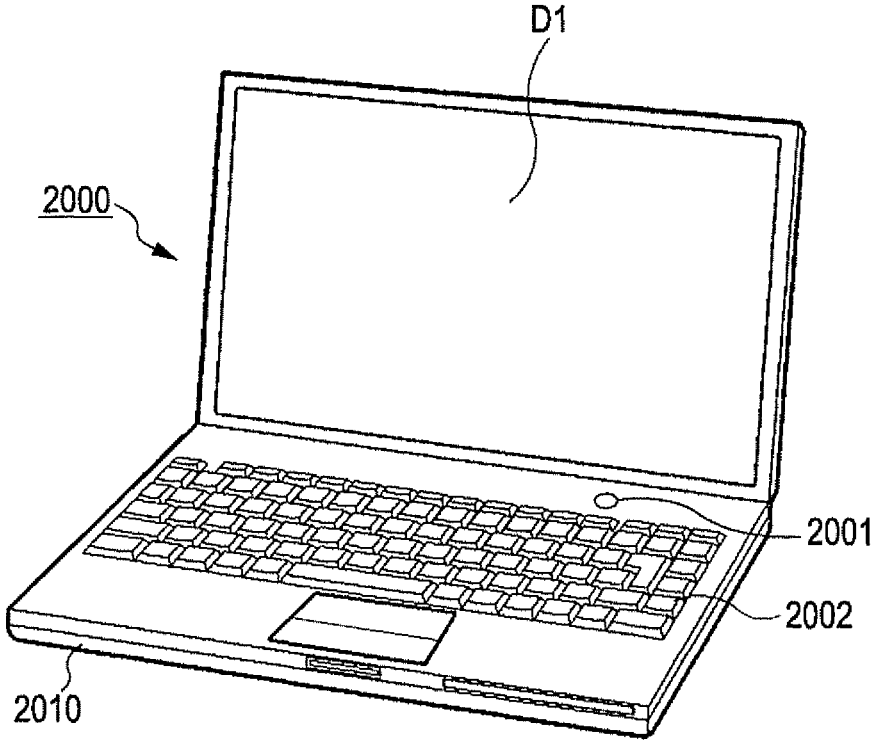
FIG. 47 is a perspective view showing an electronic apparatus (a personal computer).
Figure 48:
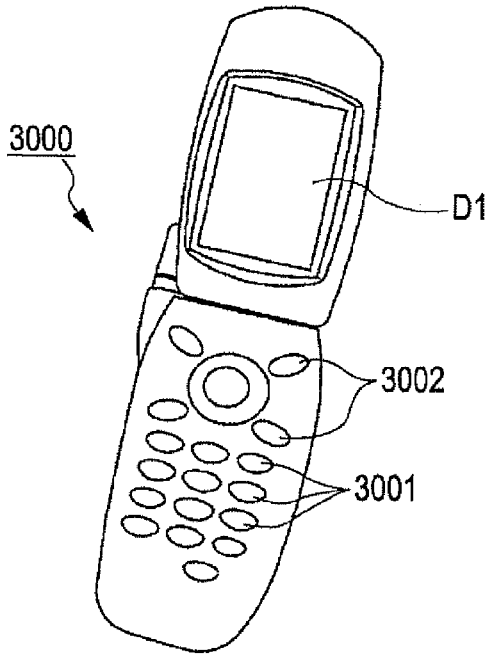
FIG. 48 is a perspective view showing an electronic apparatus (a mobile phone).
Figure 49:
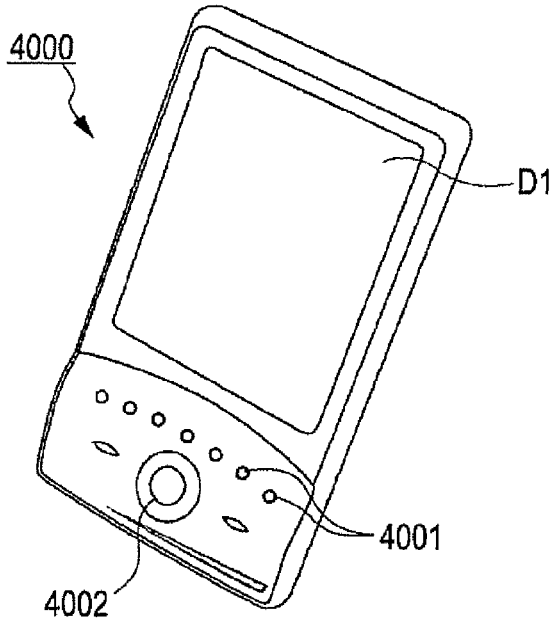
FIG. 49 is a perspective view showing an electronic apparatus (a portable information terminal).

Next, electronic apparatuses using the light emitting device 100 according to the above-described embodiment will be described. FIGS. 47 to FIG. 49 show embodiments of electronic apparatuses using the light emitting device 100 as a display device.

FIG. 47 is a perspective view illustrating a configuration of a mobile type personal computer using the light emitting device 100. The personal computer 2000 includes the light emitting device 100 for displaying various images and a main body 2010 equipped with a power switch 2001 and a keyboard 2002. The light emitting device 100 uses an organic EL device as the light emitting device E, whereby it is possible to display a visible screen with a wide viewing angle.

FIG. 48 is a perspective view illustrating a configuration of a mobile phone using the light emitting device 100. The mobile phone 3000 includes a plurality of operation buttons 3001 and scroll buttons 3002, and the light emitting device 100 used for displaying various images. By operating the scroll buttons 3002, the screen displayed on the light emitting device 100 is scrolled.

FIG. 49 is a perspective view illustrating a configuration of a portable information terminal (PDA: personal digital assistants) using the light emitting device 100. The portable information terminal 4000 includes a plurality of operation buttons 4001 and a power switch 4002, and the light emitting device 100 used for displaying various images. When the power switch 4002 is operated, various information such as an address or schedule note is displayed on the light emitting device 100.

Examples of electronic apparatuses using the light emitting device according to the embodiments of the invention include not only the apparatuses shown in FIGS. 47 to 49 but also include: a digital still camera, a television; a video camera; a car navigation system; a pager; an electronic personal organizer; an electronic sheet; an electronic calculator; a word processor; a workstation; a video telephone; a POS terminal; a printer; a scanner; a copier; a video player; a device with a touch panel; and the like. The use of the light emitting device according to the embodiment of the invention is not limited to display of an image. For example, the light emitting device according to the embodiment of the invention may be used as an exposure device for forming a latent image on a photosensitive drum by performing an exposure process in an electrophotographic-type image forming apparatus.

The entire disclosure of Japanese Patent Application Nos.: 2008-226735, filed Sep. 4, 2008, 2008-226736, filed Sep. 4, 2008 and 2008-247525, filed Sep. 26, 2008 are expressly incorporated by reference herein.

What is claimed is:

1. A method of driving a pixel circuit that includes: a light emitting element; a driving transistor that is connected to the light emitting element in series; a storage capacitor that is interposed between a path, which is formed between the light emitting element and the driving transistor, and a gate of the driving transistor; a selection switch that is interposed between the gate of the driving transistor and a signal line; and a first control switch that is interposed between the gate of the driving transistor and the signal line and is connected to the selection switch in series, the method comprising:

having a voltage between both ends of the storage capacitor gradually approach a threshold voltage of the driving transistor for a compensation period;

changing the electric potential of the gate of the driving transistor in accordance with a gray scale electric potential and having the voltage between both ends of the storage capacitor gradually approach the threshold voltage of the driving transistor for a write period after the elapse of the compensation period by supplying the gray scale electric potential according to a gray scale value that is designated to the pixel circuit to the signal line, controlling the selection switch to be in the ON state, and controlling the first control switch to be in the ON state in an operation period, which has a temporal length set to be changed in accordance with the gray scale value, of the write period; and supplying a driving current according to the voltage between the both ends of the storage capacitor to the light emitting element by stopping supply of the electric potential to the gate of the driving transistor for a driving period after elapse of the write period.

2. The method according to claim 1, wherein the temporal length of the operation period is set to be changed in accordance with the gray scale value designated to the pixel circuit, so that the temporal length of the operation period is shortened as the amount of change in the voltage between the both ends of the storage capacitor at a time when the gray scale electric potential is supplied for the write period is increased.

3. The method according to claim 1, wherein the temporal length of the operation period is set to be changed such that a value acquired by multiplying the amount of change in the voltage between the both ends of the storage capacitor at a time when the gray scale electric potential is supplied for the write period by the temporal length of the operation period approaches a predetermined value.

4. The method according to claim 1, wherein a reference electric potential is supplied to the gate of the driving transistor from a feed line other than the signal line for the compensation period.

5. A light emitting device comprising:

a pixel circuit that includes: a light emitting element; a driving transistor that is connected to the light emitting element in series; a storage capacitor that is interposed between a path, which is formed between the light emitting element and the driving transistor, and a gate of the driving transistor; a selection switch that is interposed between the gate of the driving transistor and a signal line; and a first control switch that is interposed between the gate of the driving transistor and the signal line and is connected to the selection switch in series; and a driving circuit that drives the pixel circuit, the driving circuit configured to apply a voltage between both ends of the storage capacitor to gradually approach a threshold voltage of the driving transistor for a compensation period, change the electric potential of the gate of the driving transistor in accordance with a gray scale electric potential and having the voltage between both ends of the storage capacitor gradually approach the threshold voltage of the driving transistor for a write period after the elapse of the compensation period by supplying the gray scale electric potential according to a gray scale value that is designated to the pixel circuit to the signal line, configured to control the selection switch to be in the ON state, and control the first control switch to be in the ON state in an operation period, which has a temporal length set to be changed in accordance with the gray scale value, of the write period, and configured to supply a driving current according to the voltage between the both ends of the storage capacitor to the light emitting element by stopping supply of the electric potential to the gate of the driving transistor in a driving period after elapse of the write period.

6. The light emitting device according to claim 5, wherein the pixel circuit further includes a second control switch that is interposed between the gate of the transistor and a feed line to which a reference electric potential is supplied, and wherein the driving circuit controls the second control switch to be in the ON state for the compensation period and controls the second control switch to be in the OFF state for the write period.

7. An electronic apparatus comprising the light emitting device according to claim 5.

8. A light emitting device comprising:

a light emitting element;

a driving transistor that is connected to the light emitting element in series;

a storage capacitor that is interposed between a path, which is formed between the light emitting element and the driving transistor, and a gate of the driving transistor;

a signal line to which a gray scale electric potential according to a gray scale value is supplied;

a selection switch that is interposed between the gate of the driving transistor and the signal line;

a first control switch that is interposed between the gate of the driving transistor and the signal line and is connected to the selection switch in series;

a scanning line to which a scanning signal for controlling the selection switch is supplied;

a control line to which a control signal for controlling the first control switch is supplied;

a driving circuit configured to supply the scanning signal to the scanning line, so that the selection switch is in the ON state at least for a write period within a period in which the gray scale electric potential is supplied to the signal line and supplies the control signal to the control line such that the first control switch turns on at a start point of an operation period of the write period and the first control switch turns off at an end point of the operation period, the operation period, in which the first control switch is in the ON state, having a temporal length set to be changed in accordance with the gray scale value.

9. The light emitting device according to claim 8, wherein the signal line and the control line extend in a direction intersecting the direction of the scanning line.

10. An electronic apparatus comprising the light emitting device according to claim 8.

11. A light emitting device comprising:

a pixel circuit that includes: a light emitting element; a driving transistor that is connected to the light emitting element in series; a storage capacitor that is interposed between a path, which is formed between the light emitting element and the driving transistor, and a gate of the driving transistor; a selection switch that is interposed between the gate of the driving transistor and a signal line; and a first control switch that is interposed between the gate of the driving transistor and the signal line and is connected to the selection switch in series; and driving means for driving the pixel circuit, the driving means applying a voltage between both ends of the storage capacitor to gradually approach a threshold voltage of the driving transistor for a compensation period, changing the electric potential of the gate of the driving transistor in accordance with a gray scale electric potential and having the voltage between both ends of the storage capacitor gradually approach the threshold voltage of the driving transistor for a write period after the elapse of the compensation period by supplying the gray scale electric potential according to a gray scale value that is designated to the pixel circuit to the signal line, for controlling the selection switch to be in the ON state, and controlling the first control switch to be in the ON state in an operation period, which has a temporal length set to be changed in accordance with the gray scale value, of the write period, and for supplying a driving current according to the voltage between the both ends of the storage capacitor to the light emitting element by stopping supply of the electric potential to the gate of the driving transistor in a driving period after elapse of the write period.

12. A light emitting device comprising:

a light emitting element;

a driving transistor that is connected to the light emitting element in series;

a storage capacitor that is interposed between a path, which is formed between the light emitting element and the driving transistor, and a gate of the driving transistor;

a signal line to which a gray scale electric potential according to a gray scale value is supplied;

a selection switch that is interposed between the gate of the driving transistor and a signal line;

a first control switch that is interposed between the gate of the driving transistor and the signal line and is connected to the selection switch in series;

a scanning line to which a scanning signal for controlling the selection switch is supplied;

a control line to which a control signal for controlling the first control switch is supplied; and driving means for supplying the scanning signal to the scanning line, so that the selection switch is in the ON state at least for a write period within a period in which the gray scale electric potential is supplied to the signal line, and for supplying the control signal to the control line such that the first control switch turns on at a start point of an operation period of the write period and the first control switch turns off at an end point of the operation period, the operation period, in which the first control switch is in the ON state, having a temporal length set to be changed in accordance with the gray scale value.

* * * * *